US008686908B2

(12) United States Patent
Kusunoki et al.

(10) Patent No.: US 8,686,908 B2
(45) Date of Patent: Apr. 1, 2014

(54) WIRELESS FUNCTION WATCH

(76) Inventors: Kouichi Kusunoki, Toyko (JP); Setsuo Kachi, Nishitokyo (JP)

( * ) Notice: Subject to any disclaimer, the term of this patent is extended or adjusted under 35 U.S.C. 154(b) by 888 days.

(21) Appl. No.: 12/376,898

(22) PCT Filed: Aug. 10, 2007

(86) PCT No.: PCT/JP2007/065707
§ 371 (c)(1),
(2), (4) Date: Feb. 9, 2009

(87) PCT Pub. No.: WO2008/018583
PCT Pub. Date: Feb. 14, 2008

(65) Prior Publication Data

US 2010/0164818 A1 Jul. 1, 2010

(30) Foreign Application Priority Data

Aug. 10, 2006 (JP) ..... 2006-218786
Aug. 10, 2006 (JP) ..... 2006-218788

(51) Int. Cl.
*H01Q 1/27* (2006.01)
*H01Q 1/42* (2006.01)

(52) U.S. Cl.
USPC ..... 343/718; 343/702; 343/720; 368/47

(58) Field of Classification Search
USPC ..... 343/718, 702, 720; 368/47
See application file for complete search history.

(56) References Cited

U.S. PATENT DOCUMENTS

| | | | | |
|---|---|---|---|---|
| 6,411,569 | B1 * | 6/2002 | Megner et al. | 368/43 |
| 6,853,605 | B2 | 2/2005 | Fujisawa et al. | |
| 7,102,963 | B2 | 9/2006 | Matoge et al. | |
| 7,321,337 | B2 | 1/2008 | Ikeda et al. | |
| 2002/0071346 | A1 | 6/2002 | Paratte et al. | |
| 2005/0180266 | A1 | 8/2005 | Hanai | |
| 2005/0196636 | A1 | 9/2005 | Kawakami et al. | |
| 2006/0153009 | A1 * | 7/2006 | Matoge et al. | 368/47 |
| 2008/0094942 | A1 | 4/2008 | Oguchi et al. | |

FOREIGN PATENT DOCUMENTS

| | | | |
|---|---|---|---|
| EP | 1624525 | A1 | 2/2006 |
| JP | 2001235561 | A | 8/2001 |
| JP | 2002341057 | A | 11/2002 |
| JP | 2003161788 | A | 6/2003 |
| JP | 2003329785 | A | 11/2003 |
| JP | 2004340700 | A | 12/2004 |
| JP | 2004354365 | A | 12/2004 |
| JP | 2005212461 | A | 8/2005 |
| JP | 2006189379 | A | 7/2006 |
| JP | 2004325315 | A | 6/2010 |
| WO | 03023525 | A1 | 3/2003 |

* cited by examiner

*Primary Examiner* — Jacob Y Choi
*Assistant Examiner* — Amal Patel
(74) *Attorney, Agent, or Firm* — The Webb Law Firm

(57) ABSTRACT

A wireless function watch includes an antenna for receiving a radio wave from outside; a housing for accommodating the antenna; a conductive projecting portion projecting in a planar direction from an inner wall of the housing toward the inside of a watch case; and an opening penetrating the conductive projecting portion vertically so as to improve receiving characteristics of the antenna.

52 Claims, 54 Drawing Sheets

WIRELESS FUNCTION WATCH

TECHNICAL FIELD

The present invention relates to a wireless function watch, and particularly to a wireless function watch in which an antenna for receiving a predetermined radio wave from outside is accommodated in a housing.

BACKGROUND ART

Radio-controlled timepieces provided with a radio function such as a personal-computer communication function, a cellular phone function, anon-contact IC-card function or the like have been known. As such wireless function watches, radio controlled watches which receive a standard long wave (carrier wave) containing time information and modify the time based on the time information are also widely known.

These wireless function watches are required to be provided with an antenna for receiving a predetermined radio wave, similarly to other communication equipment.

From the viewpoint of the receiving sensitivity that is a function of receiving a radio wave, a housing that accommodates an antenna for receiving a radio wave may be constituted of a non-conductive material such as a synthetic resin.

However, since these wireless function watches are watches, esthetic or high-class appearance as ornaments or accessories is required unlike other communication equipment.

Thus, a housing that accommodates an antenna for receiving a radio wave should be made of a conductive material, that is, a metal material, not a non-conductive material such as a synthetic resin. This is because a housing made of a synthetic resin gives a cheap appearance and a cheap feeling of wearing to a wearer due to its texture, tone or lightness. The demand for metal housings is particularly remarkable in watches as accessories worn by users.

However, in the case where an outer case and a caseback of such a wireless function watch are formed of metal and a dial plate is also formed of metal, the antenna is accommodated in a closed space completely shielded by the metal members, and a radio wave reaching the antenna is attenuated by the metal members. As a result, there is a problem that a required and sufficient receiving sensitivity as a wireless function watch cannot be obtained.

That is, as shown in FIG. 49, when a radio wave 104 is incident on an antenna 102 in a wireless function watch 100, an antenna core portion 106 transmits the wave 104, then a magnetic field is generated around the antenna 102, and an electric current is generated in an antenna coil 108. But if a large metal member which easily transmits magnetism is disposed in the vicinity of the antenna 102, part of the magnetic field generated around the antenna 102 is absorbed by the metal member nearby. As a result, the resonance of the antenna 102 is prevented, and a required and sufficient receiving sensitivity cannot be obtained.

Therefore, Patent Document 1 discloses a wireless function watch 100 in which a dial plate 112 that forms one of the faces of a closed space 110 accommodating an antenna 102, and a solar cell 116 held between the dial plate 112 and a watch movement 114 are formed of a non-metal material which easily transmits a radio wave. In FIG. 49, reference numeral 118 denotes an attenuated wave, reference numeral 120 denotes glass, reference numeral 122 denotes a bezel, reference numeral 124 is an outer case, and reference numeral 126 is a caseback.

According to the wireless function watch 100, a required and sufficient receiving sensitivity can be ensured even if a metal exterior is used.

Patent Document 2 discloses a radio-controlled wrist watch 200 as shown in FIG. 50, having a loop antenna 202 for receiving a radio wave, a first watch case 206 having a side face and made of a non-conductive material wherein the case accommodates the loop antenna 202 so that loop open faces 204, 204 of the loop antenna 202 are opposed to the side face, and a second watch case 210 attached so as to cover the outer side of the first watch case 206 and made of a metal material in which an opening 208 is formed in at least one of the locations opposed to the loop open faces 204, 204 of the loop antenna 202. In FIG. 50, reference numeral 212 denotes a dial plate and reference numeral 214 denotes a caseback.

The radio-controlled wrist watch 200 is configured such that in the second watch case 210 the openings 208, 208 are formed at locations opposed to the loop open faces 204, 204 of the loop antenna 202 so that a standard long wave can reach the loop open faces 204, 204 of the loop antenna 202 through the openings 208, 208.

By using the second watch case 210 in which the openings 208, 208 are formed at locations opposed to the loop open faces 204, 204 of the loop antenna 202, a standard long wave can be received by the loop antenna 202 even if the second watch case 210 made of a metal material, which is a conductive material, covers the first watch case 206 except the locations opposed to the loop open faces 204, 204.

The loop antenna 202 has the same shape as a bar-shaped bar antenna used as one of embodiments of the invention.

If a watch case and a caseback are formed of metal, a radio wave from outside is incident on the antenna mainly through a glass glass and a non-conductive dial plate.

However, a metal dial plate is often used in order to improve esthetic and high-class appearance as a watch. In this case, since the dial plate is made of metal, a good-appearance dial plate can be easily realized at low cost, but a radio wave incident from outside is shielded and attenuated by the metal dial plate.

In relation to this problem, Patent Document 3 discloses an radio controlled watch 300 as shown in FIGS. 51 and 52 wherein a receiving antenna 326 is located at a position opposed to an opening 333 provided in a metal dial plate 324 so that a radio wave entering a case 314 through the opening 333 is reliably received by the receiving antenna 326. Even though the dial plate 324 is made of metal, the decrease of a receiving sensitivity for the standard wave can be minimized.

In the wireless function watches as described above, if the watch case 124 or 210 is made of a conductive material, incident of a radio wave on the wireless function watch causes the generation of an eddy current as an induction current along a circumferential direction of an annular wall of the conductive watch case 124 or 210.

If the eddy current is generated as above, the eddy current offsets the wave from outside and the receiving sensitivity of the antenna 106 or 202 is decreased.

In order to avoid such a phenomenon, Patent Document 4 discloses a wireless function watch 400 wherein a slit 432 dividing a watch case 414 in the circumferential direction is provided in an annular wall of the watch case 414. That is, as shown in FIG. 53, the watch case 414 is completely divided in the vertical direction by the slit 432 so as to form a substantially C-shaped frame as a result.

In FIG. 53, though not shown, an insulating member made of a synthetic resin is incorporated in the slit 432, and waterproof properties and strength are ensured by the insulating member.

According to the wireless function watch 400 in which the slit 432 is formed in the axial direction of the watch case 414, an eddy current does not flow along the circumferential direction of the annular wall of the watch case 414 when the antenna 426 receives a radio wave from outside. Therefore, even with the housing 412 provided with the metal watch case 414, the antenna 426 inside can receive the radio wave.

Patent Document 1: Japanese Patent Application Laid-Open Publication No. 2004-340700

Patent Document 2: Japanese Patent Application Laid-Open Publication No. 2003-161788

Patent Document 3: Japanese Patent Application Laid-Open Publication No. 2006-189379

Patent Document 4: Japanese Patent Application Laid-Open Publication No. 2002-341057

Although the wireless function watch described in Patent Document 1 has improved receiving sensitivity by forming the dial plate and the solar cell from a non-metal material, the antenna cannot often receive a radio wave depending on a location where the wireless function watch is placed or depending on the surrounding environment or the posture of the watch.

Therefore, even with the wireless function watch in which the dial plate and the solar cell are formed of a non-metal material as in Patent Document 1, the receiving sensitivity of the antenna can hardly obtain sufficient receiving sensitivity yet. Thus, wireless function watches with improved receiving sensitivity are demanded.

In the radio-controlled wrist watch described in Patent Document 2, since an opening is provided in the first watch case on the outermost side, the inner second watch case made of a non-conductive material is seen through the opening, which damages appearance and high-class appearance. Moreover, since the inner second watch case is made of a non-conductive material, the watch is not a so-called full-metal radio-controlled wrist watch in which all the exterior parts are made of metal.

Further, since the watch cases form a double structure, the thickness in the radial direction is large and the size of the watch is excessively large.

Moreover, when the radio-controlled wrist watch is worn, the opening is brought into contact with skin, which causes bad wearing feeling and discomfort.

In the radio-controlled watch described in Patent Document 3, since the antenna is usually located adjacent to an outer circumferential portion of the movement, a projection portion or a dial ring that is not shown is present above the antenna as shown in FIG. 52. Thus, it is difficult to provide an opening in the dial plate at a position opposed to the antenna. If the opening is provided in the dial plate off the position opposed to the antenna, sufficient receiving sensitivity of the antenna cannot be obtained.

In the wireless function watch described in Patent Document 4, since the insulating member made of a synthetic resin is incorporated in the slit 432 of the watch case 414, appearance is not favorable and high-class appearance is insufficient. When compared with a watch case entirely formed of metal, it is unavoidable that strength is weaker at a portion where the insulating member is incorporated, and water-proof properties, impact resistance and chemical resistance are deteriorated.

Further, depending on a location where the wireless function watch 400 is placed or depending on the posture of the wireless function watch 400, the antenna 426 cannot often receive a radio wave sufficiently.

As mentioned above, even with the wireless function watch 400 in which the slit 432 in the height direction is formed in the annular wall of the watch case 414, the antenna 426 can hardly obtain sufficient receiving sensitivity yet.

Moreover, some wireless function watches are provided with a dial ring 536 in a watch case 514, as a wireless function watch 500 shown in FIG. 54.

The dial ring 536 is arranged between a glass 518 made of glass and a dial plate 524 in the watch case 514, and is a ring-shaped member provided with a stadium-shaped face inclined inward in the radial direction. An upper face of the dial ring 536 is a mounting face for the glass 518, and the inclined face extending downward from the upper face toward the dial plate 524 functions as an index face on which indexes indicating function display of the watch are arranged.

The dial ring 536 is made of metal or is composed of a synthetic resin member coated with a metal film, in order to achieve esthetic appearance or high-class appearance as an accessory similar to the watch case 514.

Specifically, the wireless function watch 500 shown in FIG. 54 is provided with a substantially cylindrical watch case 514 made of metal and having open ends in the vertical direction, a caseback 516 made of metal and attached on the lower-face opening of the watch case 514 so as to seal the watch case through a water-proof packing 547, and a glass 518 made of glass and attached on the upper-face opening of the watch case 514 so as to seal the watch case through a water-proof packing 546. A housing 512 is thus configured. That is, in the wireless function watch 500, a cylindrical portion with a bottom of the housing 512 except the glass 518 is composed of metal.

In the housing 512 of the wireless function watch 500, a movement 520 constituting a watch driving portion, a solar cell 522, and a dial plate 524 provided with a light transmitting function are accommodated. Moreover, an antenna 526 is attached below and aside the movement 520.

In the wireless function watch 500 with such configuration, the watch case 514 and the caseback 516 are integrated by the engagement of an engaging projecting portion 550 of a core member 548 projecting inward from the caseback 516 with an engaging recess portion 552 formed on the inner circumferential side in the vicinity of the lower end of the watch case 514. At a tip end portion of the core member 548, an annular support frame 554 made of a non-conductor is arranged.

In the wireless function watch 500, the movement 520, the solar cell 522 and the dial plate 524 are positioned and fixed by a flange-shaped dial ring receiving portion 532 formed inward in the radial direction at the upper opening side of the watch case 514, and the support frame 554 arranged on the core member 548.

When the conductive dial ring 536 is arranged on the conductive watch case 514 as mentioned above, electricity is conducted through the dial ring 536 even if the slit 522 is formed. Therefore, the receiving sensitivity of the antenna 526 cannot be improved.

The present invention was made in view of the current circumstances. It is therefore an object of the invention to provide a wireless function watch which has a favorable receiving sensitivity even with a full-metal structure and can reliably receive a predetermined radio wave with the antenna.

The present invention has another object to provide a wireless function watch which has an appearance similar to a (usual) watch not having an antenna and has esthetic appearance, high-class appearance and excellent strength.

The present invention has another object to provide a wireless function watch with favorable wearing feeling.

The present invention has another object to provide a wireless function watch without a need to excessively increase a thickness in the radial direction.

SUMMARY OF THE INVENTION

The present invention has been made in order to solve the problems in the related art and to achieve the objects.

A wireless function watch of the present invention comprises:

an antenna for receiving a radio wave from outside;

a housing for accommodating the antenna;

a conductive projecting portion projecting in a plane direction from an inner wall of the housing toward the inside of a watch case; and an opening penetrating the conductive projecting portion vertically so as to improve receiving characteristics of the antenna.

By providing the opening at the projecting portion as above, the radio wave can easily pass therethrough and the conductive projecting portion and the antenna are more separated from each other because of the presence of the opening, whereby the antenna can receive the radio wave with good sensitivity through the opening without the radio wave being shielded by the conductive projecting portion. The openings include a notch obtained by partially cutting off the projecting portion.

The remarkable effects of the opening are obvious from test results described later, and are probably derived from the following action.

Particularly when a watch case and a caseback are made of a metal material, receiving characteristics of an antenna are strongly affected by a conductive projecting portion located immediately above an open end portion of the antenna.

That is, if the conductive projecting portion is found in the vicinity of and above the antenna when the antenna receives a radio wave, the projecting portion shields the receiving of the radio wave by the antenna and reduces the receiving characteristics of the antenna.

However, according to the present invention, because the opening is provided at the projecting portion formed on the inner circumferential portion of the housing, the radio wave can easily pass therethrough and the conductive projecting portion and the antenna ensure a distance therebetween for favorable receiving sensitivity. Thus, the radio wave to be received by the antenna is not shielded by the conductive projecting portion, and the antenna can receive the radio wave with good sensitivity through the opening.

By this arrangement, the decrease of the receiving sensitivity of the antenna can be prevented, and the receiving sensitivity of the antenna is improved.

In the present invention, the conductive projecting portion may be a conductive material itself, a projecting portion in which a non-conductive member is coated with a conductive coating, or a projecting portion in which at least a part thereof is conductive.

Since the opening is provided at the projecting portion in the housing sealed from the outside, water-proof properties of the housing are not affected at all.

With regard to the housing, when the projecting portion is formed in the watch case, the watch case may be a conductive watch case and the other members may be non-conductive members such as synthetic resin.

When the opening is provided at the conductive projecting portion arranged in the housing, the radio wave to be received by the antenna is not shielded by the conductive projecting portion and the antenna can receive the radio wave with good sensitivity through the opening.

Specific examples of the conductive materials constituting the watch case include gold, silver, copper, brass, aluminum, magnesium, zinc, titanium, alloys of these metals, stainless steel, tantalum carbide and the like.

The conductive member in the present invention refers to "a member that is a conductive material itself" or "a member coated with a conductive coating". In the latter case, the material of the member may be a non-conductive material, a conductive material or a combination of a non-conductive material and a conductive material.

On the other hand, the non-conductive member refers to "a member that is a non-conductive material itself" or "a member coated with a non-conductive coating". In the latter case, the material of the member may be a non-conductive material, a conductive material or a combination of a non-conductive material and a conductive material.

Further, a wireless function watch of the present invention is characterized in that:

the projecting portion is a dial ring receiving portion.

When the projecting portion is a dial ring receiving portion as mentioned above, the opening can be covered by a dial ring mounted on the upper side of the dial ring receiving portion as described later, and the opening will not easily be visually recognized by a wearer of the watch. Thus, the esthetic appearance of the watch is hardly damaged.

Further, a wireless function watch of the present invention comprises:

the watch case constituting a part of the housing;

a conductive dial ring receiving portion projecting in a plane direction from an inner circumferential portion of the watch case toward the inside of the watch case;

a dial ring mounted on an upper side of the dial ring receiving portion; and the opening penetrating the conductive dial ring receiving portion in the vertical direction.

According to this constitution, the opening can be covered by the dial ring mounted on the upper side of the dial ring receiving portion, and the opening will not easily be visually recognized by a wearer of the watch. Thus, the esthetic appearance of the watch is hardly damaged.

Further, a wireless function watch of the present invention is characterized in that:

the opening is provided in the vicinity of and above the antenna.

By arranging the opening in the vicinity of and above the antenna as mentioned above, any conductive projecting portion that prevents the receiving of a radio wave is not present above the antenna, and the receiving sensitivity of the antenna is improved.

Further, a wireless function watch of the present invention is characterized in that:

the opening is provided in the vicinity of and above at least one of open end portions of the antenna and opposed to the at least one open end portion.

According to this constitution, since the conductive projecting portion that prevents the receiving of the radio wave is not present at a location opposed to the at least one open end portion of the antenna because of the opening, the radio wave is received by the one open end portion of the antenna through the opening and the receiving sensitivity of the antenna is improved.

Further, a wireless function watch of the present invention is characterized in that:

the openings are provided in the vicinity of and above open end portions on both sides of the antenna and opposed to the open end portions.

According to this constitution, since any conductive annular member that prevents the receiving of the radio wave is not present at locations opposed to both open end portions of the antenna because of the two openings, the radio wave is received by the open end portions of the antenna through these openings and the receiving sensitivity of the antenna is improved.

Further, a wireless function watch of the present invention is characterized in that:

the dial ring is provided with a slit penetrating the dial ring vertically to improve the receiving characteristics of the antenna; and the opening and the slit are arranged at least partially overlapping each other vertically.

According to the configuration, since the opening and the slit are at least partially overlapped with each other vertically, the radio wave is not shielded by the conductive dial ring receiving portion and the conductive dial ring and is received by the antenna through the openings.

Here, the opening is a space portion such as a notch or a slit where the conductive member is not present, and it may be a hole depending on the case.

Further, since arranging the opening and the slit in the overlapping manner ensures a long distance from the antenna to the conductive dial ring receiving portion and the conductive dial ring (a long distance to the metal portions), the receiving sensitivity of the antenna is improved.

Further, a wireless function watch of the present invention is characterized in that:

the slit at the dial ring is constituted by fully dividing the dial ring in the circumferential direction.

When the dial ring is fully divided in the circumferential direction as above, an eddy current will not flow as an induction current in the circumferential direction of the dial ring. Thus, the receiving sensitivity of the antenna will not decrease.

Further, a wireless function watch of the present invention is characterized in that:

the slit in the dial ring is constituted by two holes formed separately from each other by a length corresponding to the distance between both open end portions of the antenna.

When the slit is constituted by the two holes separated by a predetermined interval as above, the radio wave can easily pass therethrough and even if an eddy current flows in the circumferential direction through outer circumferential edge portions around the holes, the antenna can receive the radio wave passing through the holes.

Further, a wireless function watch of the present invention is characterized in that:

the slit is provided in the vicinity of and above the antenna.

Further, a wireless function watch of the present invention is characterized in that:

the slit is provided in the vicinity of and above at least one of open end portions of the antenna and opposed to the at least one open end portion.

By arranging the opening and the slit in the vicinity of and above the antenna as above, the receiving sensitivity of the antenna in a region above the antenna is improved.

Moreover, a wireless function watch of the present invention is characterized in that:

an insulating member presenting a metal appearance is interposed in the slit.

With such configuration, the slit of the dial ring is not visually recognized from outside because of the insulating member presenting a metal appearance. Therefore, the esthetic appearance is good. Since the insulating member is arranged in the housing sealed from the outside, impact resistance, abrasion resistance or chemical resistance of the housing is not lowered even if the insulating member is arranged. Moreover, since the insulating member is arranged in the slit of the dial ring, strength of the dial ring is maintained.

Further, a wireless function watch of the present invention is characterized in that:

an insulating member is interposed in the opening.

Further, a wireless function watch of the present invention is characterized in that:

the insulating member is made of a non-conductive synthetic resin.

By interposing the insulating member in the opening as above, strength of the metal case is improved. Further, by forming the insulating member from a non-conductive synthetic resin, the insulating member may be formed in advance to the size and shape of the opening and the assembling thereof to the opening is facilitated.

Further, a wireless function watch of the present invention is characterized in that:

the color tone of a visible face of the insulating member interposed in the slit is the same as the color tone of an outer face of the dial ring.

Because the color tone of the visible face of the insulating member in the slit is the same as the color tone of the outer face of the dial ring as above, the insulating member is difficult to be visually recognized, which is aesthetically favorable.

Here, the visible face refers to a region in the outer face visually recognized by an observer.

Further, the same color tone here means that an observer will recognize the color tones of the annular member and the insulating member the same as each other, and is not limited to perfect matching in esthetic properties in appearance of the tones such as deepness and darkness. For example, deep gold, light gold, bright gold and dark gold are all in the same color tone here.

For example, even if the annular member has a bright gold tone and the insulating member has a dark gold tone, the insulating member is difficult to be visually recognized as long as the outer faces of the annular member and the insulating member present the same gold tone, and the esthetic appearances of the annular member and the watch itself are improved.

The color tones of the outer faces of the dial ring and the insulating member may be the color tones of the materials themselves of the dial ring and the insulating member or the color tones of the coatings on the dial ring and the insulating member. Such coatings include paint coatings, print coatings and dry plating coatings.

The outer faces other than the visible faces of the dial ring and the insulating member may be in the same color tone, and for example, all the outer faces of the annular member and the insulating member may be in the same color tone.

Particularly, when the insulating member presents a metal appearance similar to the dial ring made of a conductive material, the insulating member is difficult to be visually recognized and the dial ring is given high-class appearance.

In order to obtain a metal appearance similar to the dial ring made of a conductive material, the insulating member may be coated by paint coating with a metallic coating in the same color tone as that of the dial ring. Examples of the metallic paint coatings include paint coatings in which metallic pigment is mixed.

For example, in order to obtain a stainless steel color, paint coatings that contain a stainless steel pigment having iron, chromium, nickel, molybdenum and the like may be applied.

In order to obtain a gold color, paint coatings that contain a bronze pigment having copper, zinc, iron and the like may be applied.

In order to obtain a silver color, paint coatings that contain an aluminum pigment having aluminum or a nickel pigment having nickel may be applied.

Further, various pigments such as pearl pigments, graphite pigments, phthalocyanine flakes and the like may be used.

A process of coating the insulating member is as follows.

First, a base coating film is applied on the outer surface of an insulating member. Then, on the base coating film, a metallic coating film is applied. Moreover, on the metallic coating film, a clear coating which is a transparent or translucent synthetic resin layer is applied. With the clear coating, the outermost surface of the coated insulating member maintains non-conductivity even though the metallic coating film contains metal.

In order to ensure non-conductivity, an insulating overcoating film such as a clear coating is preferably employed for the outermost layer not only with the metallic paint coatings but also with a single layer or a multilayer of such paint coatings as described above.

Examples of the insulating coating films include polyurethane resin coatings, fluororesin coatings in which fluorine is mixed in the polymer molecule forming the resin, vinyl chloride sol coatings in which polyvinylchloride resin is dispersed in plasticizer, silicone polyester resin coatings made of silicone polyester resins obtained by modifying oil-free polyester resin with silicone intermediate, oil-free polyester resins, acrylic resin coatings, epoxy resin coatings, silicone acrylic resin coatings, vinyl chloride resin coatings, lacquers, phenol resin coatings, chlorinated rubber coatings and the like.

Further, a wireless function watch of the present invention is characterized in that:

the color tone of a visible face of the insulating member interposed in the slit is different from the color tone of a visible face of the dial ring.

By constituting the color tone of the visible face of the insulating member incorporated in the slit of the dial ring different from that of the visible face of the dial ring as above, the esthetic appearance is improved and information may be easily recognized by observers such as wearers of the watch.

Here, the different color tones of the insulating member and the dial ring mean a combination of color tones not considered as the same tone.

Further, a wireless function watch of the present invention is characterized in that:

the insulating member interposed in the slit is provided with an index indicating a watch function display.

When the dial ring presents a metal tone, the insulating member may present a distinctive color tone such as red, orange, yellow or the like. The color tone of the outer face of the insulating member may be the color tone of the material itself of the insulating member or the color tone of the coating applied on the insulating member. The coatings include paint coatings, print coatings and dry plating coatings.

Further, a wireless function watch of the present invention is characterized in that:

an insulating region is provided between the dial ring in which at least a part thereof is conductive and the watch case in which at least a part thereof is conductive.

By providing the insulating region between the dial ring and the watch case as above, the antenna can receive the radio wave without a shielding action for the radio wave that is caused by an induction current flowing between the dial ring and the watch case in which at least apart thereof is conductive, and the antenna can receive the radio wave with good sensitivity through the opening.

The insulating region is arranged at least between the conductive portion of the watch case and the dial ring.

The insulating member constituting such an insulating region is not particularly limited, and a non-conductive insulating member such as synthetic resin, rubber, ceramic or the like may be employed.

Alternatively, the insulating member may be a member in which a conductive material is coated with an insulating film or in which an insulating sheet made of synthetic resin or rubber is attached to a conductive material. In this case, the conductive materials are similar to those that constitute the dial ring, and include gold, silver, copper, brass, aluminum, magnesium, zinc and titanium, and alloys of these metals. Further, titanium alloy, stainless steel, tantalum carbide and the like may be employed.

Examples of the non-conductive films, that is, the insulating films formed on the conductive material constituting the insulating member include non-conductive paint coatings, non-conductive print coatings, non-conductive dry plating coatings and the like.

Specific examples of the insulating films include:

DLC (diamond like carbon) coatings;

insulating coatings of organic materials such as acrylic materials, urethane-based materials, cellulose-based materials and the like;

chromium compound-based coatings containing chromium compounds; and aluminum oxide-based coatings containing aluminum oxide compounds.

The chromium compound-based coatings include chromium oxide-based coatings containing chromium oxide compounds, chromium nitride-based coatings containing chromium nitride compounds, chromium carbide-based coatings containing chromium carbide compounds and the like.

Specific examples of the methods for forming the insulating coatings include application of insulating overcoatings such as clear coats. In this case, after a paint coating is formed by metallic coating, a clear coat that is a transparent or translucent synthetic resin layer may be formed on the metallic paint coating.

Specific examples of such insulating coatings include polyurethane resin coatings, fluororesin coatings in which fluorine is incorporated in the polymer molecule forming the resin, vinyl chloride sol coatings in which polyvinylchloride resin is dispersed in plasticizer, silicone polyester resin coatings made of silicone polyester resin obtained by modifying oil-free polyester resin with silicone intermediate, oil-free polyester resins, acrylic resin coatings, epoxy resin coatings, silicone acrylic resin coatings, vinyl chloride resin coatings, lacquers, phenol resin coatings, chlorinated rubber-based coatings and the like.

Instead of such insulating coatings, there may be used insulating members in which an insulating sheet made of synthetic resin or rubber is affixed to a conductive material constituting the insulating member.

Moreover, the insulating coatings mentioned for the above insulating member may be used Further, a wireless function watch of the present invention is characterized in that:

the insulating region is constituted by an insulating member arranged between the dial ring and the watch case.

By providing the insulating member between the dial ring and the watch case as above, the antenna can receive the radio wave without a shielding action for the radio wave that is caused by an induction current flowing between the dial ring and the watch case in which at least a part thereof is conductive, and the antenna can receive the radio wave with good sensitivity through the opening.

Further, a wireless function watch of the present invention is characterized in that:

the insulating member is affixed to at least either one of boundary faces of the dial ring and the watch case.

According to this constitution, it is only necessary that a sheet-shaped insulating member is affixed to either one of the dial ring or the watch case, and the dial ring can be easily incorporated in the watch case, which improves work efficiency and reduces manufacturing costs.

Further, a wireless function watch of the present invention is characterized in that:

the insulating region is constituted by an insulating coating formed on at least either one of boundary faces of the dial ring and the watch case.

According to this constitution, the insulating region made of the insulating coating may be formed on at least either one of the boundary faces of the dial ring and the watch case by for example applying an insulating material, and work efficiency is improved and manufacturing costs are reduced.

Further, a wireless function watch of the present invention is characterized in that:

the insulating coating is formed on an entire face of the dial ring.

According to this constitution, the insulating coating may be formed by for example dipping the dial ring in an insulating material liquid, and work efficiency is improved and manufacturing costs are reduced.

Further, a wireless function watch of the present invention is characterized in that:

a bezel is provided in the watch case; and an insulating region is provided between the dial ring in which at least a part thereof is conductive and the bezel in which at least a part thereof is conductive.

By providing the insulating region between the dial ring and the bezel as above, the antenna can receive the radio wave without a shielding action for the radio wave that is caused by an induction current flowing between the dial ring and the bezel in which at least a part thereof is conductive, and the antenna can receive the radio wave with good sensitivity through the opening.

The insulating region is arranged at least between the conductive portion of the bezel and the dial ring.

The insulating members constituting the insulating region include various insulating members similar to those for the insulating region between the dial ring and the watch case.

Further, a wireless function watch of the present invention is characterized in that:

the insulating region is constituted by an insulating member arranged between the dial ring and the bezel.

By providing the insulating member between the dial ring and the bezel as above, the antenna can receive the radio wave without a shielding action for the radio wave that is caused by an induction current flowing between the dial ring and the bezel in which at least a part thereof is conductive, and the antenna can receive the radio wave with good sensitivity through the opening.

Further, a wireless function watch of the present invention is characterized in that:

the insulating member is affixed to at least either one of boundary faces of the dial ring and the bezel.

According to this constitution, it is only necessary that a sheet-shaped insulating member is affixed to either one of the dial ring or the bezel, and the dial ring and the bezel can be easily incorporated in the watch case, which improves work efficiency and reduces manufacturing costs.

Further, a wireless function watch of the present invention is characterized in that:

the insulating region is constituted by an insulating coating formed on at least either one of boundary faces of the dial ring and the bezel.

According to this constitution, the insulating region made of the insulating coating may be formed on at least either one of the boundary faces of the bezel and the dial ring by for example applying an insulating material, and work efficiency is improved and manufacturing costs are reduced.

Further, a wireless function watch of the present invention is characterized in that:

the insulating coating is formed on an entire face of the bezel.

According to this constitution, the insulating coating may be formed by for example dipping the bezel in an insulating material liquid, and work efficiency is improved and manufacturing costs are reduced.

Further, a wireless function watch of the present invention is characterized in that:

an insulating region is provided between the bezel in which at least a part thereof is conductive and the watch case in which at least a part thereof is conductive.

By providing the insulating region between the bezel and the watch case as above, the antenna can receive the radio wave without a shielding action for the radio wave that is caused by an induction current flowing between the bezel and the watch case in which at least a part thereof is conductive, and the antenna can receive the radio wave with good sensitivity through the opening.

The insulating region is arranged at least between the conductive portion of the bezel and the watch case.

The insulating members constituting the insulating region include various insulating members similar to those for the insulating region between the dial ring and the watch case.

Further, a wireless function watch of the present invention is characterized in that:

the insulating region is constituted by an insulating member arranged between the bezel and the watch case.

By providing the insulating member between the bezel and the watch case as above, the antenna can receive the radio wave without a shielding, action for the radio wave that is caused by an induction current flowing between the bezel and the watch case in which at least a part thereof is conductive, and the antenna can receive the radio wave with good sensitivity through the opening.

Further, a wireless function watch of the present invention is characterized in that:

the insulating member is affixed to at least either one of boundary faces of the bezel and the watch case.

According to this constitution, it is only necessary that a sheet-shaped insulating member is affixed to either one of the bezel or the watch case, and the bezel can be easily incorporated in the watch case, which improves work efficiency and reduces manufacturing costs.

Further, a wireless function watch of the present invention is characterized in that:

the insulating region is constituted by an insulating coating formed on at least either one of boundary faces of the bezel and the watch case.

According to this constitution, the insulating region made of the insulating coating may be formed on at least either one of the boundary faces of the bezel and the watch case by for example applying an insulating material, and work efficiency is improved and manufacturing costs are reduced.

Further, a wireless function watch of the present invention comprises:

the watch case constituting a part of a housing;

a bezel arranged on an upper face of the watch case;

a conductive dial ring receiving portion projecting in a plane direction from the bezel toward the inside of the watch case;

a dial ring mounted on the dial ring receiving portion; and the opening penetrating the dial ring receiving portion in a vertical direction.

When the opening is provided at the dial ring receiving portion of the bezel as above, the radio wave to be received can easily pass therethrough even through the dial ring receiving portion is provided at the bezel. Moreover, the conductive dial ring receiving portion and the antenna ensure a distance therebetween for favorable receiving sensitivity. Thus, the radio wave to be received by the antenna is not shielded by the conductive dial ring receiving portion, and the antenna can receive the radio wave with good sensitivity through the opening.

By this arrangement, the decrease of the receiving sensitivity of the antenna is prevented, and the receiving sensitivity of the antenna is improved.

According to the present invention, the opening is provided at the conductive projecting portion or the dial ring receiving portion formed on the inner circumferential portion of the watch case, or the opening is provided at the conductive dial ring receiving portion provided at the bezel arranged on the inner circumferential portion of the watch case. Accordingly, the radio wave to be received can easily pass through the opening, and the radio wave to be received by the antenna is not shielded by these conductive members and the antenna can receive the radio wave with good sensitivity through the opening.

By this arrangement, the decrease of the receiving sensitivity of the antenna is prevented, and the wireless function watch achieves improved receiving sensitivity of the antenna.

Further, since the opening is provided inside the wireless function watch, the wireless function watches according to the invention can have an appearance similar to (usual) watches without an antenna. Therefore, the wireless function watches have favorable esthetic appearance, high-class appearance, excellent strength and favorable wearing feeling.

The wireless function watches according to the invention do not require that the thickness in the radial direction is excessively large.

Further, even if the housing is a full-metal structure, the wireless function watches of the invention show favorable receiving sensitivity and can reliably receive a predetermined radio wave by the antenna.

Because the opening is provided at the conductive dial ring receiving portion formed on the inner circumferential portion of the watch case or the conductive dial ring receiving portion provided at the bezel arranged on the inner circumferential portion of the watch case and further because the slit is formed at the dial ring and the opening and the slit are arranged while being partially overlapped vertically, the radio wave to be received by the antenna is not shielded by these conductive members and the radio wave can be received with good sensitivity through the opening and the slit.

According to this constitution, improved receiving sensitivity of the antenna may be achieved even with the wireless function watches in which the conductive dial ring is mounted on the conductive dial ring receiving portion.

Further, by arranging the opening in the dial ring receiving portion and the slit in the dial ring on the same straight line, the distance in which any metal is not present above the antenna can be increased and the receiving sensitivity is improved more effectively.

Further, by arranging the insulating member into the slit formed in the dial ring or particularly by arranging the insulating member presenting a metal appearance into the slit, the esthetic appearance of the wireless function watches is enhanced.

Moreover, the insulating member arranged in the slit ensures strength of the dial ring.

BEST MODE FOR CARRYING OUT THE INVENTION

Embodiments (examples) of the present invention will be described below in detail based on the attached drawings.

Example 1

Figure 1:
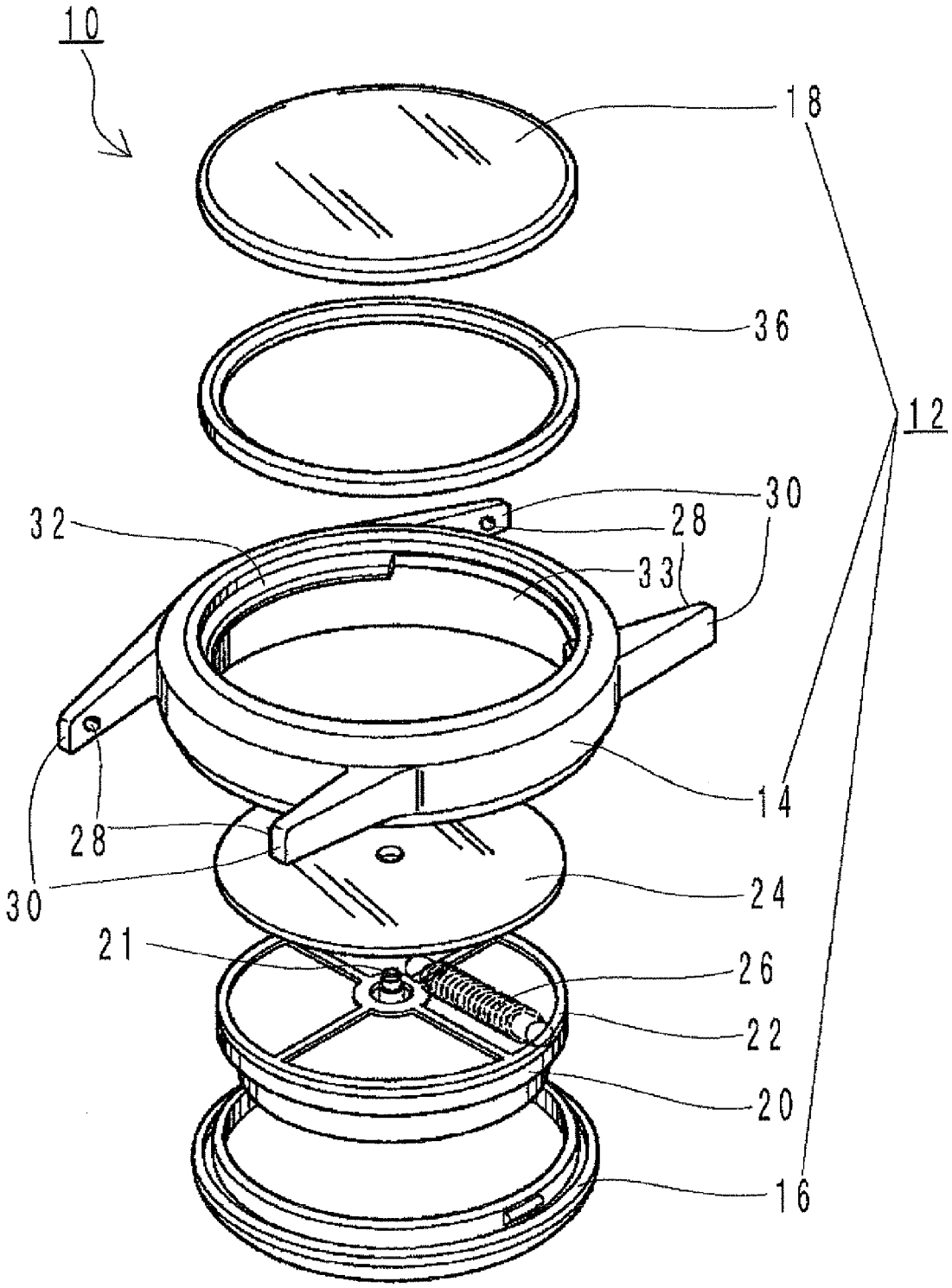
FIG. 1 is an exploded perspective view of a wireless function watch of the present invention.
Figure 2:
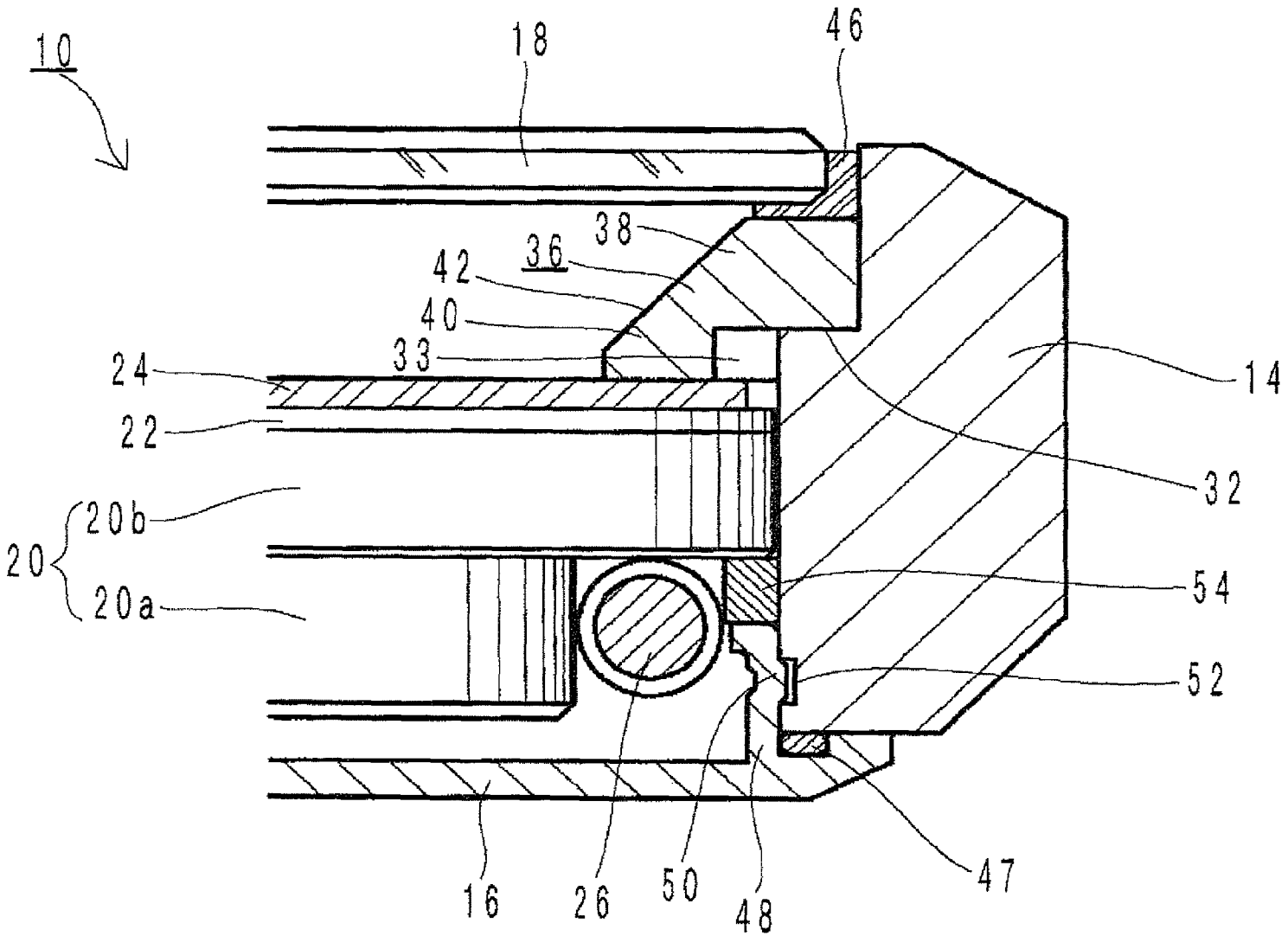
FIG. 2 is a partial sectional view of a state where the wireless function watch in FIG. 1 is assembled.

FIG. 1 is an exploded perspective view of a wireless function watch of the present invention, FIG. 2 is a partial sectional view of a state where the wireless function watch in FIG. 1 is assembled, and FIGS. 3 to 6 are top views illustrating a range of an opening in a wireless function watch of the present invention.

The present invention is directed to a wireless function watch capable of receiving a predetermined radio wave from outside with a contained antenna. The wireless function watches include watches provided with a personal computer communication function, a cellular phone function or a radio function such as a non-contact IC card function, radio controlled watches provided with a radio function for receiving a standard long wave (carrier wave) containing time information and modifying the time based on the time information, and watches constituted by combining any of these radio functions. The watches may have other radio functions.

In this specification, the "vertical direction" refers to the vertical direction in FIG. 1. Moreover, the "upper face" refers to a face exposed to the outside in a state where a wrist watch is worn on a wrist, while the "lower face" refers to a face opposed to the wrist in the same state. Further, the "plane direction" refers to the horizontal direction in FIG. 1 and the plane direction may be at the same time a longitudinal direction of a band or a width direction of a band.

A wireless function watch 10 of the present invention is provided with a housing 12 as shown in FIG. 1 or 2.

This housing 12 is provided with a watch case 14 constituting a substantially cylindrical frame body made of metal, a caseback 16 made of metal and attached in a sealed state so as to cover a lower-face opening of the watch case 14, and a glass 18 attached in a sealed state so as to cover an upper-face opening of the watch case 14.

In addition to a case where the caseback 16 is provided as described above, the housing 12 has various embodiments such as a case where the caseback 16 and the watch case 14 are integrated and a case where the caseback 16 is made of glass.

Such housing 12 contains a movement 20 constituting a watch driving portion and a solar cell 22 arranged on an upper face of the movement 20 to drive the movement 20 by an electromotive force of light.

On an upper face of the solar cell 22, a dial plate 24 that can transmit external light with a wavelength contributing to power generation of the solar cell 22 in an amount at least sufficient to drive the movement 20 is provided.

Moreover, at a small diameter portion 20*a* in a lower side position of the movement 20, an antenna 26 for receiving a standard wave is attached.

In this embodiment, the antenna 26 is shown as a bar antenna made of a rod-shaped magnetic core member and a coil wound around an outer circumference of the magnetic core member, but it is needless to say that the antenna may have other constructions.

The dial plate 24 is not particularly limited as long as it has a light transmitting function that transmits external light with a wavelength contributing to power generation of the solar cell 22. However, by constituting the dial plate with a non-conductive material such as synthetic resin, ceramic, glass, wood, sea shell or the like, the radio wave from outside can reach the antenna 26 more easily and the receiving sensitivity of the antenna 26 is improved.

Moreover, the watch case 14 is provided with two pairs of band mounting portions 28 projecting outward, and the band mounting portions 28 are constituted by leg portions 30 that are arranged at a given interval separated from and opposed to each other and are extended from the watch case 14.

A band (not shown) of the wireless function watch 10 is connected to between each pair of the leg portions 30.

Though not shown, in the wireless function watch 10 of this embodiment, a hand axis 21 projects from the movement 20 and penetrates the solar cell 22 and the dial plate 24. A minute hand and an hour hand, not shown, are arranged at the hand axis 21 so that they are located between the dial plate 24 and the glass 18 to display time.

On an inner circumferential portion of the watch case 14, a dial ring receiving portion 32 projecting in an annular form is formed, and on the dial ring receiving portion 32, a conductive annular dial ring 36 is attached.

The conductive materials constituting the dial ring 36 include gold, silver, copper, brass, aluminum, magnesium, zinc and titanium, and alloys of these metals. Further, titanium alloy, stainless steel, tantalum carbide and the like may be employed.

Alternatively, the dial ring may be so configured that a non-conductive member is used as a core material and a conductive metal coating that presents metal appearance is formed by plating or the like at least on the visible face of the core.

The dial ring 36 has, as shown in FIG. 2, a dial ring body 38 arranged on the dial ring receiving portion 32, and an extended portion 40 extended from the dial ring body 38 onto the dial plate 24 and mounted on the dial plate 24.

Further, on the inner face side of the dial ring 36, an inclined face 42 whose diameter is reduced downward is formed, and indexes such as hour letters (not shown) are formed on the inclined face 42.

On an upper end of the dial ring 36 and on the inner circumferential side of the upper end of the watchcase 14, a fixing (water-proof) packing 47 is interposed to fix the glass 18 in a sealed state, whereby the watch case 14 and the glass 18 provide sealing.

On the caseback 16, a core member 48 projecting inward is formed, and on the outer circumferential side of the core member 48, a plurality of engaging projecting portions 50 are formed at intervals therebetween. On the inner circumferential side in the vicinity of the lower end of the watch case 14, an engaging recess portion 52 in which the engaging projecting portions 50 of the core member 48 in the caseback 16 are fitted is formed.

Further, a support frame 54 is interposed between a large diameter portion 20*b* in an upper side position of the movement 20 and the upper end portion of the core member 48.

As mentioned above, the engaging projecting portions 50 of the core member 48 in the caseback 16 are engaged with the engaging recess portion 52 in the vicinity of the lower end of the watch case 14; the movement 20 and the solar cell 22 are fixed by the support frame 54; and these members are accommodated inside the watch case 14.

The support frame 54 is made of a non-conductive material such as synthetic resin. When the watch case 14 constituting a part of the housing 12 is made of a conductive material such as stainless steel, the support frame 54 ensures a gap between the conductive watch case 14 and the antenna 26 along the plane direction and keeps high receiving performance of the antenna 26.

In FIG. 2, reference numeral 47 denotes a water-proof packing for sealing between the caseback 16 and the watch case 14.

In such wireless function watch 10 as described above, if the conductive dial ring receiving portion 32 and the antenna 26 are close to each other when the antenna 26 receives a radio wave, the receiving sensitivity of the antenna 26 will be remarkably lowered.

Then, in the wireless function watch 10 of the present invention, an opening 33 is partially provided at the dial ring receiving portion 32 in order to avoid such phenomenon.

Figure 3:
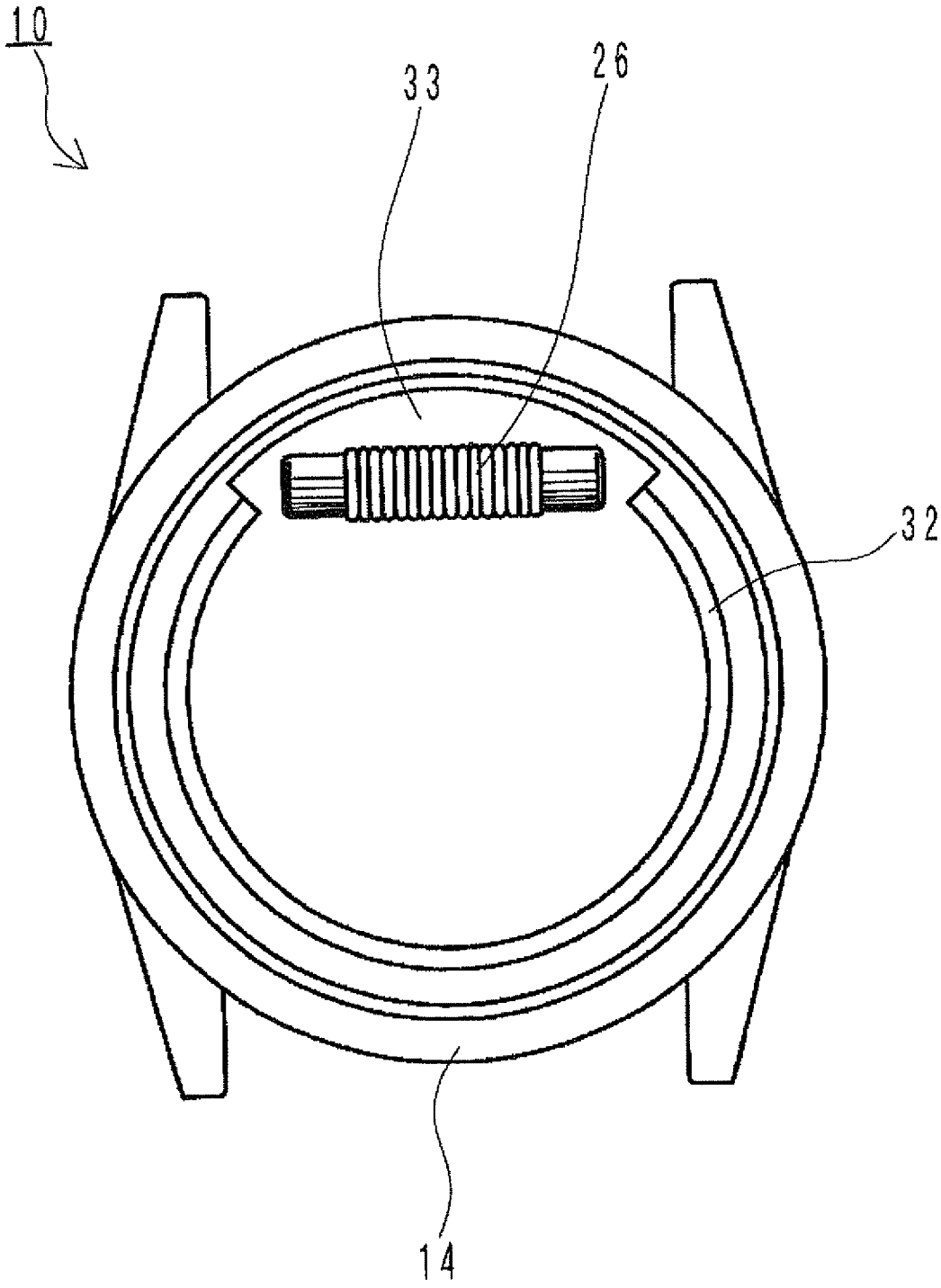
FIG. 3 is a top view illustrating a range of an opening in a wireless function watch of the present invention.

If the opening is provided in the vicinity of and above the antenna 26 as shown in FIG. 3, the dial ring receiving portion 32 that prevents the receiving of a radio wave because of its conductivity is not present above the antenna 26, and the receiving sensitivity of the antenna 26 is improved.

Figure 4:
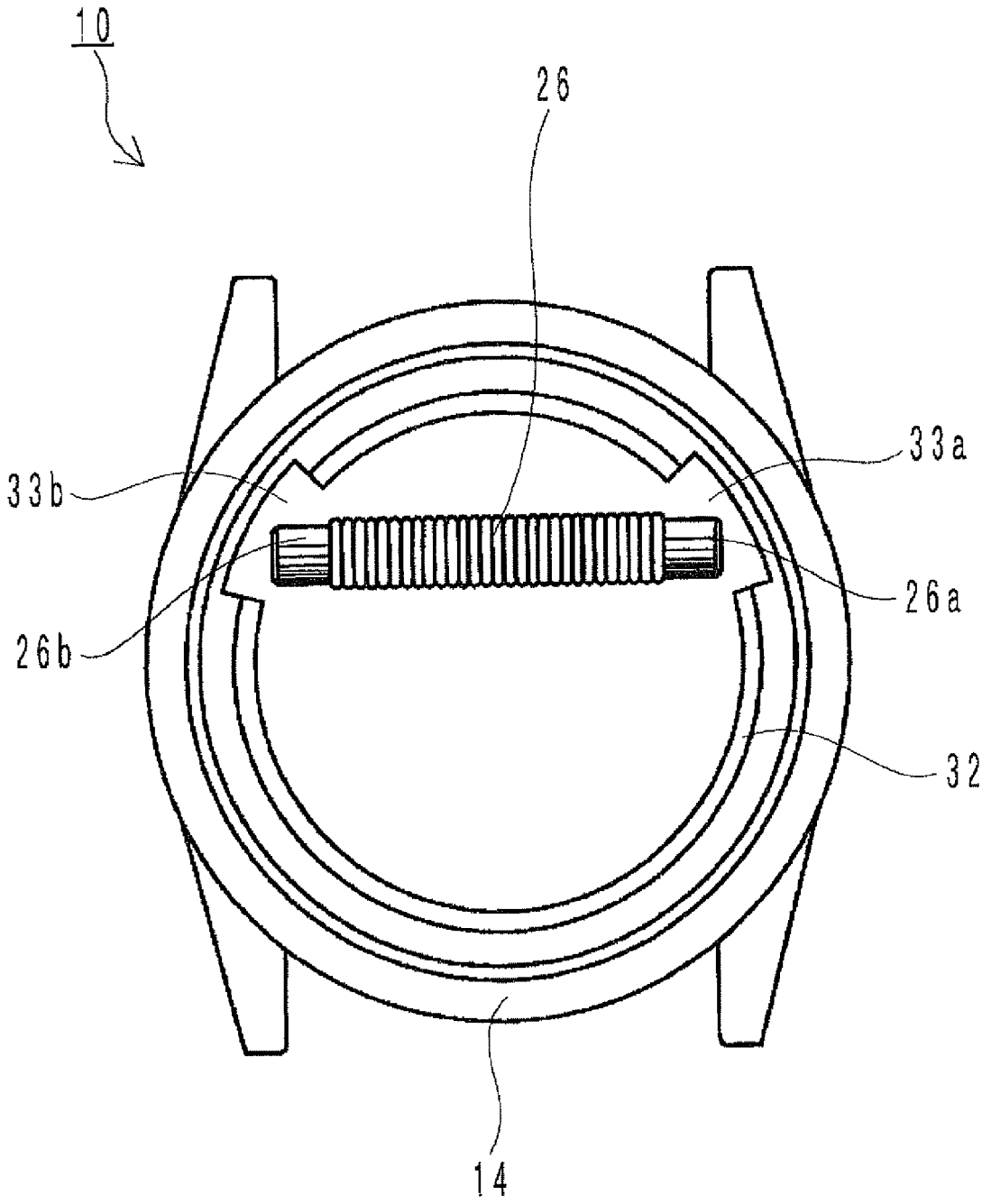
FIG. 4 is a top view illustrating a range of an opening in a wireless function watch of the present invention.

The opening 33 provided at the dial ring receiving portion 32 may be provided as openings 33*a*, 33*b* opposed to open end portions 26*a*, 26*b* on both sides of the antenna 26 as shown in FIG. 4, or may be provided only at a position opposed to at least one open end portion 26*a* of the antenna 26, though not shown.

Figure 5:
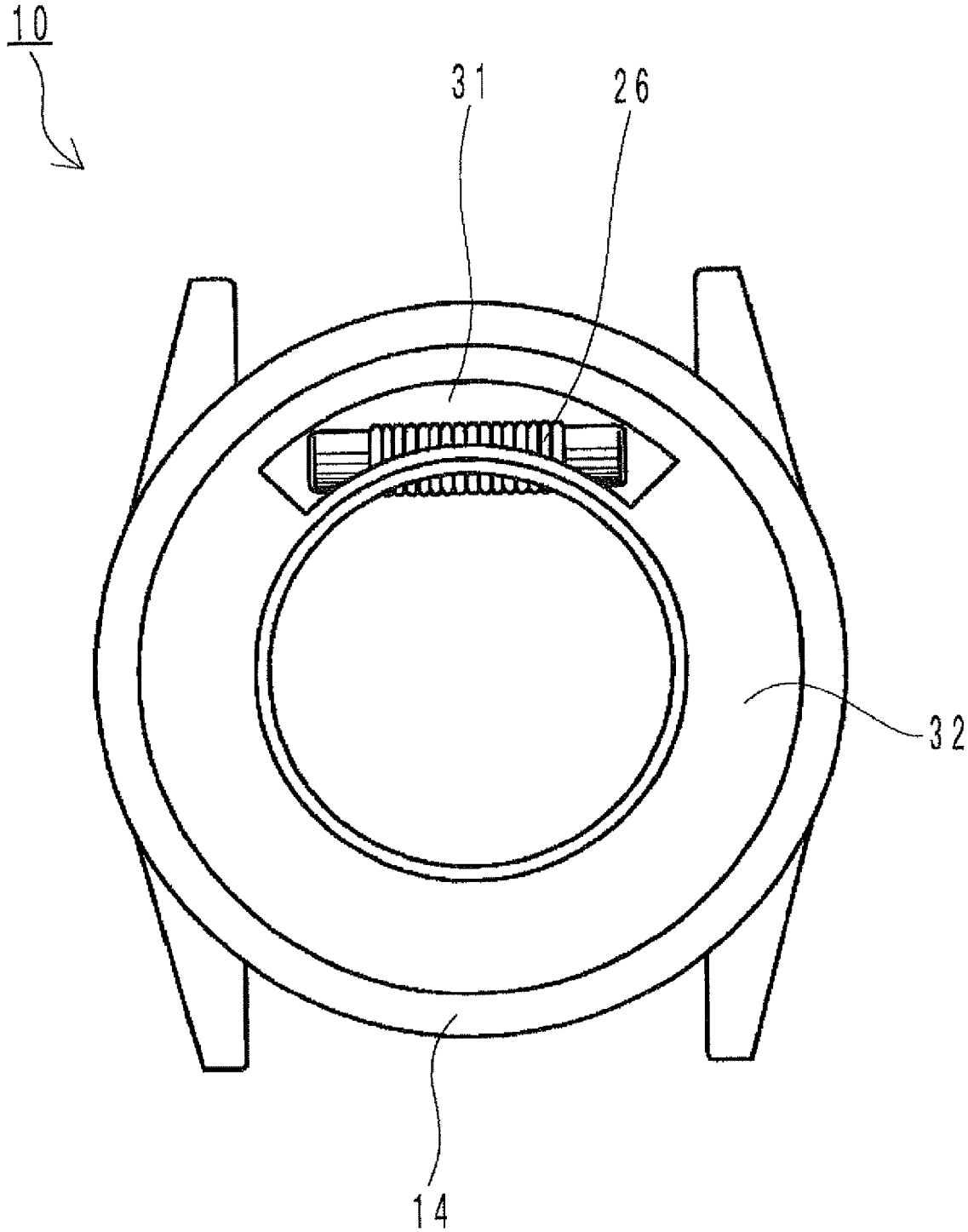
FIG. 5 is a top view illustrating a range of an opening in a wireless function watch of the present invention.
Figure 6:
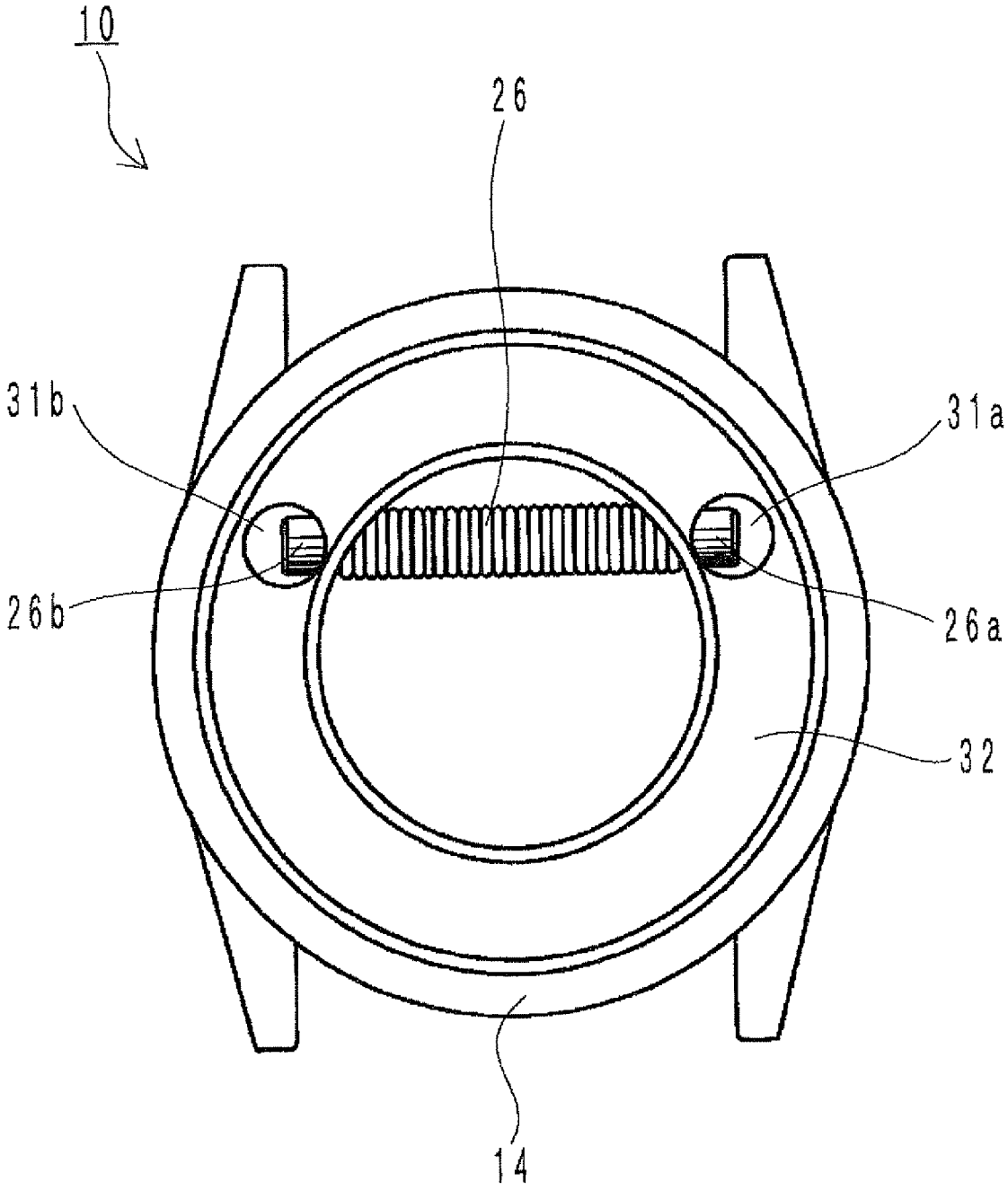
FIG. 6 is a top view illustrating a range of an opening in a wireless function watch of the present invention.

Further, instead of providing the opening 33 as a notch, a through hole 31 may be provided at the dial ring receiving portion 32 corresponding to a position in the vicinity of and above the antenna 26 as shown in FIG. 5; or through holes 31*a*, 31*b* may be provided only at locations opposed to the open end portions 26*a*, 26*b* on both sides of the antenna 26 as shown in FIG. 6.

Regarding the provision of the opening 33 and the through hole 31, if the improvement of the receiving sensitivity of the antenna 26 is particularly considered with emphasis, the opening 33 is preferably provided as shown in FIG. 3 in which the range of the opening 33 is widest among those in FIGS. 3 to 6.

By providing the opening 33 and the through hole 31 at the dial ring receiving portion 32 as above, the radio wave can easily pass therethrough, and a distance for favorable receiving sensitivity is ensured between the conductive dial ring receiving portion 32 and the antenna 26.

Thus, the radio wave to be received by the antenna 26 is not shielded by the conductive dial ring receiving portion 32 and the antenna 26 can receive the radio wave with good sensitivity through the opening 33 and the through hole 31.

By this arrangement, the decrease of the receiving sensitivity of the antenna 26 is prevented, and the receiving sensitivity of the antenna 26 can be improved.

Example 2

Figure 7:
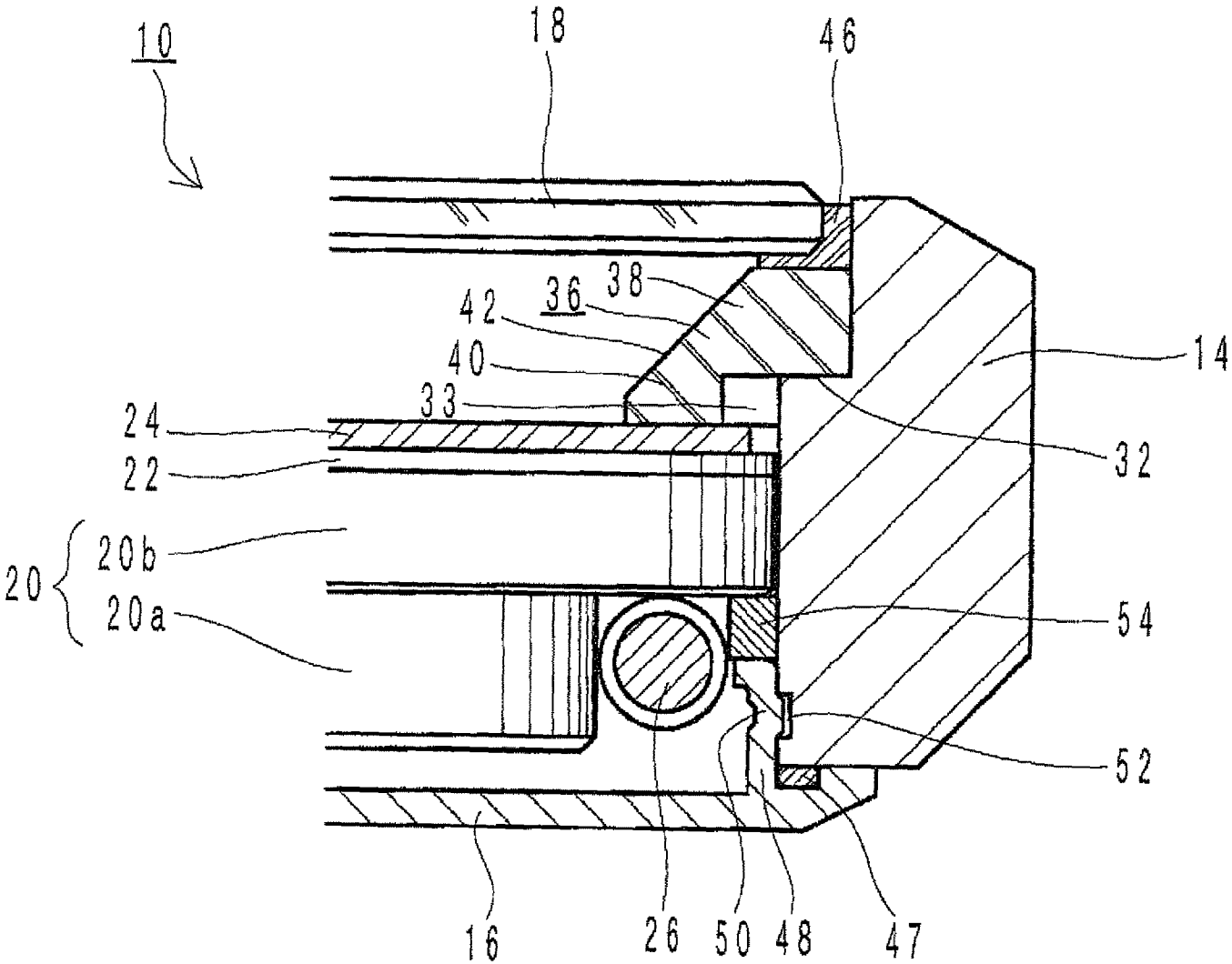
FIG. 7 is a partial sectional view similar to FIG. 2 in a wireless function watch according to another embodiment of the present invention.

FIG. 7 is an exploded perspective view illustrating a wireless function watch of another embodiment of the present invention.

A wireless function watch 10 of this embodiment has basically the same configuration as that of the wireless function watch 10 of the embodiment shown in FIG. 1 or 2, and the same reference numerals are given to the same constituting members and the detailed explanation will be omitted.

In the wireless function watch 10 shown in FIG. 7, a non-conductive dial ring 36 is attached to a dial ring receiving portion 32.

The material of such non-conductive dial ring 36 is not particularly limited and a non-conductive insulating member such as synthetic resin, rubber, ceramic or the like can be employed.

Alternatively, the dial ring may be a member in which a conductive material is coated with a non-conductive film.

In this case, the conductive materials constituting the dial ring 36 include gold, silver, copper, brass, aluminum, magnesium, zinc and titanium, and alloys of these metals. Further, titanium alloy, stainless steel, tantalum carbide and the like may be employed.

Examples of the non-conductive films, that is, the insulating films formed on the conductive material constituting the dial ring 36 include non-conductive paint coatings, non-conductive print coatings, non-conductive dry plating (CVD) coatings and the like.

Specific examples of the insulating films include:

DLC (diamond like carbon) coatings;

insulating coatings of organic materials such as acrylic materials, urethane-based materials, cellulose-based materials and the like;

chromium compound-based coatings containing chromium compounds; and aluminum oxide-based coatings containing aluminum oxide compounds.

The chromium compound-based coatings include chromium oxide-based coatings containing chromium oxide compounds, chromium nitride-based coatings containing chromium nitride compounds, chromium carbide-based coatings containing chromium carbide compounds and the like.

Specific examples of the methods for forming the insulating coatings include application of insulating overcoatings such as clear coats. In this case, after a paint coating is formed by metallic coating, a clear coat that is a transparent or translucent synthetic resin layer may be formed on the metallic paint coating.

Specific examples of such insulating coatings include polyurethane resin coatings, fluororesin coatings in which fluorine is incorporated in the polymer molecule forming the resin, vinyl chloride sol coatings in which polyvinylchloride resin is dispersed in plasticizer, silicone polyester resin coatings made of silicone polyester resin obtained by modifying oil-free polyester resin with silicone intermediate, oil-free polyester resins, acrylic resin coatings, epoxy resin coatings, silicone acrylic resin coatings, vinyl chloride resin coatings, lacquers, phenol resin coatings, chlorinated rubber-based coatings and the like.

Instead of such insulating coatings, there may be used insulating members in which an insulating sheet made of synthetic resin or rubber is affixed to a conductive material constituting the insulating member.

Moreover, the insulating coatings mentioned for the above insulating member may be used.

According to the present embodiment wherein the opening 33 is provided at the dial ring receiving portion 32 and the dial ring 36 mounted on the dial ring receiving portion 32 is made of a non-conductive material, the receiving sensitivity of the antenna 26 can be more improved than the wireless function watch 10 in the Example 1.

Example 3

Figure 8:
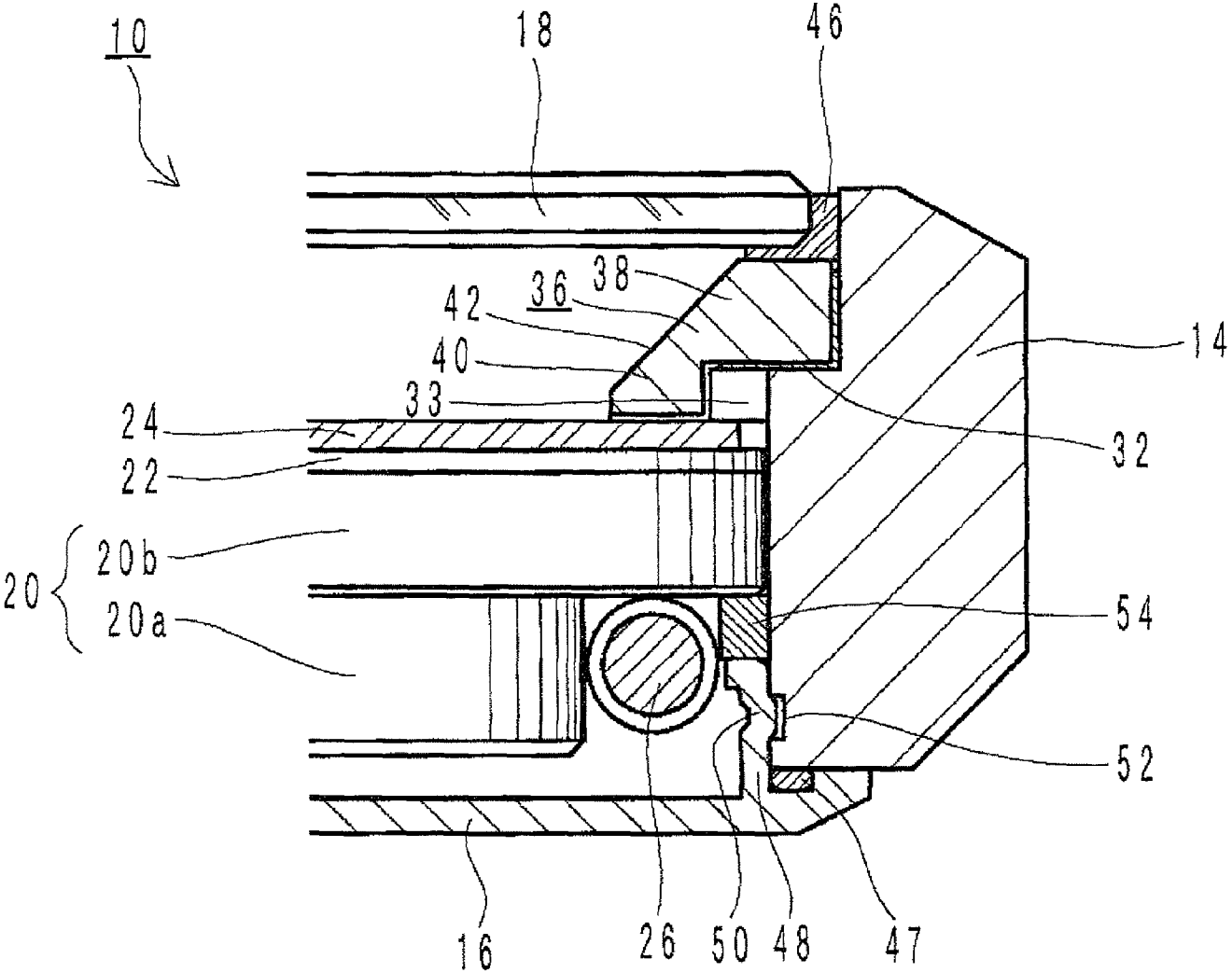
FIG. 8 is a partial sectional view of a wireless function watch according to another embodiment of the present invention wherein an insulating region is provided.
Figure 9:
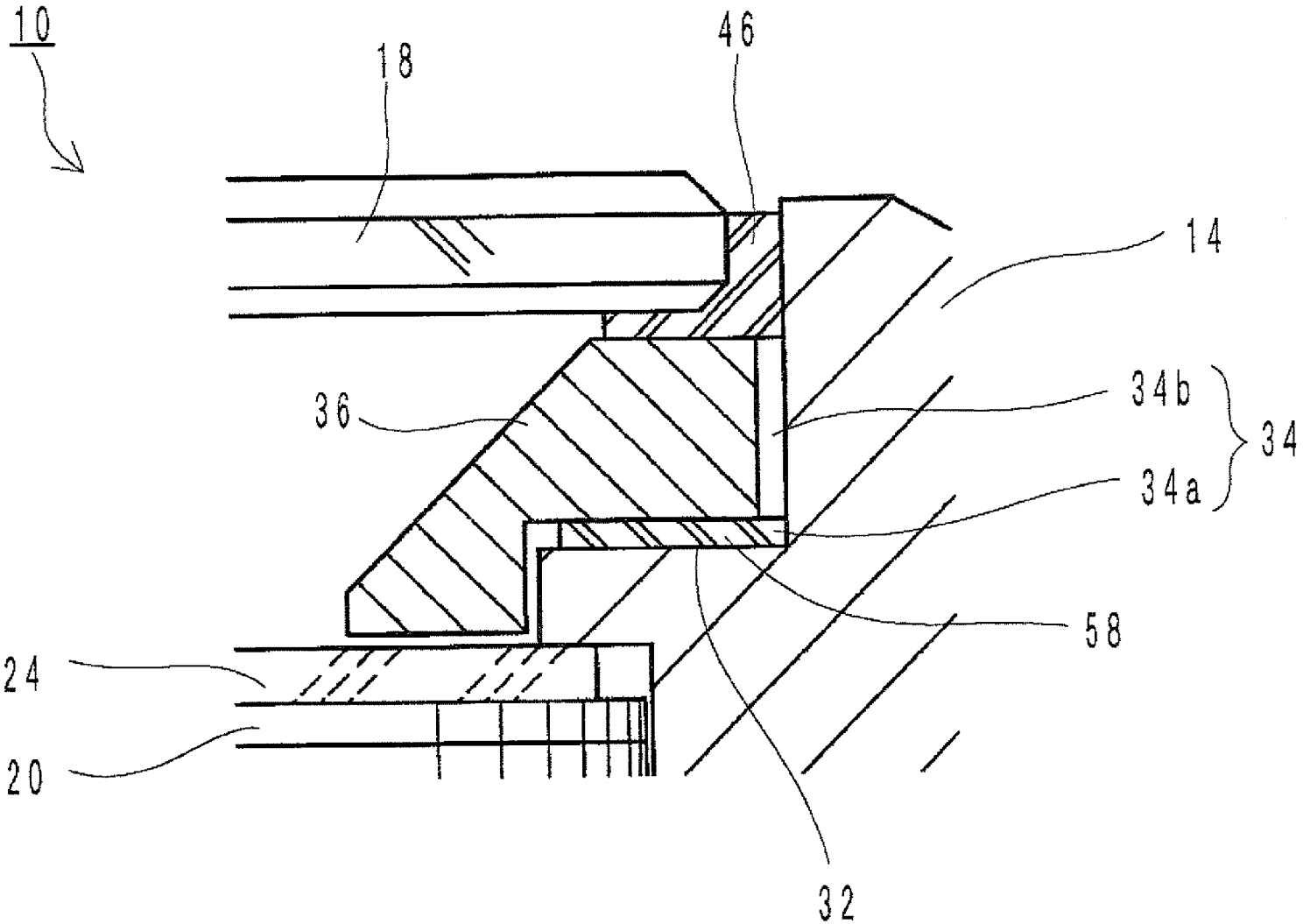
FIG. 9 is an enlarged partial sectional view illustrating another range of an insulating region from FIG. 8.
Figure 10:
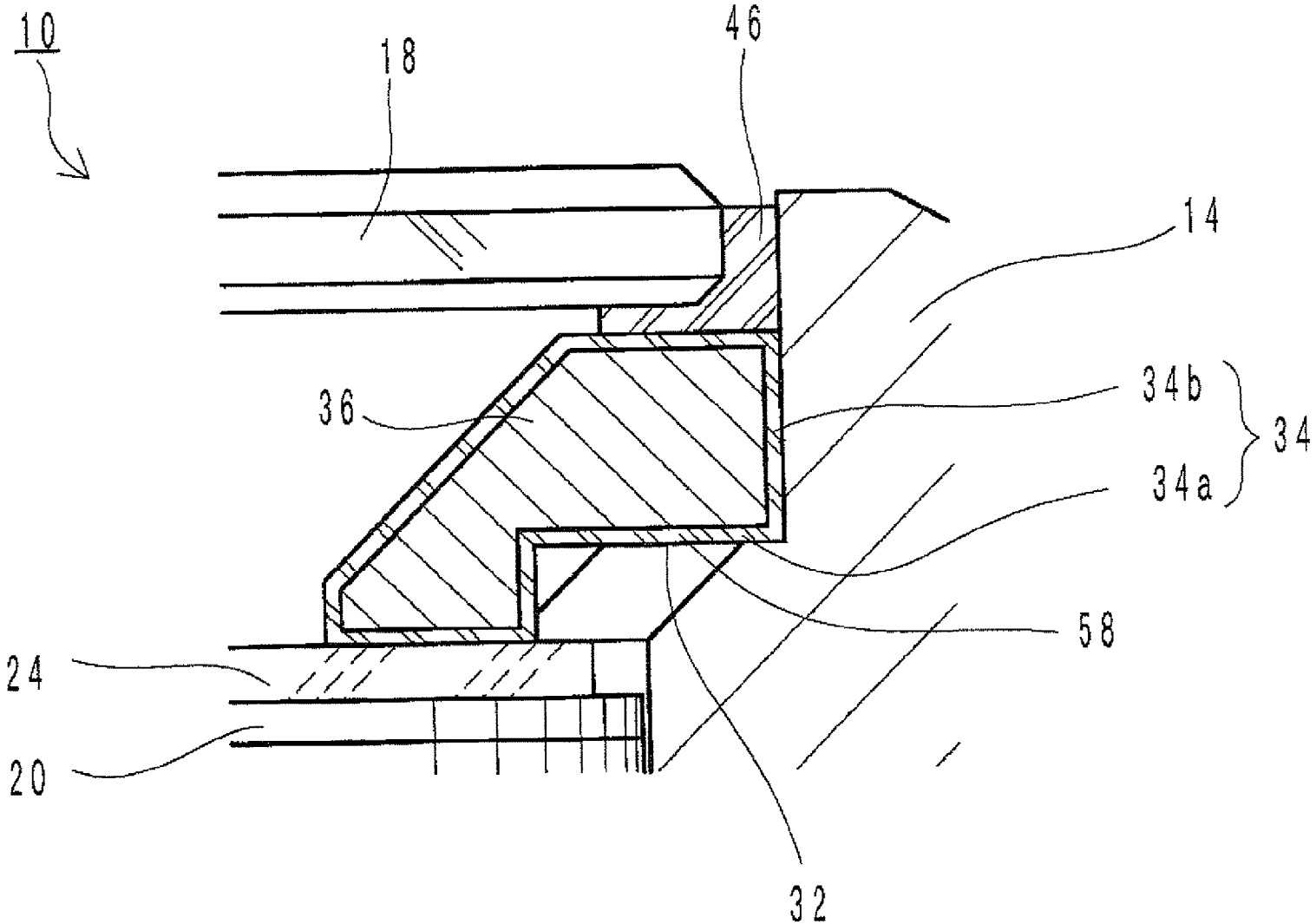
FIG. 10 is an enlarged partial sectional view illustrating another range of an insulating region from FIG. 8.

FIG. 8 is a partial sectional view illustrating a wireless function watch of another embodiment of the present invention, FIG. 9 is an enlarged partial sectional view illustrating another range of an insulating region from FIG. 8, and FIG. 10 is an enlarged partial sectional view illustrating another range of an insulating region from FIG. 8.

A wireless function watch 10 of this embodiment has basically the same configuration as that of the wireless function watch 10 of the embodiment shown in FIG. 1 or 2, and the same reference numerals are given to the same constituting members and the detailed explanation will be omitted.

In the wireless function watch 10 shown in FIG. 8, an insulating region 58 is provided between the dial ring receiving portion 32 of the watch case 14 and the dial ring 36 in addition to the provision of the opening 33 at the dial ring receiving portion 32 in order to improve the receiving sensitivity of the antenna 26.

By providing the insulating region 58 between the dial ring receiving portion 32 and the dial ring 36 as above, the antenna 26 can receive a radio wave without a wave shielding action caused by an induction current flowing between the conductive dial ring receiving portion 32 and the dial ring 36, and the antenna 26 can receive the radio wave with good sensitivity through the opening 33.

The insulating region 58 may be constituted by an insulating member, or the insulating region 58 may be constituted by an insulating film formed on at least one of the boundary faces of the dial ring 36 and the watch case 14.

Since the insulating region 58 in the form of film may be easily formed between the dial ring 36 and the watch case 14 by painting, deposition or the like, work efficiency is good and manufacturing costs can be reduced.

Though the insulating region 58 is formed along an upper face 34*a* and a side face 34*b* of a stepped portion 34 of the dial ring receiving portion 32 in FIG. 8, it should be formed at least along the upper face 34*a* of the stepped portion 34 of the dial ring receiving portion 32 as shown in FIG. 9.

Alternatively, an insulating film as the insulating region 58 may be formed on the entire face of the dial ring 36 as shown in FIG. 10. In this case, the insulating film may be formed by dipping the dial ring 36 in an insulating material liquid.

The number and positions of the insulating regions 58 are not particularly limited, and an insulating film may be formed as the insulating region 58 only at a position corresponding to the position of the antenna 26. The insulating region may be preferably formed at a position as shown in FIGS. 11 to 13.

Figure 11:
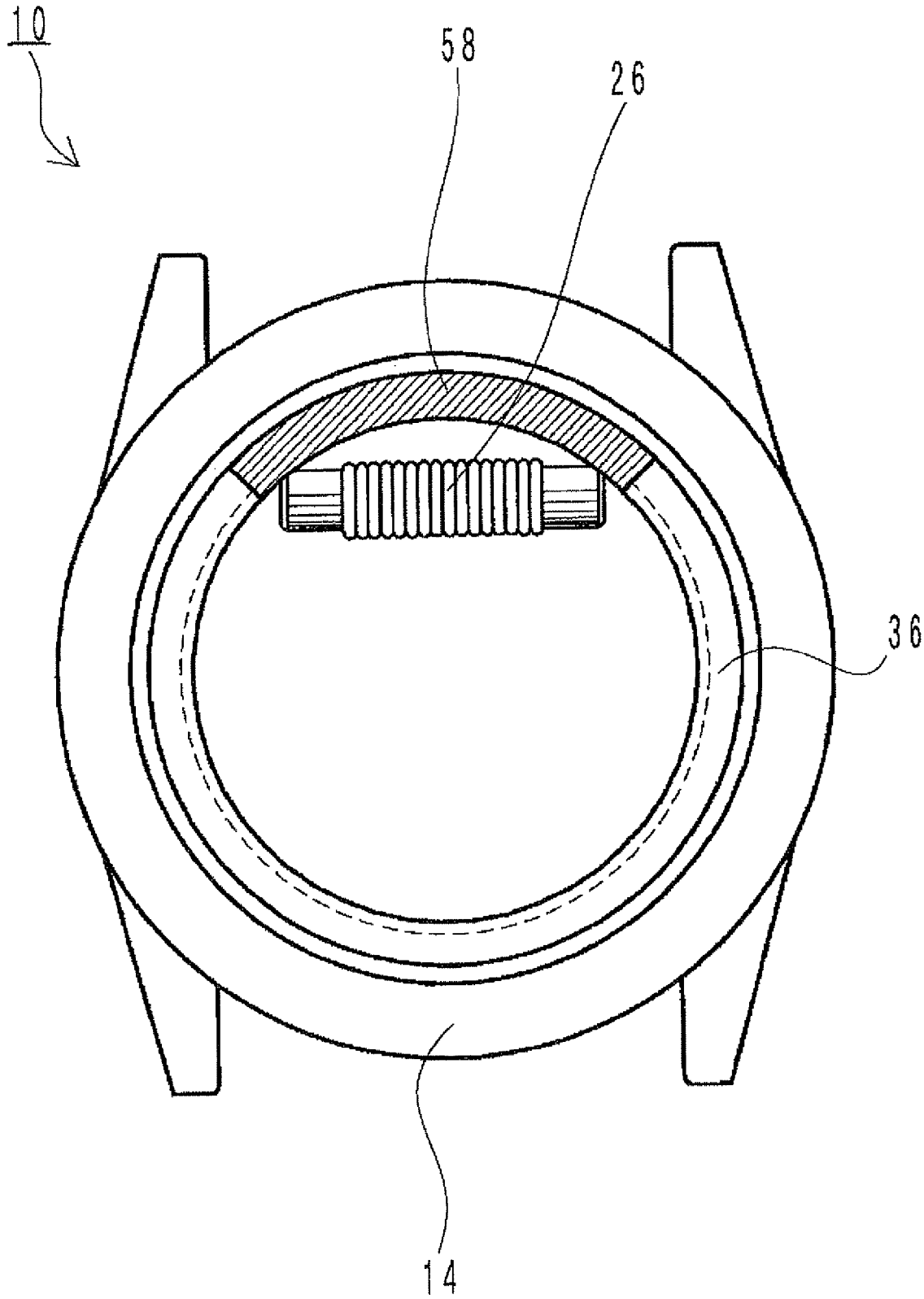
FIG. 11 is a top view illustrating a position of the insulating region in a wireless function watch of the present invention.

In detail, the insulating region 58 shown in FIG. 11 is arranged in the vicinity of and above the antenna 26.

By arranging the insulating region 58 in the vicinity of and above the antenna 26, a wave shielding action caused by an induction current flowing between the conductive dial ring 36 and the watch case 14 can be suppressed above the antenna 26 when the antenna 26 receives a radio wave, and the antenna 26 can receive the radio wave with good sensitivity through the opening 33.

Figure 12:
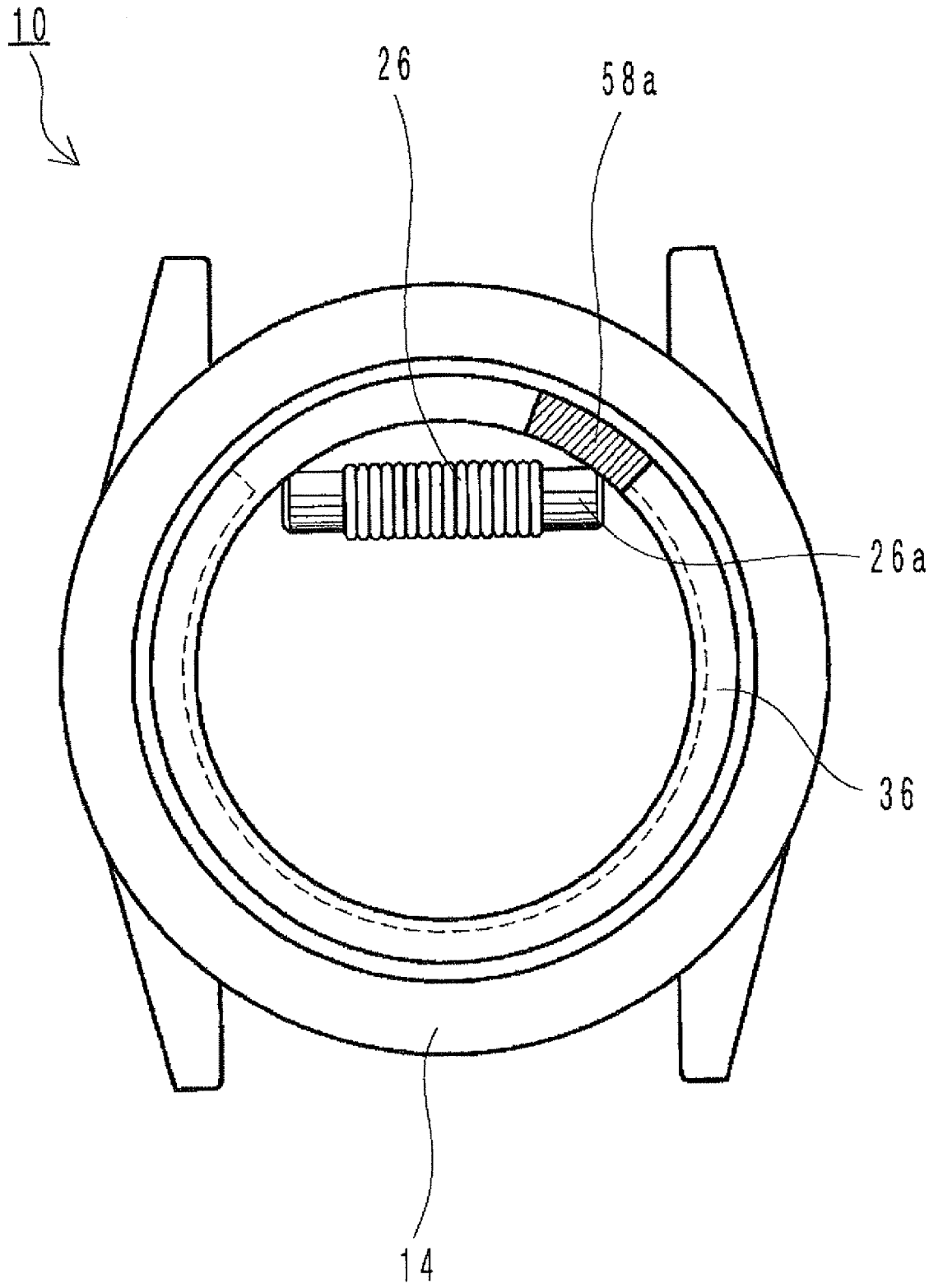
FIG. 12 is a top view illustrating a position of the insulating region in a wireless function watch of the present invention.
Figure 13:
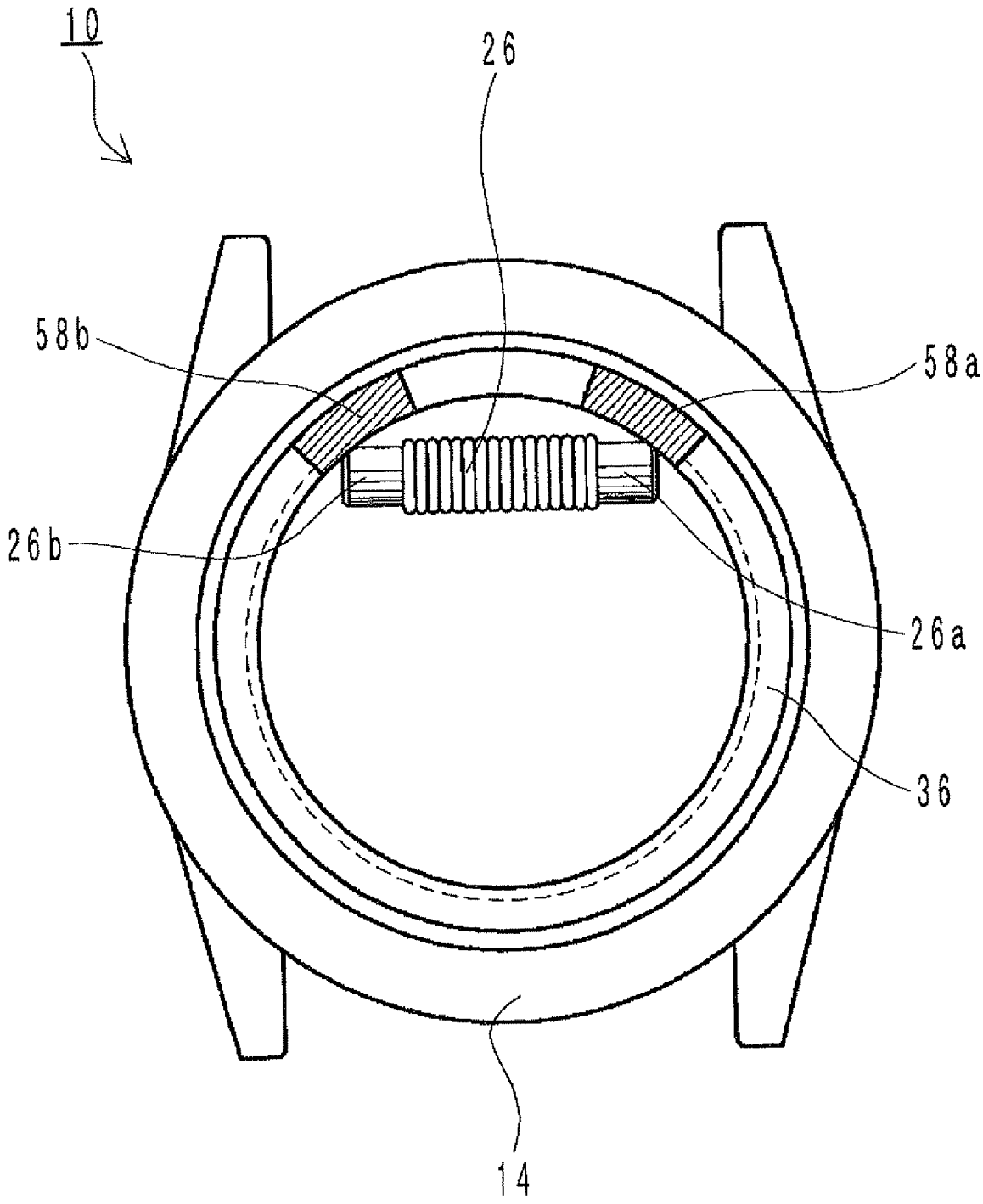
FIG. 13 is a top view illustrating positions of the insulating regions in a wireless function watch of the present invention.

Further, as shown in FIG. 12, the insulating region 58 may be constituted by an insulating region 58*a* arranged in the vicinity of and above the antenna 26 and opposed to at least one open end portion 26*a* of the antenna 26.

Moreover, as shown in FIG. 13, the insulating region 58 may be constituted by two insulating regions 58*a*, 58*b* arranged in the vicinity of and above the antenna 26 and opposed to open end portions 26*a*, 26*b* of the antenna 26.

The range in which the insulating region 58 is provided is preferably such that a desired receiving sensitivity of the antenna 26 can be obtained.

Example 4

Figure 14:
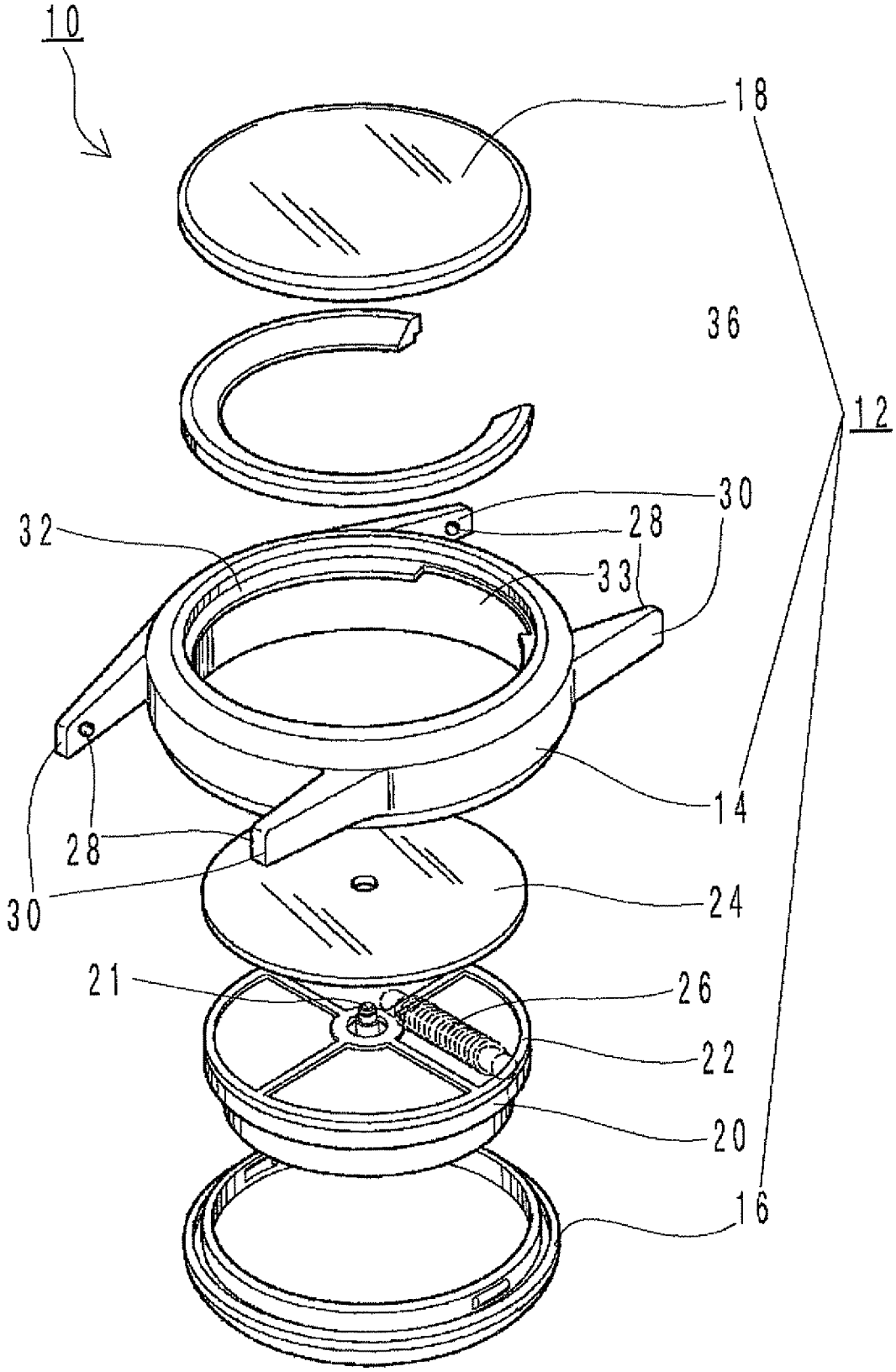
FIG. 14 is an exploded perspective view of a wireless function watch according to another embodiment of the present invention.
Figure 15:
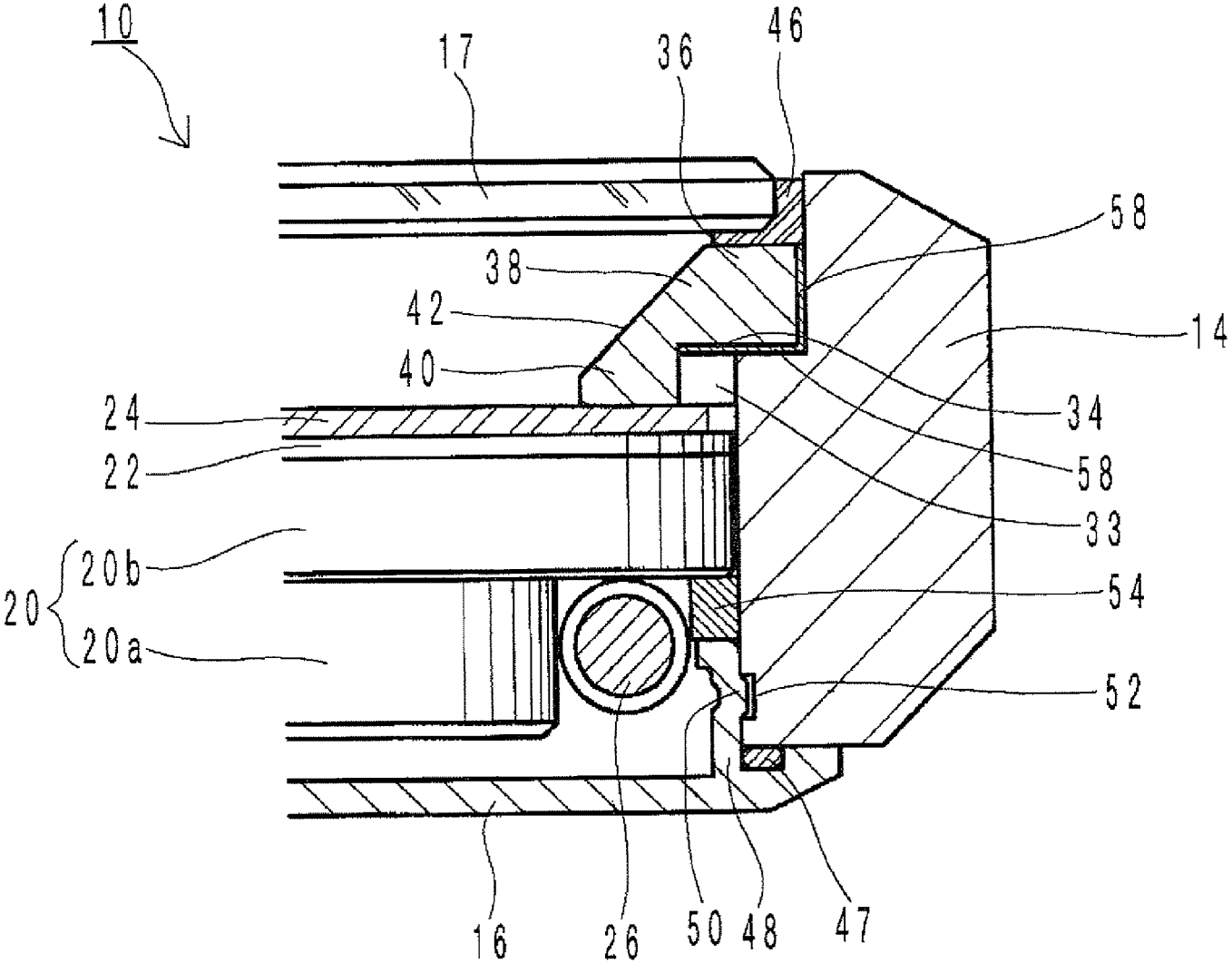
FIG. 15 is an enlarged partial sectional view in a state where the wireless function watch shown in FIG. 14 is assembled.
Figure 16:
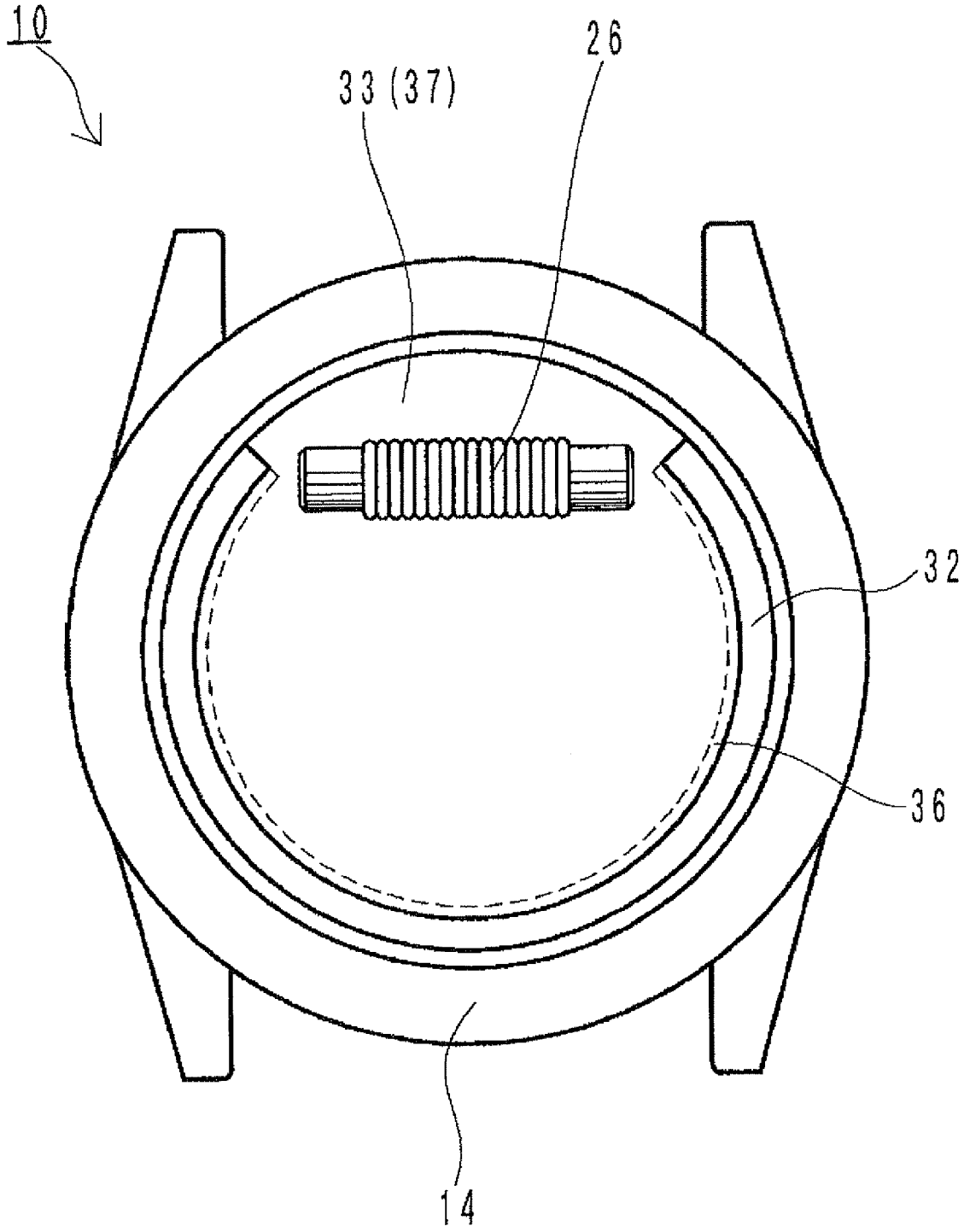
FIG. 16 is a schematic plan view illustrating an arrangement relation between an antenna and a dial ring receiving portion in the wireless function watch shown in FIG. 14.
Figure 17:
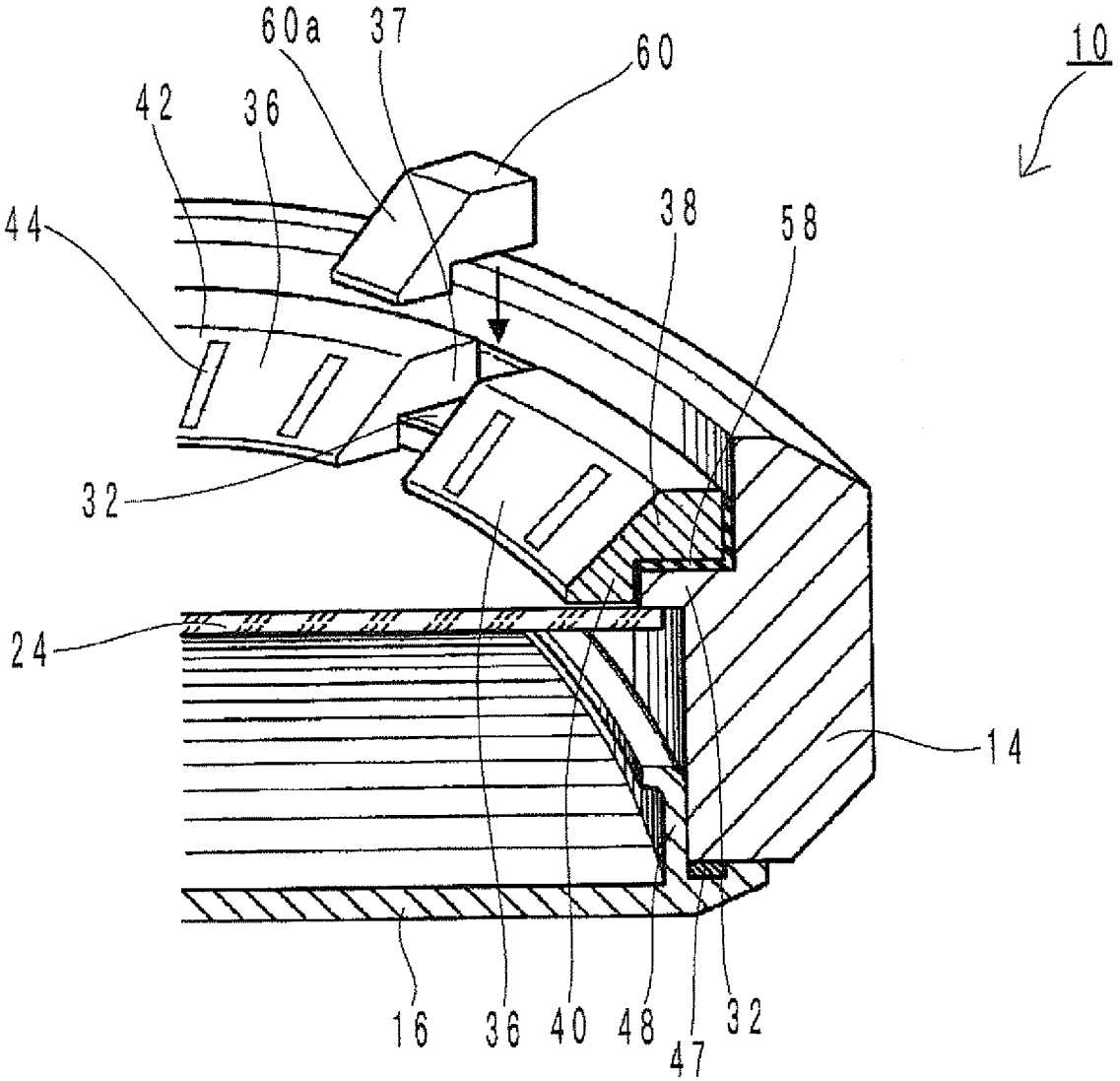
FIG. 17 is a schematic perspective view showing the fitting of an insulating member in a dial ring of the wireless function watch shown in FIG. 14.
Figure 18:
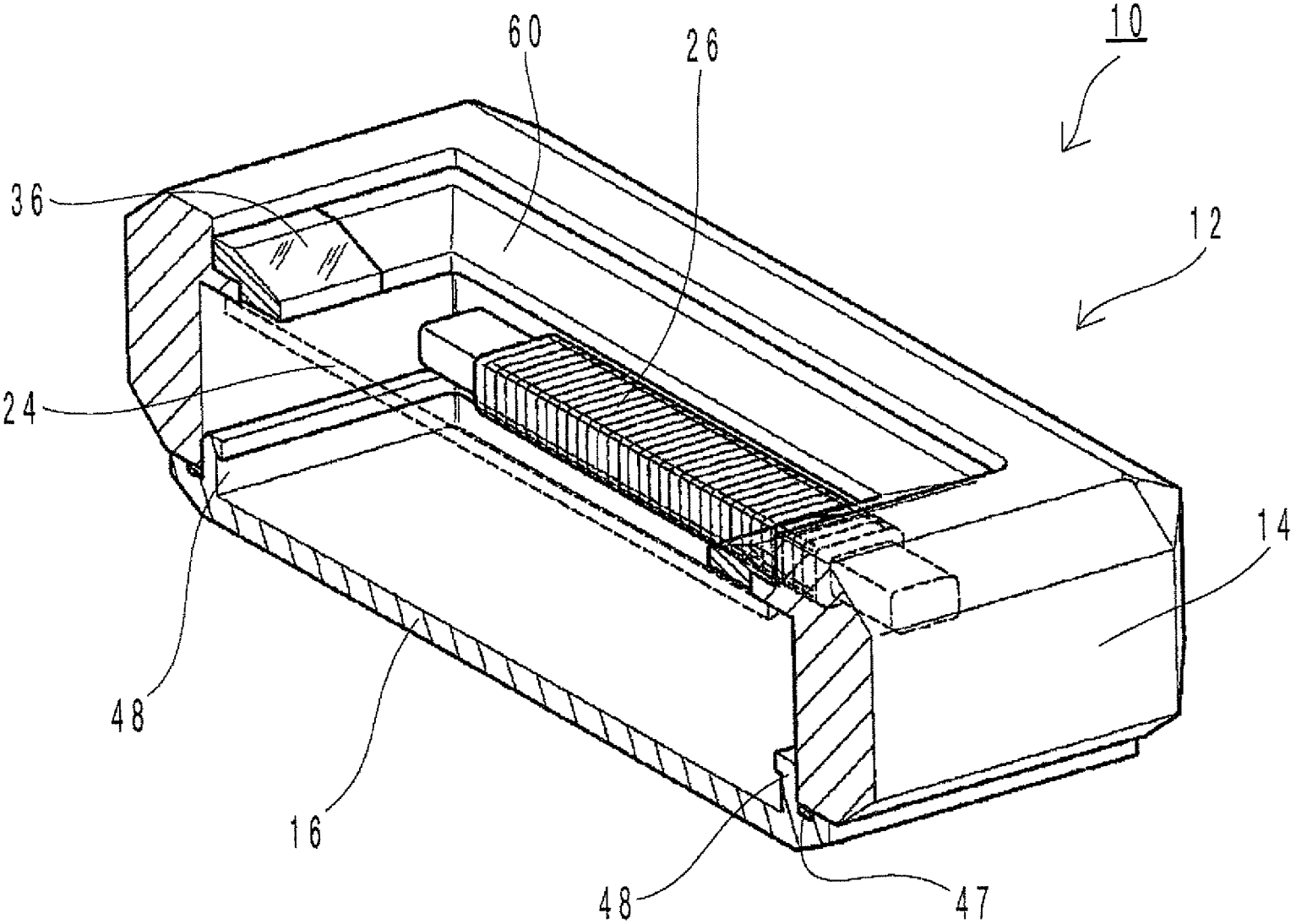
FIG. 18 is an enlarged partial perspective view of an embodiment illustrating arrangement of an insulating member 74 of a wireless function watch of the present invention.
Figure 19:
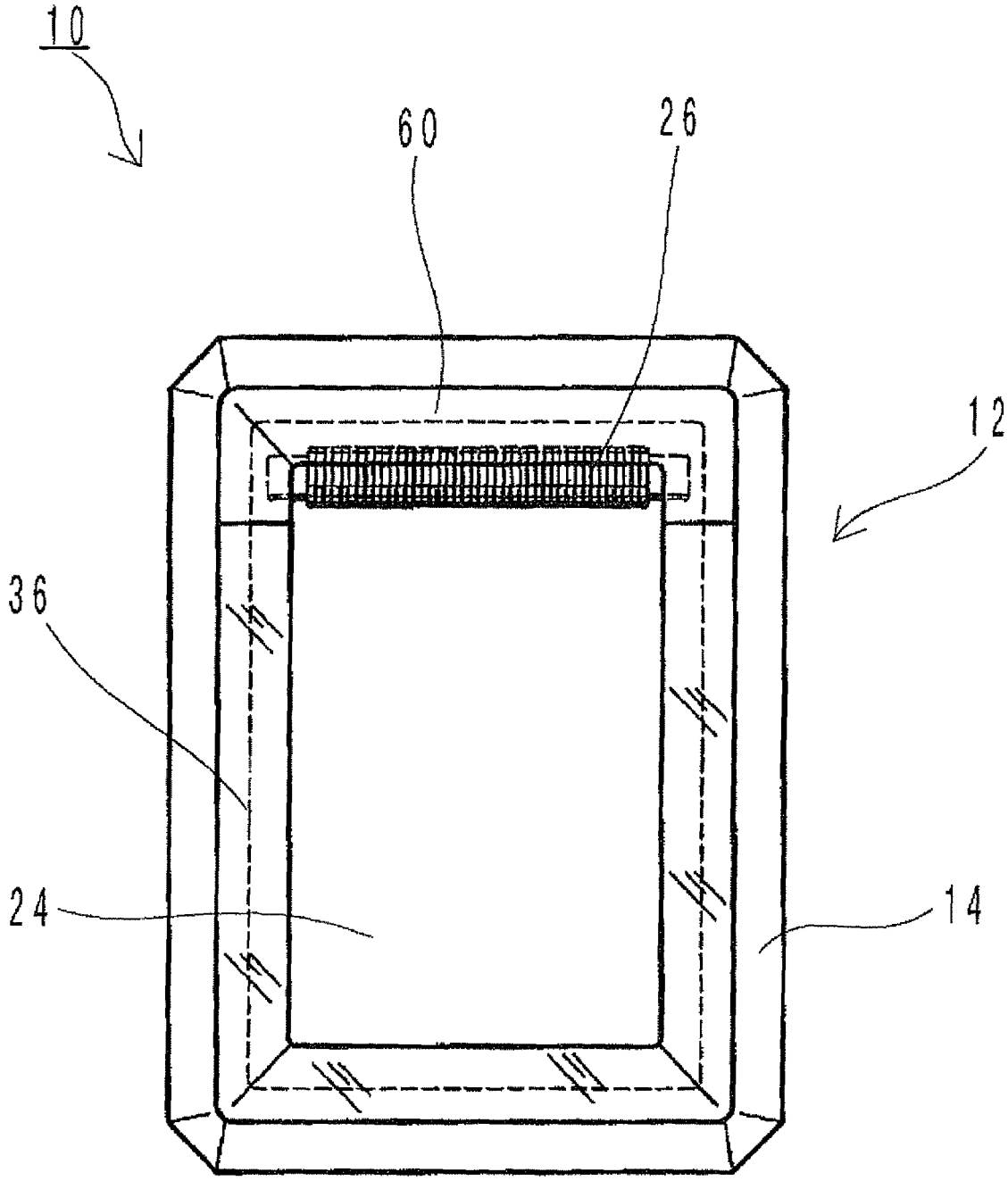
FIG. 19 is a top view of an embodiment illustrating arrangement of an insulating member 74 of a wireless function watch of the present invention.
Figure 20:
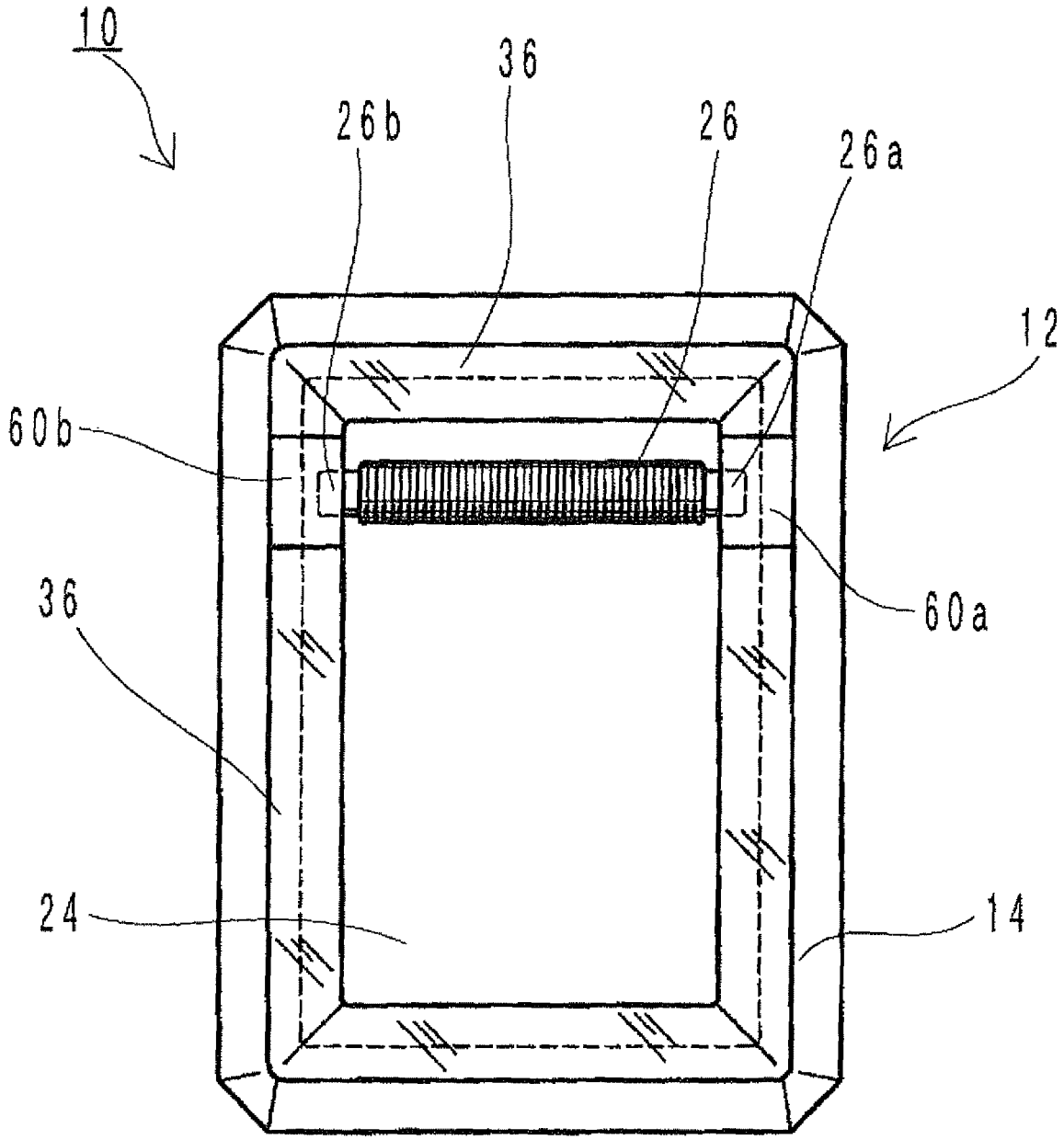
FIG. 20 is a top view of an embodiment illustrating arrangement of an insulating member 74 of a wireless function watch of the present invention.
Figure 21:
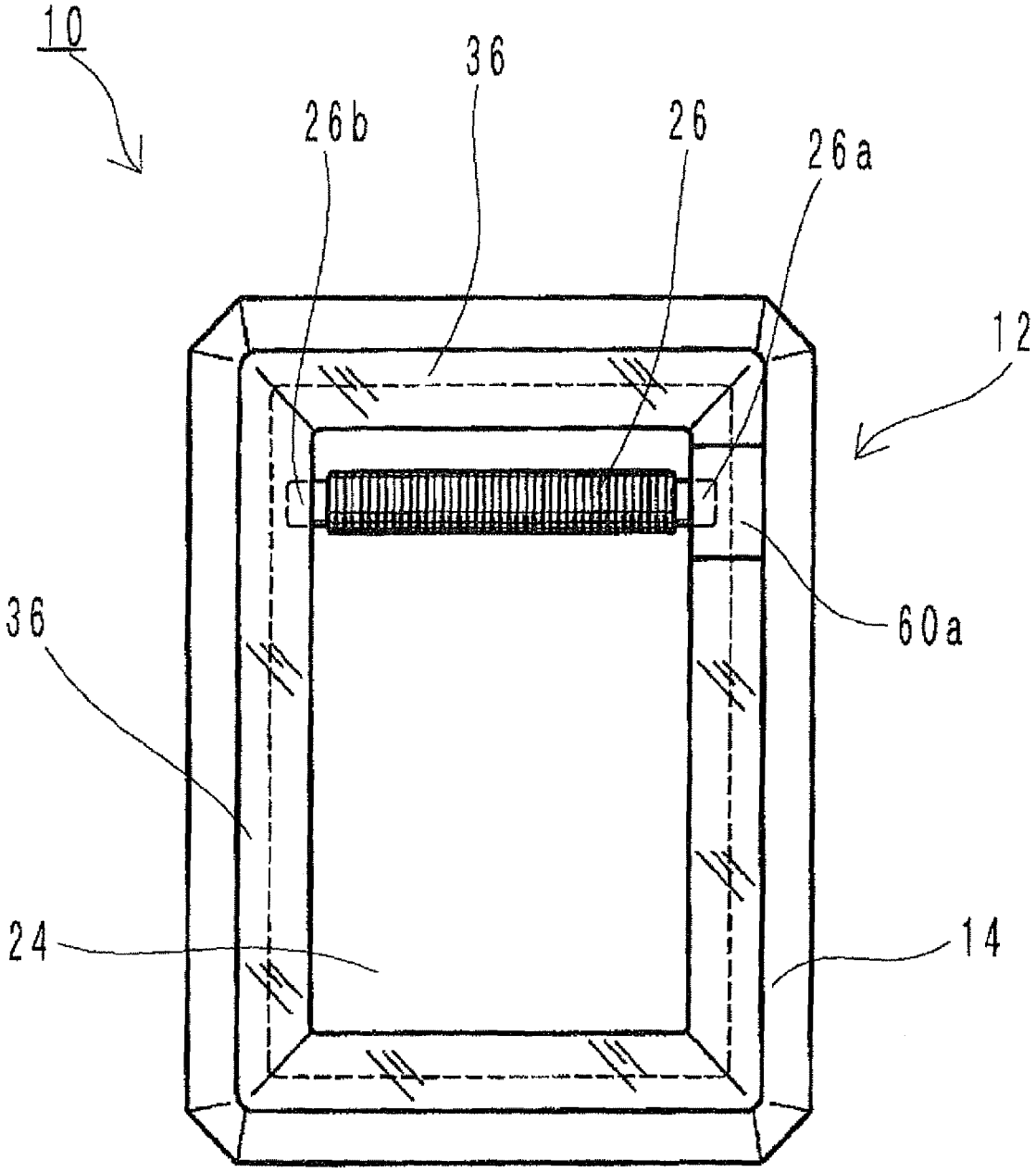
FIG. 21 is a top view of an embodiment illustrating arrangement of an insulating member 74 of a wireless function watch of the present invention.

FIG. 14 is an exploded perspective view illustrating a wireless function watch of another embodiment of the present invention, FIG. 15 is an enlarged partial sectional view in a state where the wireless function watch shown in FIG. 14 is assembled, FIG. 16 is a schematic plan view illustrating an arrangement relation between an antenna and a dial ring receiving portion in the wireless function watch shown in FIG. 14, and FIG. 17 is a schematic perspective view showing the fitting of an insulating member in a dial ring of the wireless function watch shown in FIG. 14.

A wireless function watch 10 of this embodiment has basically the same configuration as that of the wireless function watch 10 of the embodiment shown in FIG. 1 or 2, and the same reference numerals are given to the same constituting members and the detailed explanation will be omitted.

In the wireless function watch 10 shown in FIG. 14, the opening 33 is formed at the dial ring receiving portion 32 of the watch case 14. The length of the opening 33 in the plane direction is not particularly limited. However, if it is excessively long, the attachment of the dial ring 36 arranged thereon will be unstable. Therefore, the length is not limited as long as no problem occurs in the attachment of the dial ring 36, and the opening may be formed slightly longer than the entire length of the antenna 26. Alternatively, the opening 33 may be formed separately in two parts.

Further, in the dial ring 36 of this embodiment, a slit 37 is formed so as to vertically divide the circumferential direction of the ring as shown in FIG. 14. By the slit 37, the dial ring 36 is completely cut. The length of the slit 37 preferably corresponds to the length of the opening 33.

When the dial ring 36 formed as above is attached onto the dial ring receiving portion 32, it is preferable that the slit 37 of the dial ring 36 is perfectly matched or at least partially overlapped with the opening 33 of the dial ring receiving portion 32. The slit 37 and the opening 33 being aligned on the same straight line in combination with the presence of the insulating region 58 will ensure that an eddy current (annular current) in the circumferential direction does not flow through the dial ring 36.

Further, as shown in FIG. 16, by arranging the antenna 26, the opening 33 and the slit 37 on the straight line, that is, by arranging the opening 33 and the slit 37 immediately above the antenna 26, any conductive member preventing the receiving of a radio wave is not present above the antenna 26 and the radio wave can easily pass therethrough and the receiving sensitivity of the antenna 26 is improved.

On the other hand, since the slit 37 formed in the dial ring 36 is exposed to the outside and damages esthetic appearance or high-class appearance, it is preferable that an insulating member 60 is fitted in the slit 37 as shown in FIG. 17.

The insulating member 60 has a section substantially in the same shape as that of the dial ring 36 and is formed with a size that is sufficient to be attached inside the slit 37.

By attaching the insulating member 60 into the slit 37, the esthetic appearance of the dial ring 36 can be enhanced. Further, by arranging the insulating member 60, the strength of the dial ring 36 is maintained.

The section of the insulating member 60 is substantially in the same shape as that of the dial ring 36.

Therefore, an inclined face 60*a* of the insulating member 60 is visually recognized as a part of the dial ring 36, and the esthetic and high-class appearances of the dial ring 36 are improved, and the esthetic appearance of the watch itself is also improved. Particularly, since top faces of the dial ring 36 and the insulating member 60 function as mounting faces on which the glass 18 is mounted, the glass 18 can be securely mounted.

Further, the inclined face 42 of the dial ring 36 functions as an index face on which an index 44 indicating the function display of the watch is arranged.

Because the inclined face 42 of the dial ring 36 and the inclined face 60*a* of the insulating member 60 form substantially the same plane, the index 44 can be read easily. Moreover, even if the index 44 is formed by printing, printing is easy because the face is smooth.

The insulating material constituting the insulating member 60 is not particularly limited, and synthetic resin, rubber and ceramic may be employed.

It is possible to apply non-conductive coating on a conductive material to form the insulating member. In this case, the conductive materials constituting the insulating member 60 include, similarly to the conductive materials constituting the dial ring 36, gold, silver, copper, brass, aluminum, magnesium, zinc and titanium, and alloys of these metals. Further, for example, titanium alloy, stainless steel, tantalum carbide and the like may also be employed.

The non-conductive coating, that is, the insulating coating formed on the conductive material constituting the insulating member 60 is not particularly limited, and non-conductive insulating members such as synthetic resin, rubber and ceramic may be employed.

It is possible to form a non-conductive coating on a conductive material to form the insulating member. In this case, the conductive materials constituting the insulating member include, similarly to the conductive materials constituting the dial ring 36, gold, silver, copper, brass, aluminum, magnesium, zinc and titanium, and alloys of these metals. Further, for example, titanium alloy, stainless steel, tantalum carbide and the like may also be employed.

Examples of the non-conductive coatings, that is, the insulating coatings formed on the conductive material constituting the insulating member include:

- coatings such as DLC (diamond like carbon) coatings;
- insulating coatings of organic materials such as acrylic materials, urethane-based materials, cellulose-based materials and the like; and chromium compound-based coatings containing chromium compounds and aluminum oxide-based coatings containing aluminum oxide compounds.

The chromium compound-based coatings include chromium oxide-based coatings containing chromium oxide compounds, chromium nitride-based coatings containing chromium nitride compounds, and chromium carbide-based coatings containing chromium carbide compounds.

Instead of such insulating coatings, there may be used insulating members in which an insulating sheet made of synthetic resin or rubber is affixed to a conductive material constituting the insulating member.

Further, the insulating member 60 is preferably fixed to the end walls of the dial ring 36 so that it does not remove from the slit 37 of the dial ring 36 unexpectedly. Examples of the fixing means include mechanical engaging means such as fitting, press-fit, bonding, and insert molding. Moreover, the insulating member 60 preferably has a visible face in the same color tone as the color tone of the visible face of the dial ring 36.

By constituting the color tone of the visible face of the insulating member 60 the same as that of the visible face of the dial ring 36, the insulating member 60 will not be visually recognized and the esthetic appearance of the dial ring 36 and the esthetic appearance of the watch itself are improved.

Further, the color tone of the visible face of the insulating member 60 may be different from the color tone of the visible face of the dial ring 36.

By constituting the color tone of the visible face of the insulating member 60 different from that of the visible face of the dial ring 36, the insulating member 60 may add esthetic appearance or any information thereon may be easily recognized by observers such as a wearer of the watch.

Here, the "visible face" refers to a region on the outer face visually recognized by observers.

The "same color tone" means that the color tones of the dial ring 36 and the insulating member 60 are in a range recognized as the same tone, and is not limited to perfect matching in esthetic properties in appearance of the color tones such as depth and darkness. For example, deep gold, light gold, bright gold and dark gold are all in the same gold tone.

For example, even if the dial ring 36 has a bright gold tone and the insulating member 60 has a dark gold tone, the insulating member 60 is difficult to be visually recognized as long as the outer faces of the dial ring 36 and the insulating member 60 present the same gold tone, and the esthetic appearance of the dial ring 36 and that of the watch itself are improved.

The color tones of the outer faces of the dial ring 36 and the insulating member 60 may be the tones of the materials themselves of the dial ring 36 and the insulating member 60 or the tones of the coatings applied on the dial ring 36 and the insulating member 60. Such coatings include paint coatings, print coatings, dry plating coatings and the like.

The outer faces other than the visible faces of the dial ring 36 and the insulating member 60 may be in the same color tone, and for example, the entire outer faces of the dial ring 36 and the insulating member 60 may be in the same color tone.

Further, a wireless function watch according to the present invention is characterized in that the color tone of the visible face of the insulating member 60 presents a metal appearance that has the same color tone as that of the metal appearance of the visible face of the dial ring 36.

Particularly, when the insulating member presents a metal appearance similar to that of the annular member made of a conductive material as mentioned above, the insulating member is difficult to be visually recognized and the annular member is given high-class appearance.

In order to obtain a metal appearance similar to that of the annular member made of a conductive material, the insulating member may be coated with a paint coating by metallic coating in the same color tone as that of the annular member. The metallic paint coatings include paint coatings in which metallic pigment is mixed.

For example, in order to obtain a stainless steel color, paint coatings that contain stainless steel pigment having iron, chromium, nickel, molybdenum and the like may be applied.

In order to obtain a gold color, paint coatings that contain bronze pigment having copper, zinc, iron and the like may be applied.

In order to obtain a silver color, paint coatings that contain aluminum pigment having aluminum or nickel pigment having nickel may be applied.

Further, various pigments such as pearl pigments, graphite pigments, phthalocyanine flakes and the like may be used.

A process of coating the insulating member is as follows.

First, a base coating film is applied on the outer surface of an insulating member. Then, on the base coating film, a metallic coating film is applied. Moreover, on the metallic coating film, a clear coating which is a transparent or translucent synthetic resin layer is applied. With the clear coating, the outermost surface of the coated insulating member maintains non-conductivity even though the metallic coating film contains metal.

In order to ensure non-conductivity, an insulating overcoating film such as a clear coating is preferably employed for the outermost layer not only with the metallic paint coatings but also with a single layer or a multilayer of such paint coatings as described above.

Examples of the insulating coating films include polyurethane resin coatings, fluororesin coatings in which fluorine is mixed in the polymer molecule forming the resin, vinyl chloride sol coatings in which polyvinylchloride resin is dispersed in plasticizer, silicone polyester resin coatings made of silicone polyester resins obtained by modifying oil-free polyester resin with silicone intermediate, oil-free polyester resins, acrylic resin coatings, epoxy resin coatings, silicone acrylic resin coatings, vinyl chloride resin coatings, lacquers, phenol resin coatings, chlorinated rubber coatings and the like.

After the dial ring 36 in which the insulating member 60 is attached is mounted on the dial ring receiving portion 32, the glass 18 is arranged on the watch case 14 via a glass packing 46 as shown in FIG. 15, whereby a region below the dial ring 36 is sealed. By this arrangement, intrusion of water or dust from outside can be prevented. Further, chemical resistance is ensured.

The words "different color tones" mean that the color tones of the visible faces of the dial ring 36 and the insulating member 60 are not considered as the same color tone.

Moreover, the insulating member 60 may be an index showing a function display of the watch.

By using the insulating member 60 as an index that shows function displays of the watch such as time display, date display, day display, month display, year display, remaining battery level display, display of outer environment data such as pressure and temperature, display of antenna receiving sensitivity and display of successful, or unsuccessful receiving at the antenna, the function displays of the watch can be presented to observers such as a wearer of the watch.

Particularly, when the insulating member 60 as an index has a color tone different from that of the visible face of the dial ring 36, the function display of the watch is more easily recognizable by observers.

In this case, the number and positions of the insulating members 60 are similar to the insulating regions 58 in Example 3. In detail, the insulating member 60 may be arranged in the vicinity of and above the antenna 26 as in the embodiments shown in FIGS. 18 and 19; the insulating member 60 may be constituted by two insulating members 60 that are arranged in the vicinity of and above the antenna 26 and opposed to both open end portions 26*a*, 26*b* of the antenna 26 as in the embodiment shown in FIG. 20; and the insulating member 60 may be constituted by an insulating member 60 that is arranged in the vicinity of and above the antenna 26 and opposed to at least one open end portion 26*a* of the antenna 26 as in the embodiment shown in FIG. 21. In FIGS. 18 to 21, the shape of the watch case 14 is a rectangular frame and, in correspondence with that, the dial ring 36 is also shown in a rectangular frame shape. However, it is needless to say that the watch case 14 and the dial ring 36 can be made circular as in the above embodiments.

Example 5

Figure 22:
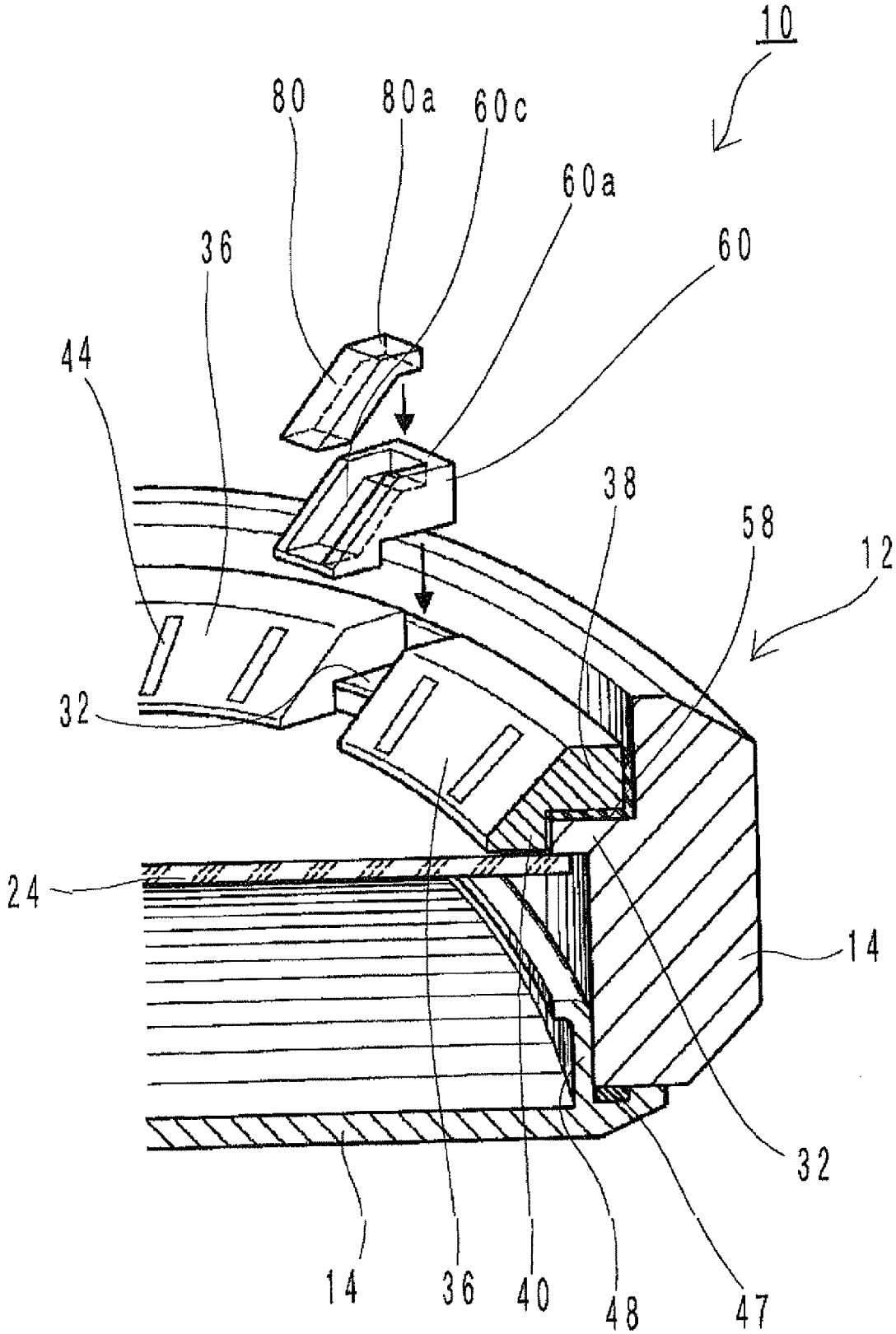
FIG. 22 is an enlarged partial perspective view similar to FIG. 17 of a wireless function watch 10 according to another embodiment of the present invention wherein an insulating member 78 and an additional member 80 are shown to be attached in a slit 56.
Figure 23:
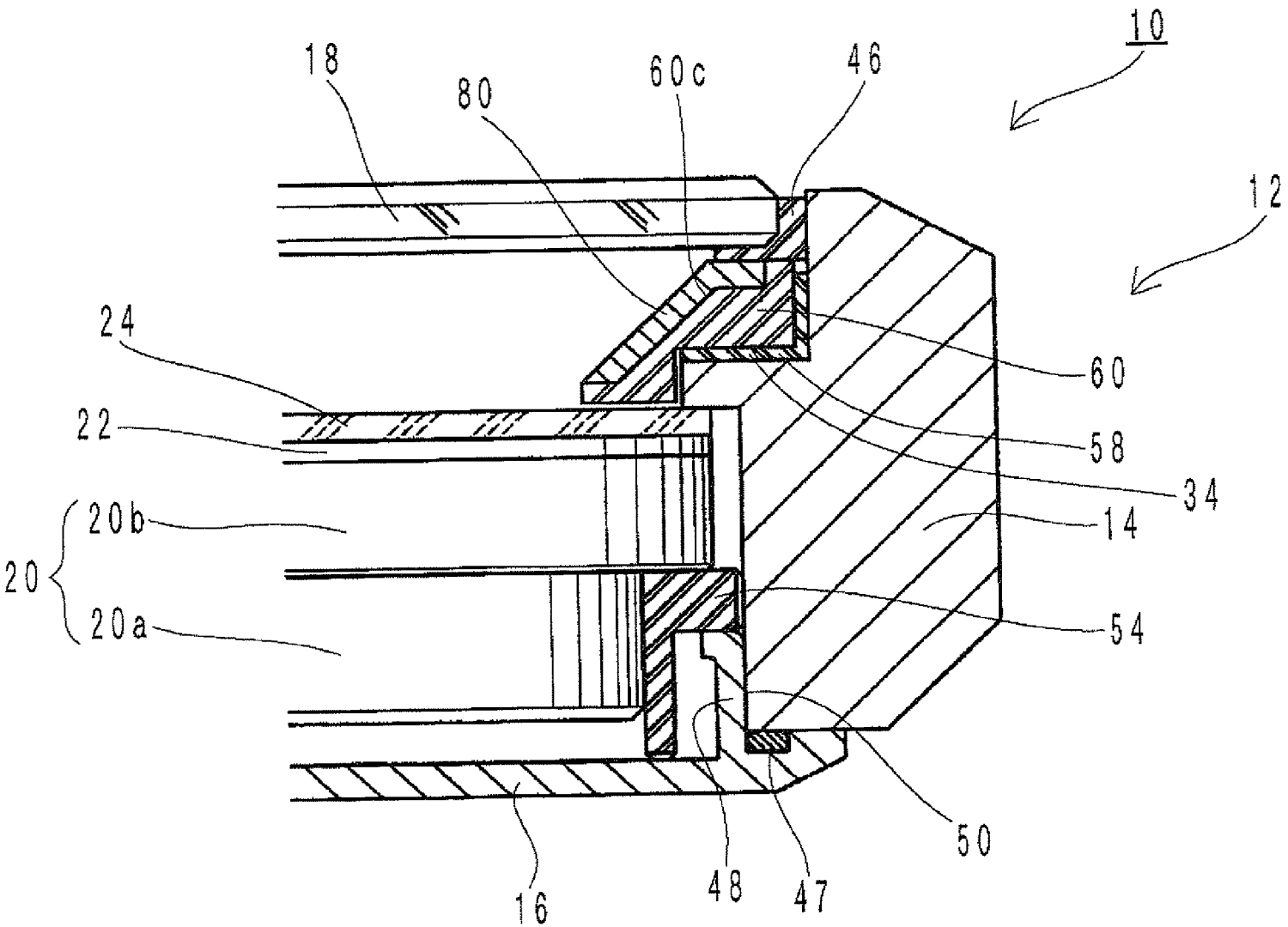
FIG. 23 is an enlarged partial sectional view for explaining a state where the insulating member 78 and the additional member 80 are attached in the slit 56 in the wireless function watch 10 of FIG. 22.

FIG. 22 is an enlarged partial perspective view similar to FIG. 17 of a wireless function watch 10 of another embodiment of the present invention and is a partially enlarged perspective view for explaining the attachment of an insulating member 60 and an additional member 80 in the slit 37. FIG. 23 is an enlarged partial sectional view for explaining a state where the insulating member 60 and the additional member 80 are attached in the slit 37 in the wireless function watch 10 of FIG. 22.

The wireless function watch 10 of this embodiment has basically the same configuration as that of the wireless function watch 10 shown in FIG. 1 or 2, and the same reference numerals are given to the same constituting members and the detailed explanation will be omitted.

In the wireless function watch 10 of this embodiment, the insulating member 60 has the conductive additional member 80, and the additional member 80 is held in the insulating member 60 such that it can be visually recognized from outside and it will not be brought into contact with the dial ring 36 which is an annular member.

Specifically, the additional member 80 is arranged in a recess portion 60*b* formed in the insulating member 60 so that the additional member 80 can be surely fixed in the recess portion 60*b* formed in the insulating member 60.

The additional member 80 is preferably fixed to the insulating member 60 so as not to remove from the recess portion 60*b* of the insulating member 60 unexpectedly. Examples of the fixing means include mechanical engaging means such as fitting, press-fit, bonding, and insert molding. Moreover, an adhesive, a pressure-sensitive adhesive or a double-sided tape may be used as a bonding layer through which the insulating member 60 and the additional member 80 are bonded together.

By constituting the watch as described above, the insulating member 60 is given a metal appearance from the conductive additional member 80 held in the insulating member 60, whereby the esthetic and high-class appearances of the dial ring 36 and the esthetic appearance of the watch itself are improved.

Further, because the additional member 80 is held by the insulating member 60 so as not to be brought into contact with the dial ring 36, an eddy current is not generated in the dial ring 36 and the receiving sensitivity of the antenna 26 is improved.

In this case, the color tone of the visible face of the additional member 80 may be the same as that of the visible face of the dial ring 36.

By constituting the color tone of the visible face of the additional member 80 the same as the color tone of the visible face of the dial ring 36, the additional member 80 is difficult to be visually recognized and the esthetic appearance of the dial ring 36 and the esthetic appearance of the watch itself are improved.

Alternatively, the color tone of the visible face of the additional member 80 may be different from the color tone of the visible face of the dial ring 36.

By constituting the color tone of the visible face of the additional member 80 different from the color tone of the visible face of the dial ring 36, the additional member 80 may add esthetic appearance or any information thereon may be easily recognized by observers such as a wearer of the watch.

The additional member 80 may be used as an index showing a function display of the watch.

By using the additional member 80 as an index that shows function displays of the watch such as time display, date display, day display, month display, year display, remaining battery level display, display of outer environment data such as pressure and temperature, display of antenna receiving sensitivity and display of successful or unsuccessful receiving at the antenna, the function displays of the watch can be presented to observers such as a wearer of the watch.

Figure 24:
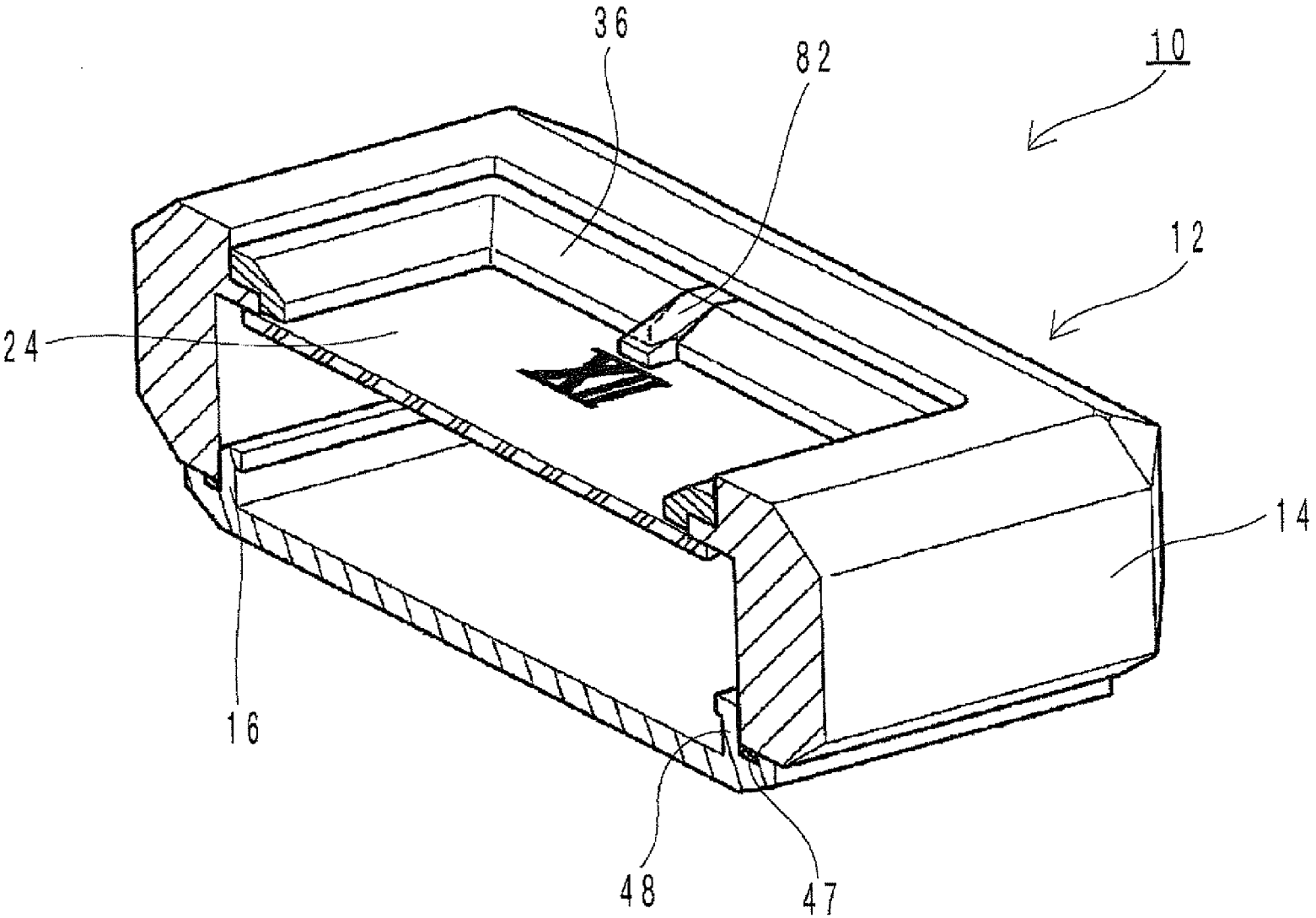
FIG. 24 is an enlarged partial perspective view similar to FIG. 17 of a wireless function watch 10 according to another embodiment of the present invention.

In this case, as shown in FIG. 24, the additional member 80 itself may be used as an index 82 indicating a function display of the watch.

Alternatively, an index may be formed on the visible face of the additional member 80. Alternatively, the additional member 80 may be a product display member such as a mark or emblem showing a brand name, a manufacturer name, a product name or the like.

Figure 25:
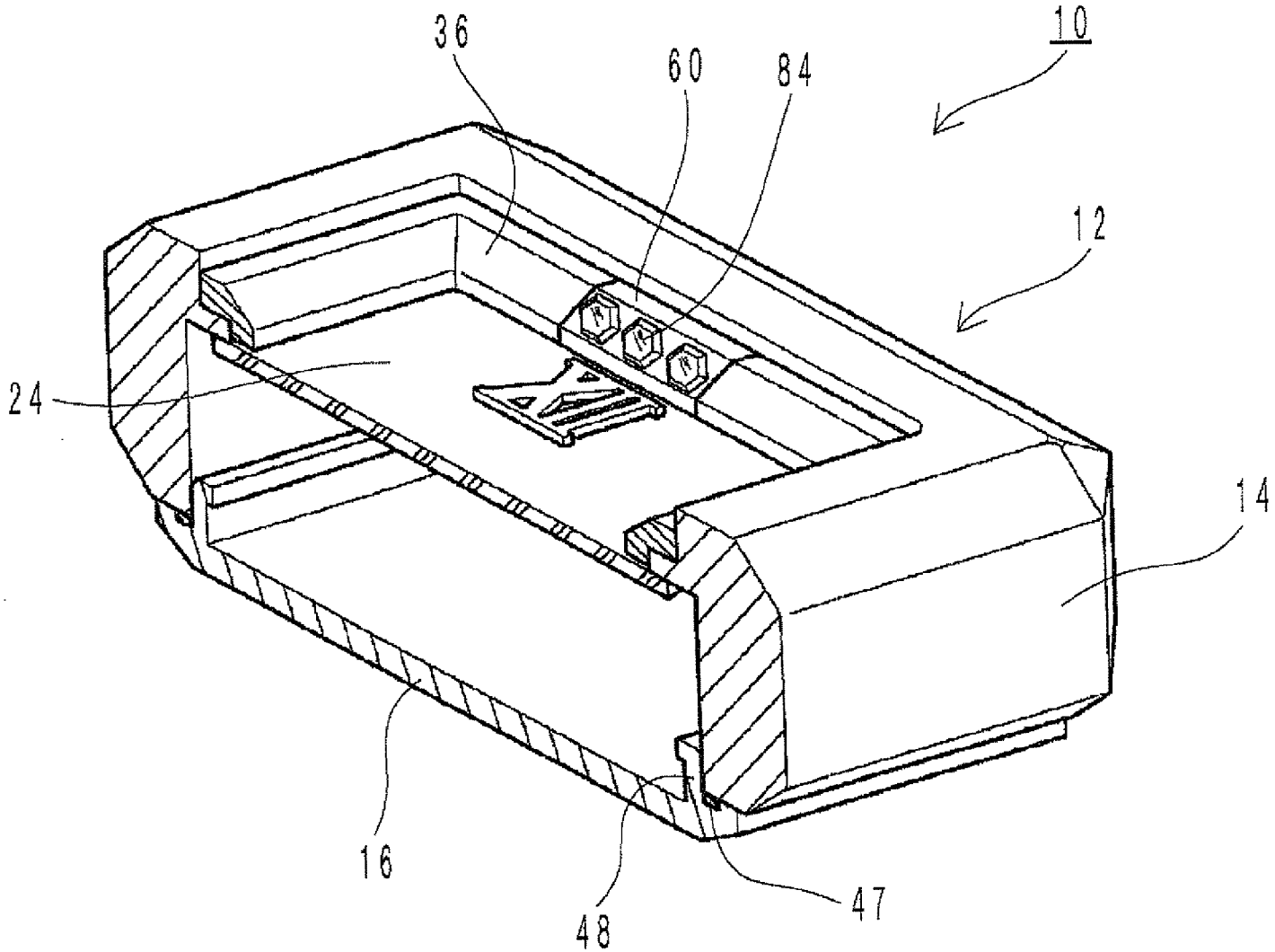
FIG. 25 is an enlarged partial perspective view similar to FIG. 17 of a wireless function watch 10 according to another embodiment of the present invention.
Figure 26:
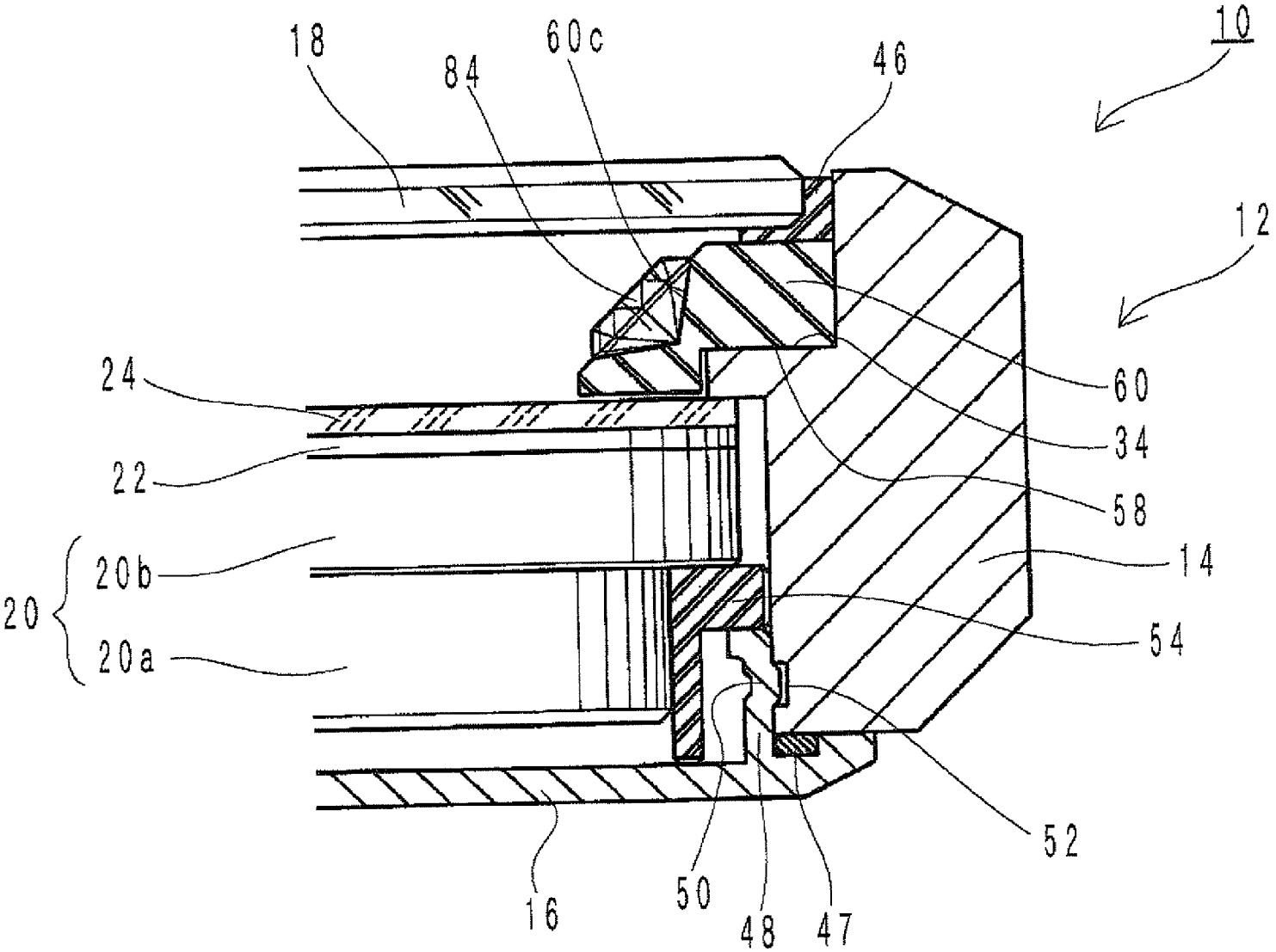
FIG. 26 is an enlarged partial sectional view similar to FIG. 15 of a wireless function watch 10 according to another embodiment of the present invention.

Moreover, as shown in FIGS. 25 and 26, the additional member 80 may be a decoration member 84 giving an esthetic feeling to an observer.

With a constitution wherein the decoration member 84 is made of a brilliant stone such as a jewel, a precious stone or the like in the insulating member 60, the esthetic and high-class appearances of the annular member are improved and the esthetic appearance of the watch itself is improved.

In particular, when the additional member 80 as an index is in a different color tone from that of the visible face of the dial ring 36, the function display of the watch is more easily recognized visually by observers.

The visible faces of the dial ring 36, the insulating member 60 and the additional member 80 may form substantially the same plane.

With such constitution, the dial ring 36, the insulating member 60 and the additional member 80 are visually recognized as a unit, and the esthetic and high-class appearances of the annular member are improved and the esthetic appearance of the watch itself is improved.

The upper face of the dial ring 36 functions as a mounting face for mounting the glass. When the upper faces 36*a*, 60*c* and 80*a* of the dial ring 36, the insulating member 78 and the additional member 80, respectively, form substantially the same plane, a smooth mounting face is formed at the dial ring 36, and the glass 18 can be surely mounted.

Further, the inclined face 36*b* extending downward from the upper face 36*a* of the dial ring 36 to the dial plate 24 functions as an index face on which an index showing a function display of the watch is arranged.

When inclined faces 36*b*, 60*a* and 80*b* of the dial ring 36, the insulating member 60 and the additional member 80, respectively, form substantially the same plane, a smooth index face is formed on the dial ring 36 and the index can be easily read. Moreover, in the case that the index is formed by printing on the index face, the index can be printed on the smooth index face extremely easily.

Because the additional member 80 is arranged in the recess portion 60*b* of the insulating member 60 so that the visible faces of the additional member 80 and the insulating member 60 form substantially the same plane, and further because the dial ring 36, the insulating member 60 and the additional member 80 are visually recognized as a unit, the esthetic and high-class appearances of the dial ring 36 are improved and the esthetic appearance of the watch itself is improved.

The material constituting the additional member 80 is not particularly limited, and materials similar to those for the dial ring 36 may be used.

Example 6

Figure 27:
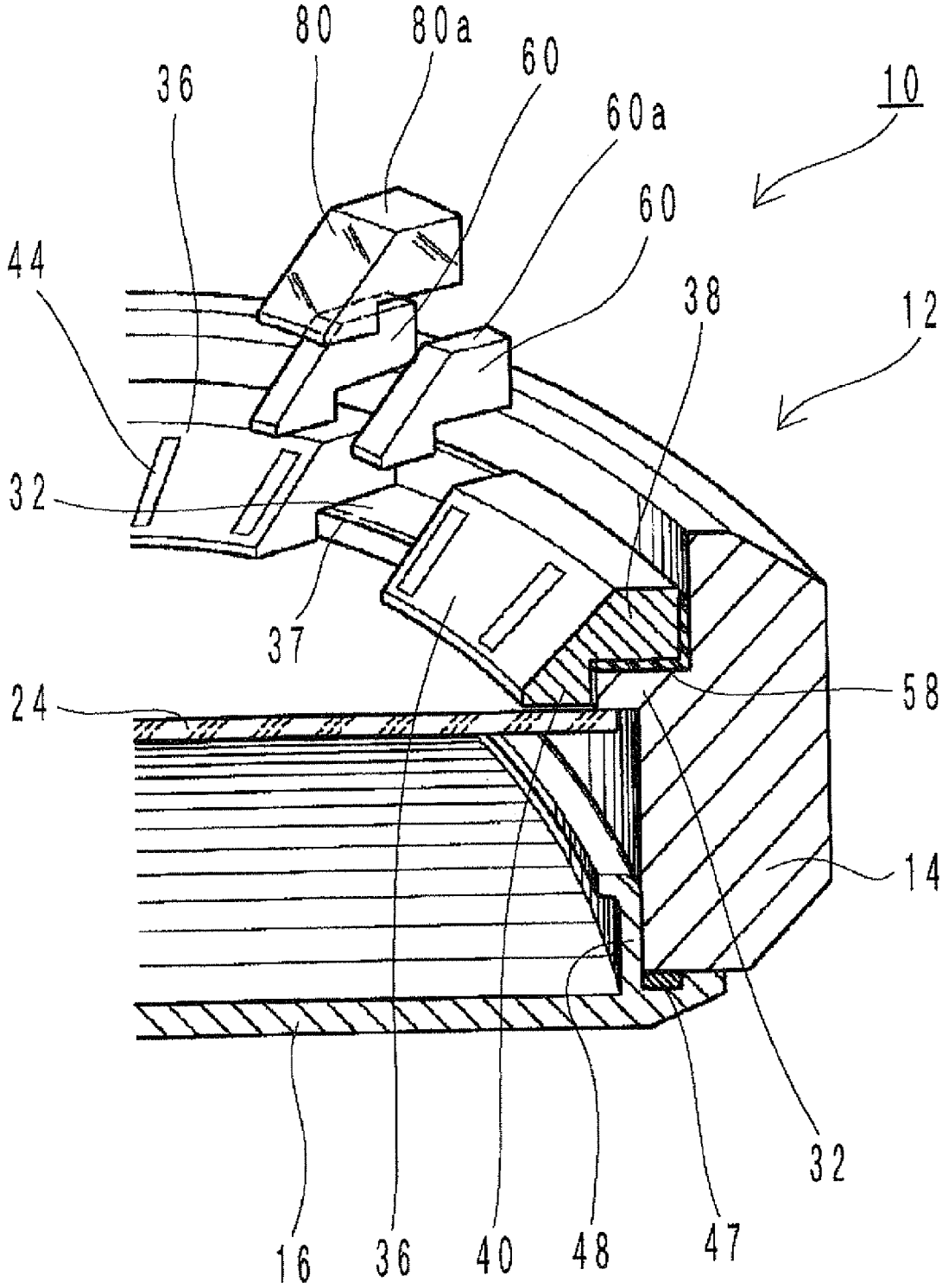
FIG. 27 is an enlarged partial perspective view similar to FIG. 17 of a wireless function watch 10 according to another embodiment of the present invention wherein an insulating member 78 and an additional member 80 are shown to be attached in a slit 56.
Figure 28:
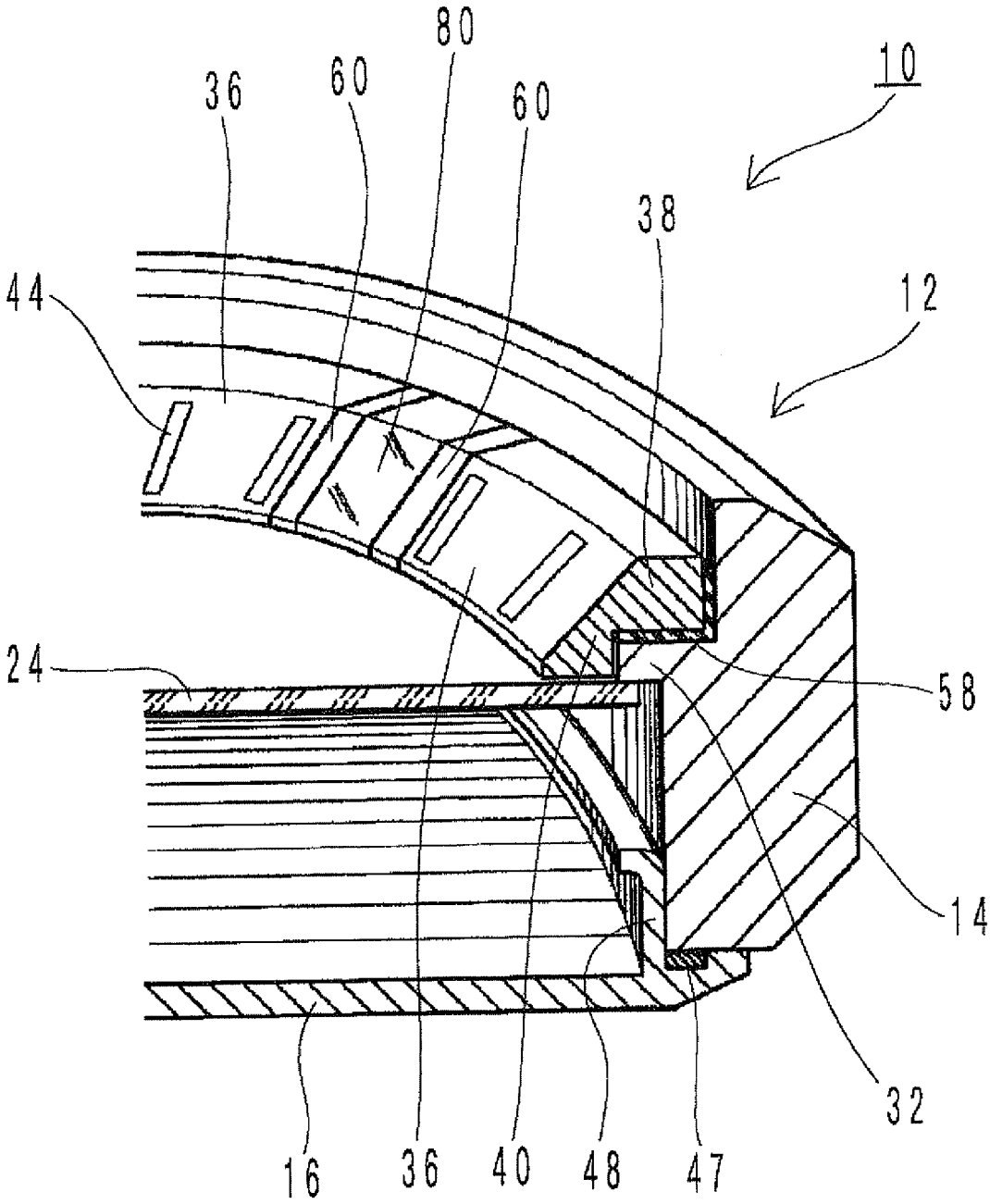
FIG. 28 is an enlarged partial sectional view for explaining a state where the insulating member 78 and the additional member 80 are attached in the slit 56 in the wireless function watch 10 of FIG. 26.

FIG. 27 is an enlarged partial perspective view similar to FIG. 17 of a wireless function watch 10 in another embodiment of the present invention and is a partially enlarged perspective view for explaining the attachment of insulating members 60 and an additional member 80 in the slit 37. FIG. 28 is an enlarged partial sectional view for explaining a state where the insulating members 60 and the additional member 80 are attached in the slit 37 in the wireless function watch 10 of FIG. 27.

The wireless function watch 10 of this embodiment has basically the same configuration as that of the wireless function watch 10 of the embodiment shown in FIG. 1 or 2, and the same reference numerals are given to the same constituting members and the detailed explanation will be omitted.

In the wireless function watch 10 of this embodiment, the additional member 80 is arranged between two insulating members 60 and 60 that are arranged separately from each other with a given interval within the slit 37.

According to this constitution, the additional member 80 can be surely fixed between the two insulating members 60 and 60.

Further, the additional member is arranged between the two insulating members 60 and 60 so that the visible faces of the additional member 80 and the insulating members 60 form substantially the same plane, and the dial ring 36, the insulating members 60 and the additional member 80 are visually recognized as a unit. Consequently, the esthetic and high-class appearances of the dial ring 36 are improved and the esthetic appearance of the watch itself is improved.

Example 7

Figure 29:
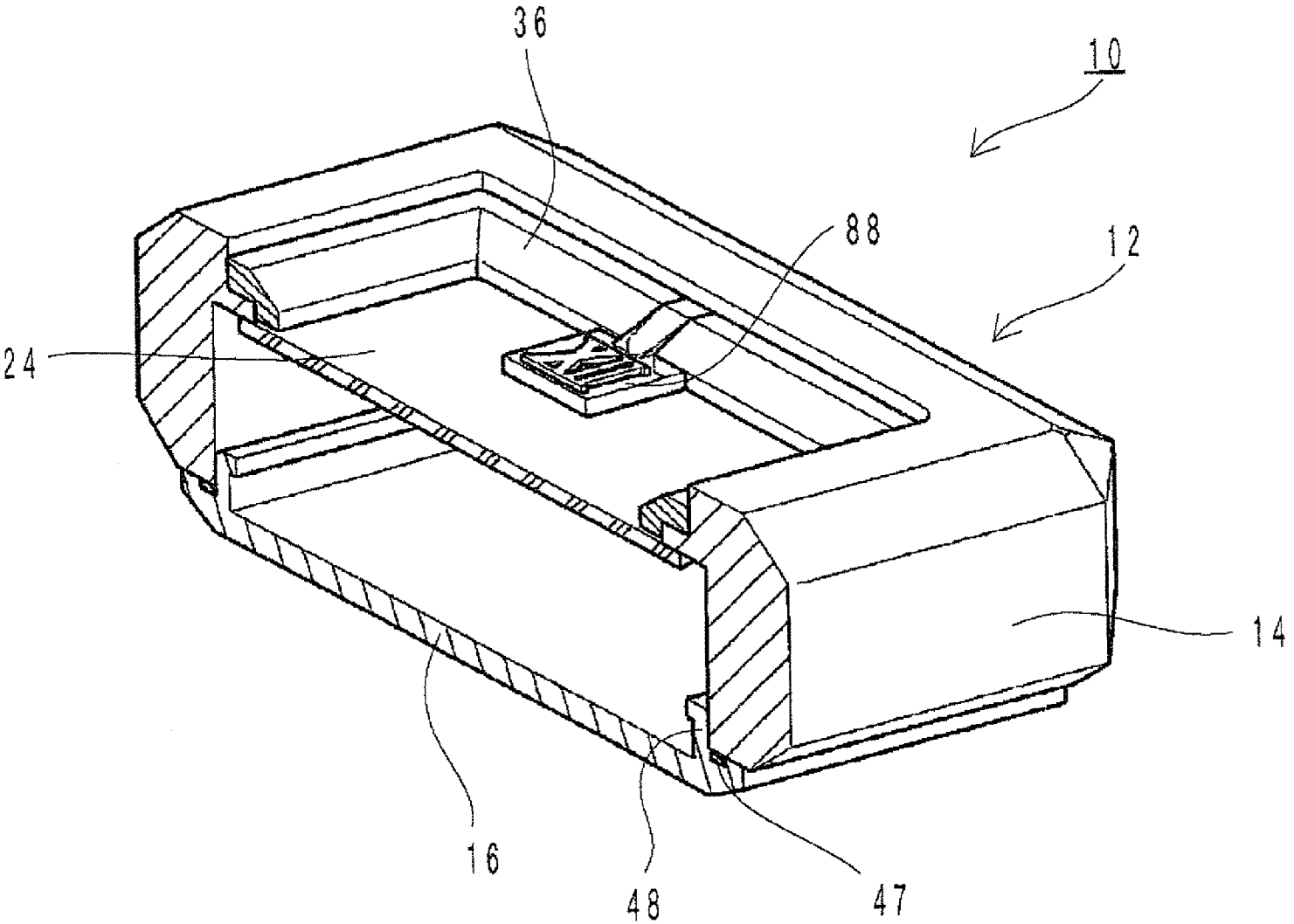
FIG. 29 is an enlarged partial perspective view similar to FIG. 17 of a wireless function watch 10 according to another embodiment of the present invention.

FIG. 29 is an enlarged partial perspective view similar to FIG. 17 of a wireless function watch 10 of another embodiment of the present invention.

The wireless function watch 10 of this embodiment has basically the same configuration as that of the wireless function watch 10 shown in FIG. 1 or 2, and the same reference numerals are given to the same constituting members and the detailed explanation will be omitted.

In the wireless function watch 10 of this embodiment, an insulating member 60 has an index portion 88 extended onto the upper face of the dial plate 24.

According to this constitution, when the insulating member 60 is used as an index showing a function display of the watch, the index portion 88 extended onto the upper face of the dial plate 24 clearly shows the function display of the watch. Therefore, an observer such as a wearer of the watch can visually recognize the function display of the watch easily.

In this case, though not shown, similarly to the embodiment in FIGS. 22 and 23, the insulating member 60 holds the conductive additional member 80, and the additional member 80 may extend onto the upper face of the dial plate 24 to constitute the index portion.

According to this constitution, when the additional member 80 is used as an index showing a function display of the watch, the index portion extended onto the upper face of the dial plate 24 clearly shows the function display of the watch. Therefore, an observer such as a wearer of the watch can visually recognize the function display of the watch easily.

Example 8

Figure 30:
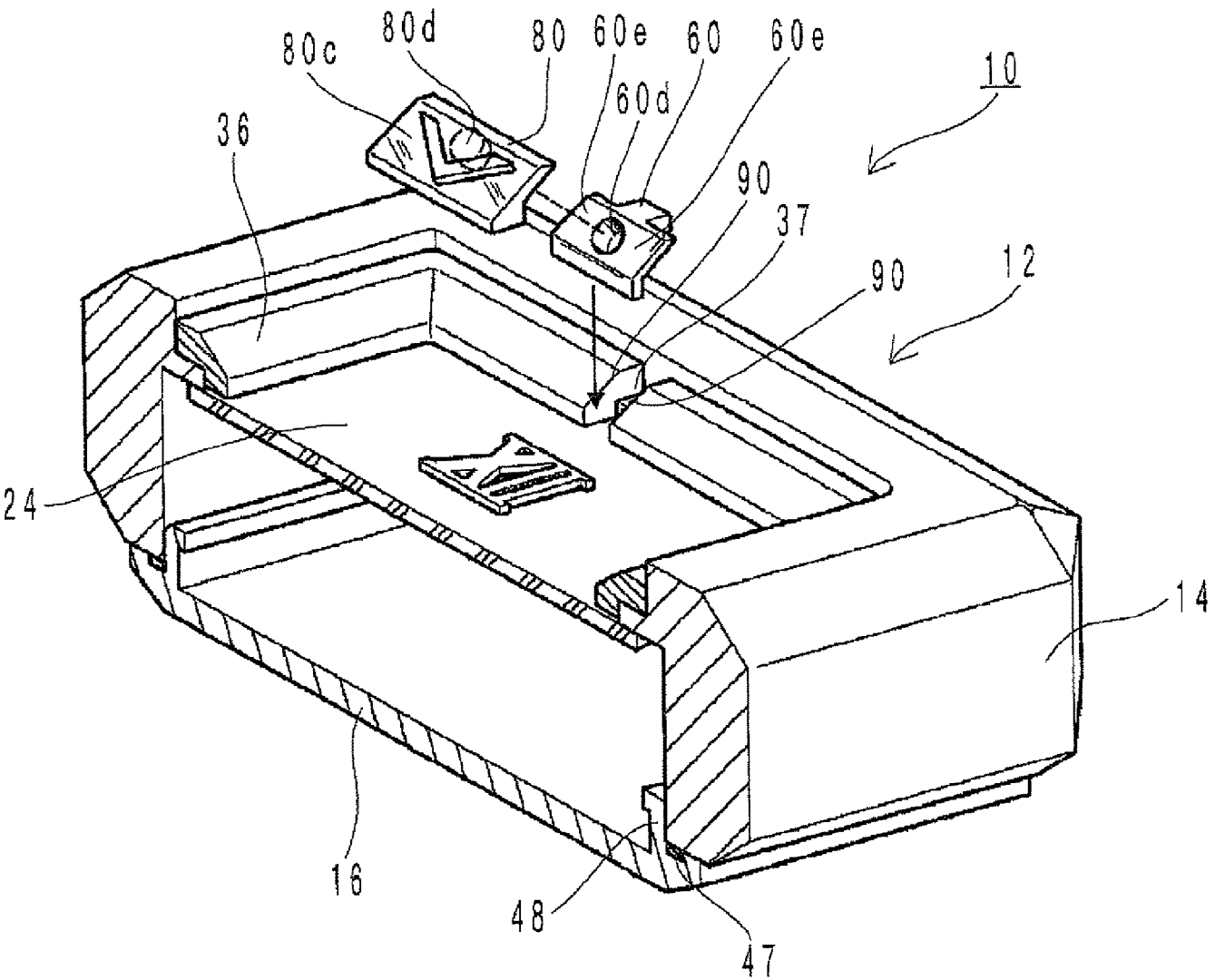
FIG. 30 is an enlarged partial perspective view similar to FIG. 17 of a wireless function watch 10 according to another embodiment of the present invention wherein an insulating member 78 and an additional member 80 are shown to be attached in a slit 56.
Figure 31:
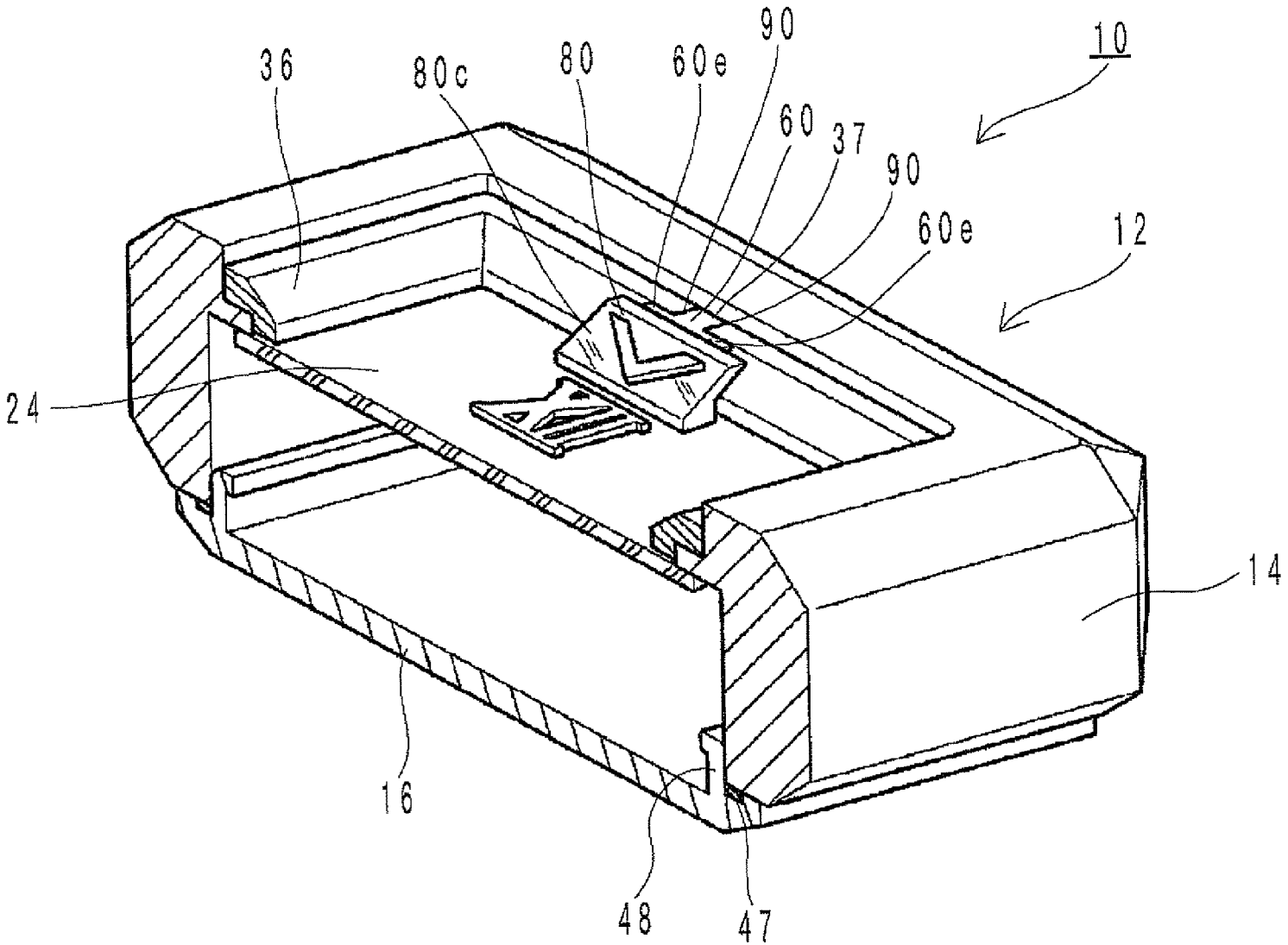
FIG. 31 is an enlarged partial perspective view for explaining a state where the insulating member 78 and the additional member 80 are attached in the slit 56 in the wireless function watch 10 of FIG. 30.
Figure 32:
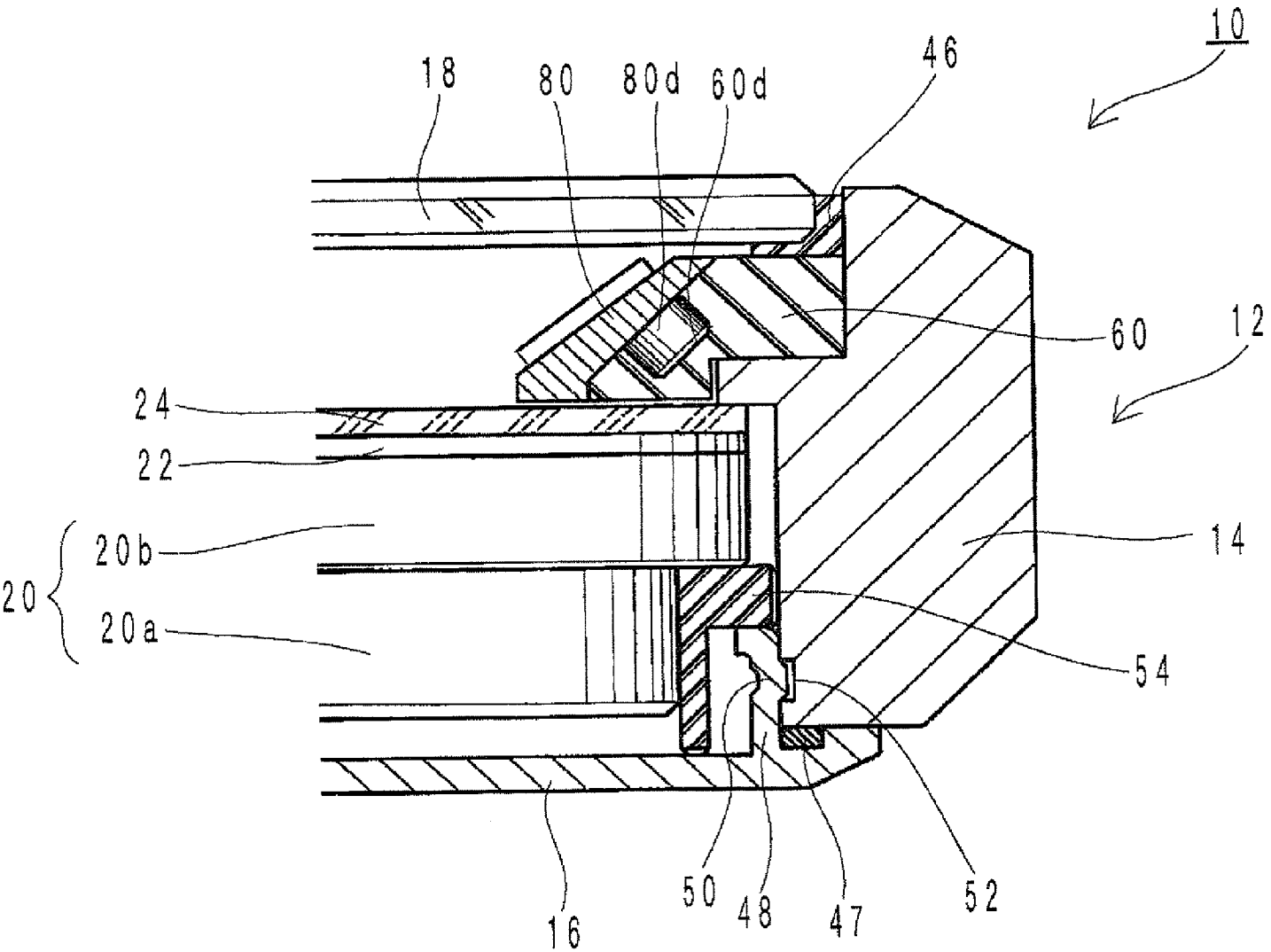
FIG. 32 is an enlarged partial sectional view for explaining a state where the insulating member 78 and the additional member 80 are attached in the slit 56 in the wireless function watch 10 of FIG. 30.
Figure 33:
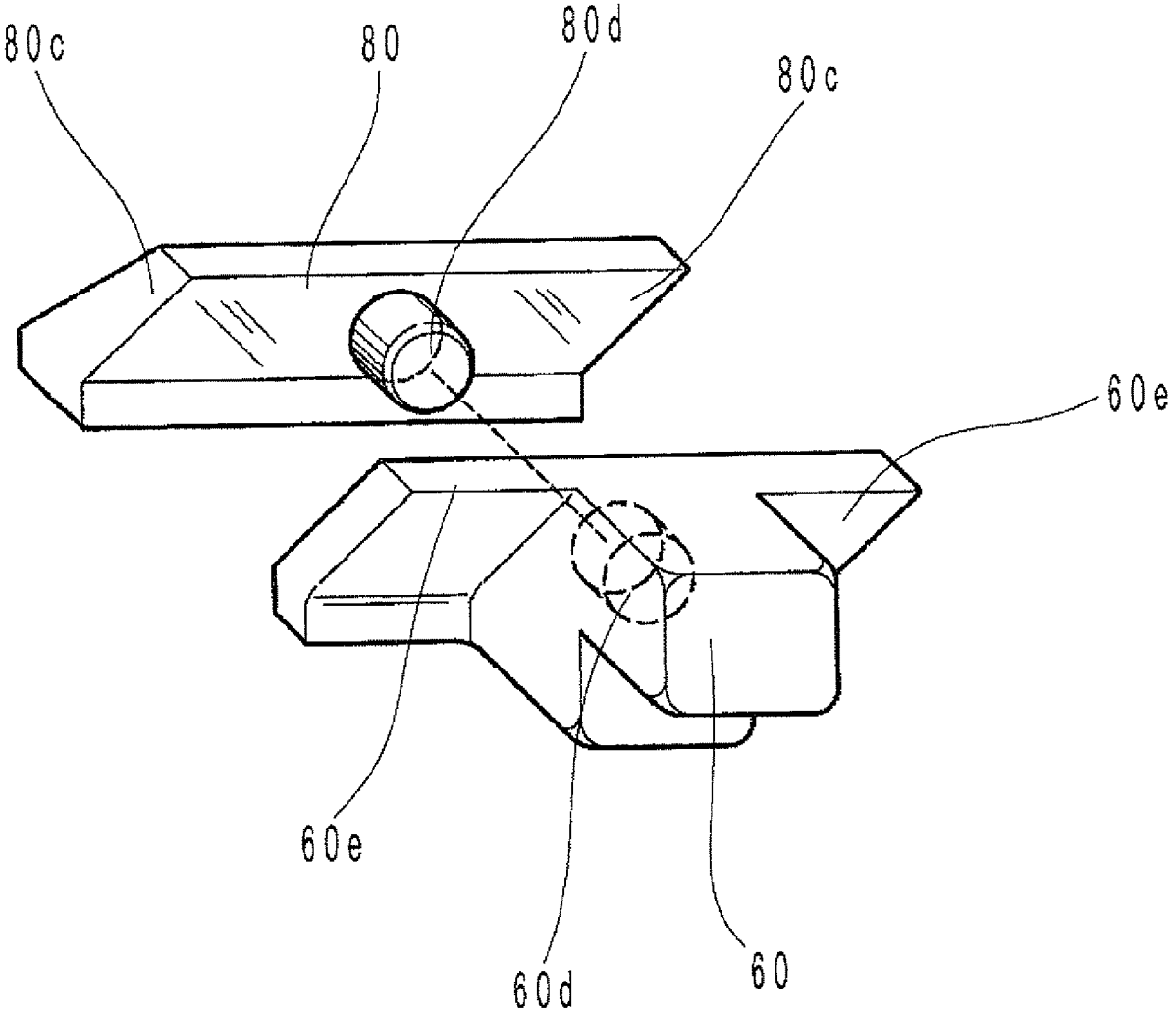
FIG. 33 is a perspective view for explaining a method of attaching an additional member 80 to an insulating member 78.

FIG. 30 is an enlarged partial perspective view similar to FIG. 17 of a wireless function watch 10 of another embodiment of the present invention and is a partially enlarged perspective view for explaining the attachment of an insulating member 60 and an additional member 80 in the slit 37. FIG. 31 is an enlarged partial perspective view for explaining a state where the insulating member 60 and the additional member 80 are attached in the slit 37 in the wireless function watch 10 of FIG. 30. FIG. 32 is an enlarged partial sectional view for explaining a state where the insulating member 60 and the additional member 80 are attached in the slit 37 in the wireless function watch 10 of FIG. 30. FIG. 33 is a perspective view for explaining a method of attaching the additional member 80 on the insulating member 60.

The wireless function watch 10 of this embodiment has basically the same configuration as that of the wireless function watch 10 shown in FIG. 1 or 2, and the same reference numerals are given to the same constituting members and the detailed explanation will be omitted.

In the wireless function watch 10 of this embodiment, as shown in FIGS. 31 and 32, the additional member 80 has covering portions 80*a* covering at least a part of boundaries 90 between the dial ring 36 which is an annular member and the insulating member 60.

According to this constitution, the boundaries 90 between the dial ring 36 and the insulating member 60 are covered by the covering portions 80*a* of the additional member 80 and are not visually recognized, and the esthetic appearance and high-class appearance of the dial ring 36 are further improved.

In this embodiment, as shown in FIGS. 32 and 33, an engaging projecting portion 80*b* is formed on the back face of the additional member 80 in order to attach the additional member 80 to the insulating member 60, and an engagement hole 60*b* is correspondingly formed in the insulating member 60 so that the additional member 80 is mounted on the insulating member 60 by engagement between the engaging projecting portion 80*b* and the engagement hole 60*b*.

According to this constitution, the additional member can be more reliably fixed to the insulating member by the engagement between the engaging projecting portion 80*b* and the engagement hole 60*b*.

In this case, the additional member 80 should be mounted on the insulating member 60 by engaging the engaging projecting portion formed on one of the insulating member 60 and the additional member 80 with the engagement hole formed in the other, and it is possible to provide the engagement hole in the additional member 80 and the engaging projecting portion on the insulating member 60.

Moreover, in this case, as shown in FIG. 33, extended portions 60*c* extended from the insulating member 60 are preferably formed so as to be present between each covering portion 80*a* of the additional member 80 and the annular member.

According to this constitution, the covering portions 80*a* of the conductive additional member 80 extending across the boundaries 90 between the dial ring 36 and the insulating member 60 are not brought into contact with the conductive dial ring 36 because of the presence of the extended portions 60*c* of the insulating member 60.

As a result, the conductive additional member 80 and the dial ring 36 are reliably insulated, and an eddy current is prevented from being generated at the dial ring 36, whereby the receiving sensitivity of the antenna is improved.

In the embodiments shown in FIGS. 30 to 32, the extension distance of the extended portions 60*c* extended from the insulating member 60 is shorter than that of the covering portions 80*a* of the additional member 80. However, as shown in FIG. 33, the extension distance of the extended portions 60*c* extended from the insulating member 60 may be substantially the same as that of the covering portions 80*a* of the additional member 80, in which case the covering portions 80*a* of the conductive additional member 80 are definitely not brought into contact with the conductive dial ring 36 because of the presence of the extended portions 60*c* of the insulating member 60. As a result, an eddy current is prevented from being generated at the dial ring 36, and the receiving sensitivity of the antenna is improved.

Example 9

Figure 34:
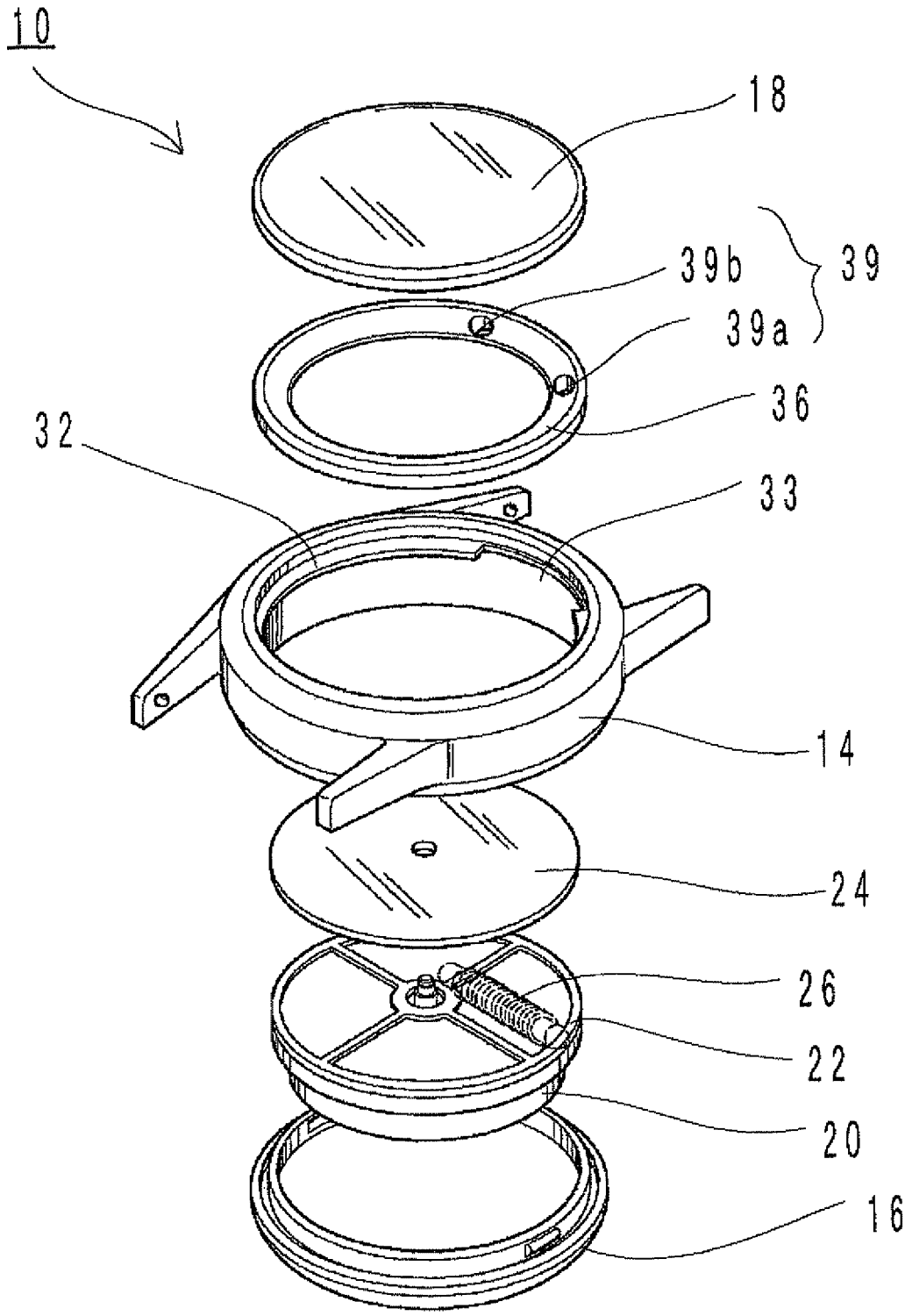
FIG. 34 is an exploded perspective view of a wireless function watch according to another embodiment of the present invention.
Figure 35:
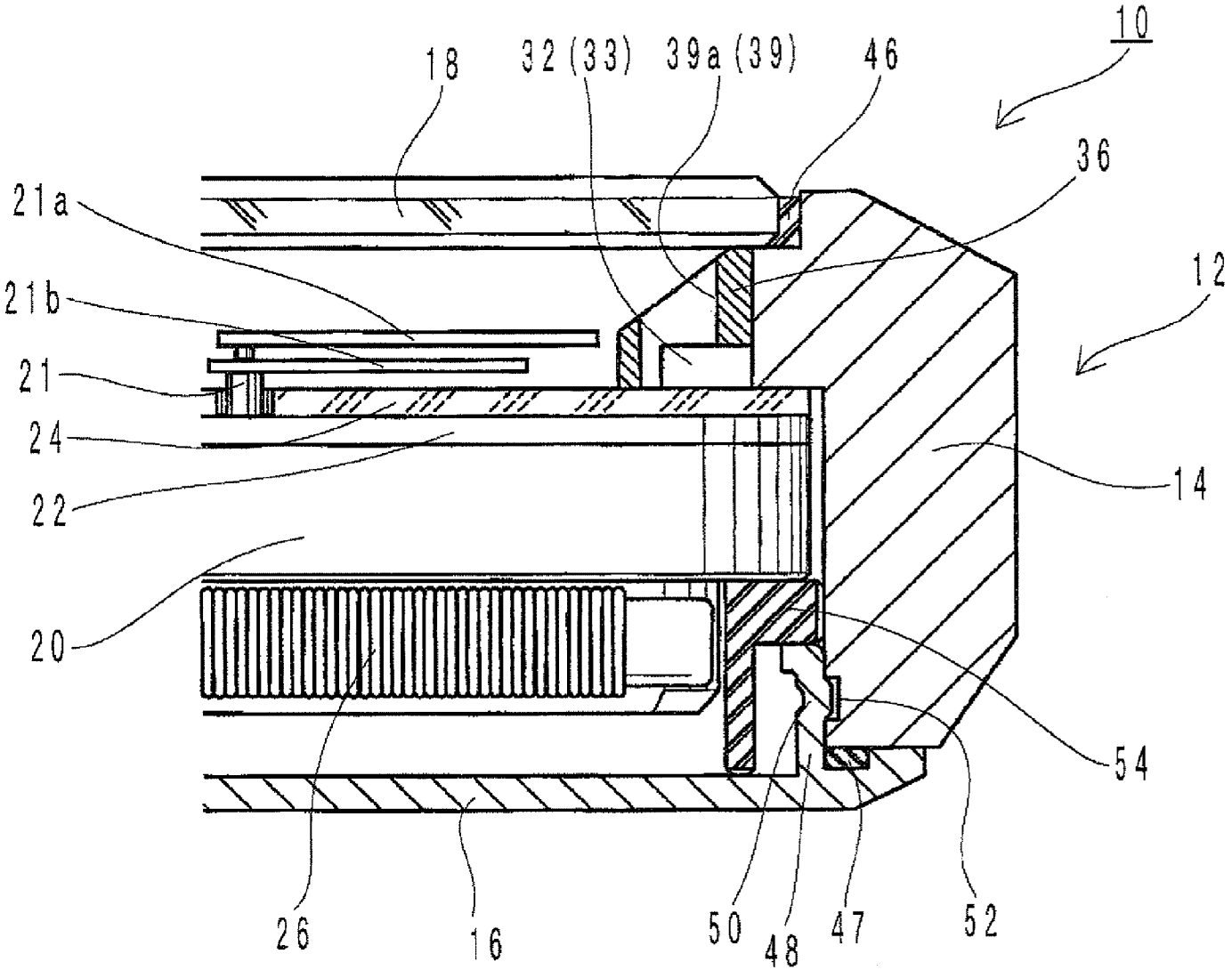
FIG. 35 is an enlarged partial sectional view of a state where the wireless function watch of the embodiment shown in FIG. 34 is assembled.

FIG. 34 is an exploded perspective view illustrating a wireless function watch of another embodiment of the present invention, and FIG. 35 is an enlarged partial sectional view in a state where the wireless function watch shown in FIG. 34 is assembled.

A wireless function watch 10 of this embodiment has basically the same configuration as that of the wireless function watch 10 of the embodiment shown in FIG. 1 or 2, and the same reference numerals are given to the same constituting members and the detailed explanation will be omitted.

Figure 36:
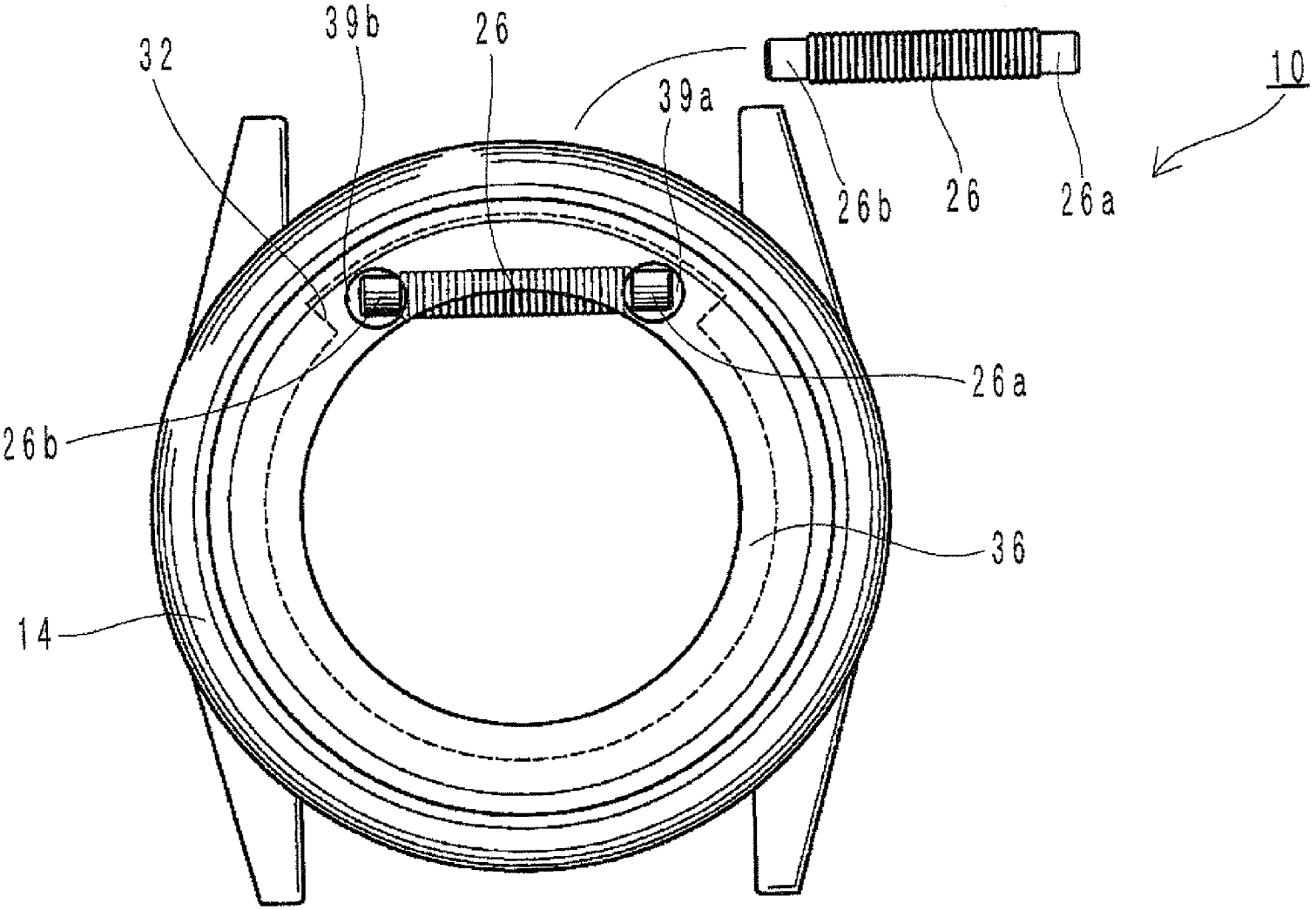
FIG. 36 is a schematic plan view of the wireless function watch of the embodiment shown in FIG. 34.

In the wireless function watch 10 of this embodiment, two holes 39*a*, 39*b* are formed in the dial ring 36. These two holes 39*a*, 39*b* are slits 39 in the dial ring 36. The distance between these two holes 39*a*, 39*b* is such that the holes are in a frame defined by the opening 33 in the watch case 14 as shown in FIG. 36. That is, the distance between these two holes 39*a*, 39*b* is slightly longer than the length between end options 26*a*, 26*b* of a rod-shaped shaft core member of the antenna 26.

According to this constitution, as shown in FIG. 35, the opening 33 and the slits 39 can be aligned with each other.

With the constitution, although an eddy current flows through opening peripheral portions of the holes 39*a*, 39*b* in the circumferential direction of the dial ring 36, the flow rate thereof will be small. Further, any metal material is not present in the height direction at positions opposed to the open end portions 26*a*, 26*b* of the antenna 26, and the receiving sensitivity of the antenna 26 is improved.

In FIG. 35, reference numerals 21*a* and 21*b* show a minute hand and an hour hand mounted on the hand axis 21.

Variations of Example 9

In a variation of Example 9, the number of the holes 39*a* formed in the dial ring 36 may be two or more, or may be one. In another variation of Example 9, only one hole 39*a* formed in the dial ring 36 may be vertically overlapped with the opening 33 formed in the watch case 14.

Even with such constitutions, the receiving sensitivity can be ensured.

Example 10

Figure 37:
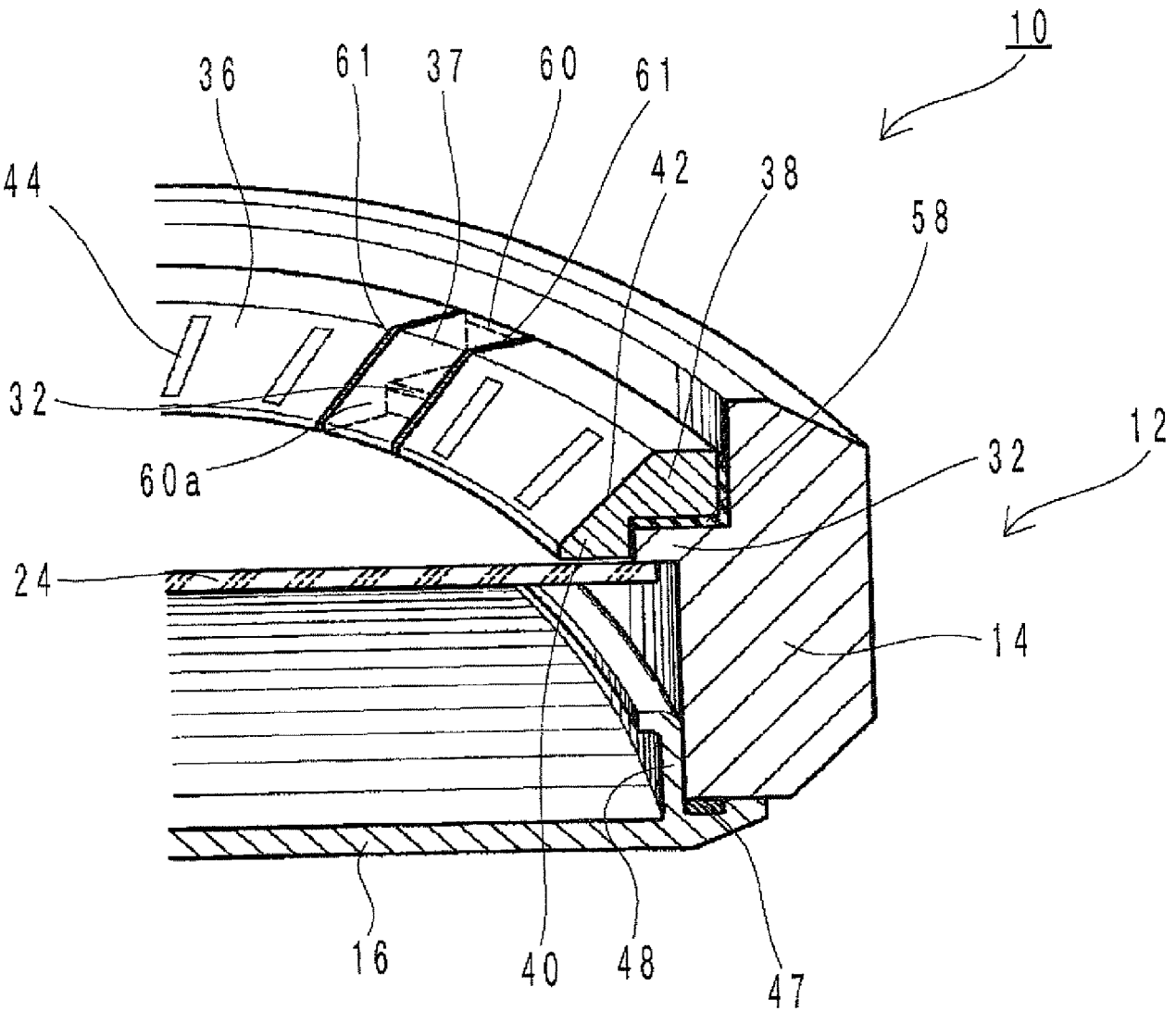
FIG. 37 shows a wireless function watch according to another embodiment of the present invention, and is particularly a schematic perspective view wherein a bonding layer is provided between an insulating member and a dial ring.

FIG. 37 is a perspective sectional view illustrating a wireless function watch of another embodiment of the present invention.

A wireless function watch 10 shown in FIG. 37 has basically the same configuration as that of the wireless function watch 10 of the embodiment shown in FIG. 1 or 2, and the same reference numerals are given to the same constituting members and the detailed explanation will be omitted.

In the wireless function watch 10 shown in FIG. 37, bonding layers 61 for bonding the insulating member 60 to the dial ring 36 are provided. Examples of the bonding layers 61 include adhesives, pressure-sensitive adhesives and double-sided tapes. The bonding layers 61 are preferably non-conductive insulating layers.

Further, the color tone of the visible face of the insulating member 60 may be the same as the color tone of the visible face of the dial ring 36.

By constituting the color tone of the visible face of the insulating member 60 the same as that of the visible face of the dial ring 36, the insulating member 60 is difficult to be visually recognized and the esthetic appearance of the dial ring 36 and the esthetic appearance of the watch itself are improved.

Further, the color tone of the visible face of the insulating member 60 may be different from the color tone of the visible face of the dial ring 36.

By constituting the color tone of the visible face of the insulating member 60 different from that of the visible face of the dial ring 36, information provided at the insulating member 60 is easily recognized by observers such as a wearer of the watch and the esthetic appearance is enhanced.

In this case, the "same color tone" means that the color tones of the dial ring 36 which is an annular member and the insulating member 60 are in a range that can be recognized as gold for example or in a range that can be recognized as silver for example, and is not limited to perfect matching in esthetic properties in appearance of the color tones.

The color tones of the visible faces of the dial ring 36 and the insulating member 60 may be the color tones of the materials themselves of the dial ring 36 and the insulating member 60 or the color tones of the coatings applied on the dial ring 36 and the insulating member 60.

Thus, the "different color tones" means that the color tones of the outer faces of the dial ring 36 and the insulating member 60 are color tones other than the same color tones as described above.

Moreover, the insulating member 60 may be used as an index showing a function display of the watch.

By using the insulating member 60 as an index that shows function displays of the watch such as time display, date display, day display, month display, year display, remaining battery level display, display of outer environment data such as pressure and temperature, display of antenna receiving sensitivity and display of successful or unsuccessful receiving at the antenna, the function displays of the watch can be presented to observers such as a wearer of the watch.

In particular, when the insulating member 60 as an index has a color tone different from that of the visible face of the dial ring 36, the function display of the watch is more easily recognized by observers.

Example 11

Figure 38:
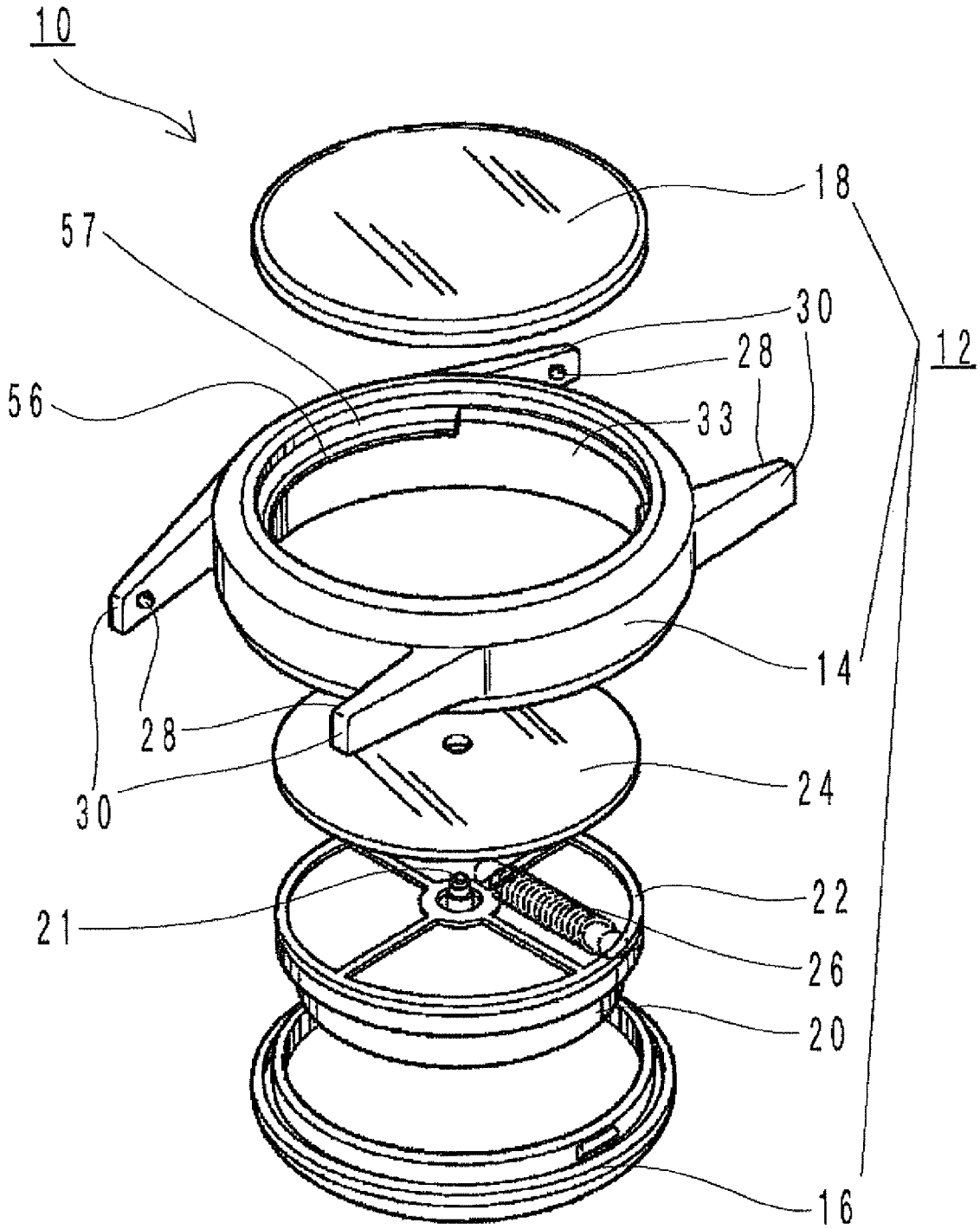
FIG. 38 is an exploded perspective view of a wireless function watch according to another embodiment of the present invention.
Figure 39:
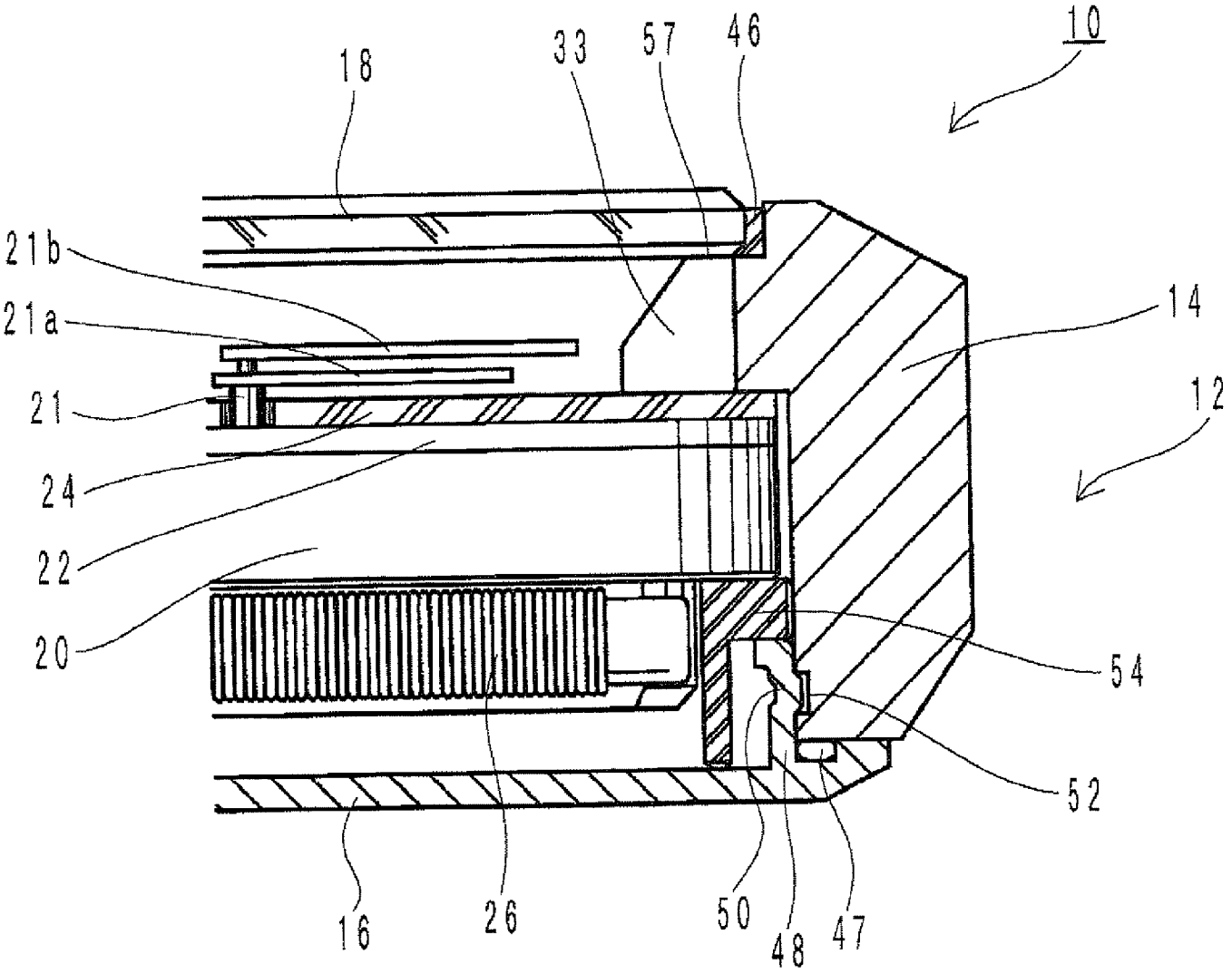
FIG. 39 is a partial sectional view in a state where the wireless function watch in FIG. 38 is assembled.

FIG. 38 is an exploded perspective view illustrating a wireless function watch of another embodiment of the present invention, and FIG. 39 is a partial sectional view in a state where the wireless function watch in FIG. 38 is assembled.

A wireless function watch 10 of this embodiment has basically the same configuration as that of the wireless function watch 10 of the embodiment shown in FIG. 1 or 2, and the same reference numerals are given to the same constituting members and the detailed explanation will be omitted.

In the wireless function watch 10 shown in FIG. 38 or FIG. 39, a projection portion 56 is formed on an inner circumferential portion of the watch case 14 instead of the dial ring receiving portion 32 projecting annularly.

Moreover, the upper face of the projection portion 56 is a glass receiving portion 57, and the watch case 14 and the glass 18 are sealed by a fixing (water-proof) packing 46 interposed on the outer circumferential face of the glass receiving portion 57.

In FIG. 39, a member projecting from the movement 20 and penetrating the solar cell 22 and the dial plate 24 is a hand axis 21. At the hand axis 21, a minute hand 21*a* and an hour hand 21*b* are arranged so that they are located between the dial plate 24 and the glass 18 to display time.

The projection portion 56 is partially cut off in the vicinity of and above the antenna 26, and this area defines an opening 33. The opening 33 is preferably provided in the same range as the ranges described in FIGS. 3 to 6.

By providing the opening 33 at the projection portion 56, the radio wave can pass therethrough easily, and the conductive projection portion 56 and the antenna 26 have such a distance therebetween that good receiving sensitivity is ensured.

Thus, the radio wave to be received by the antenna 26 is not shielded by the conductive projection portion 56, and the antenna 26 can receive the radio wave with good sensitivity through the opening 33.

By this arrangement, the decrease of the receiving sensitivity of the antenna 26 is prevented, and the receiving sensitivity of the antenna 26 can be improved.

Example 12

Figure 40:
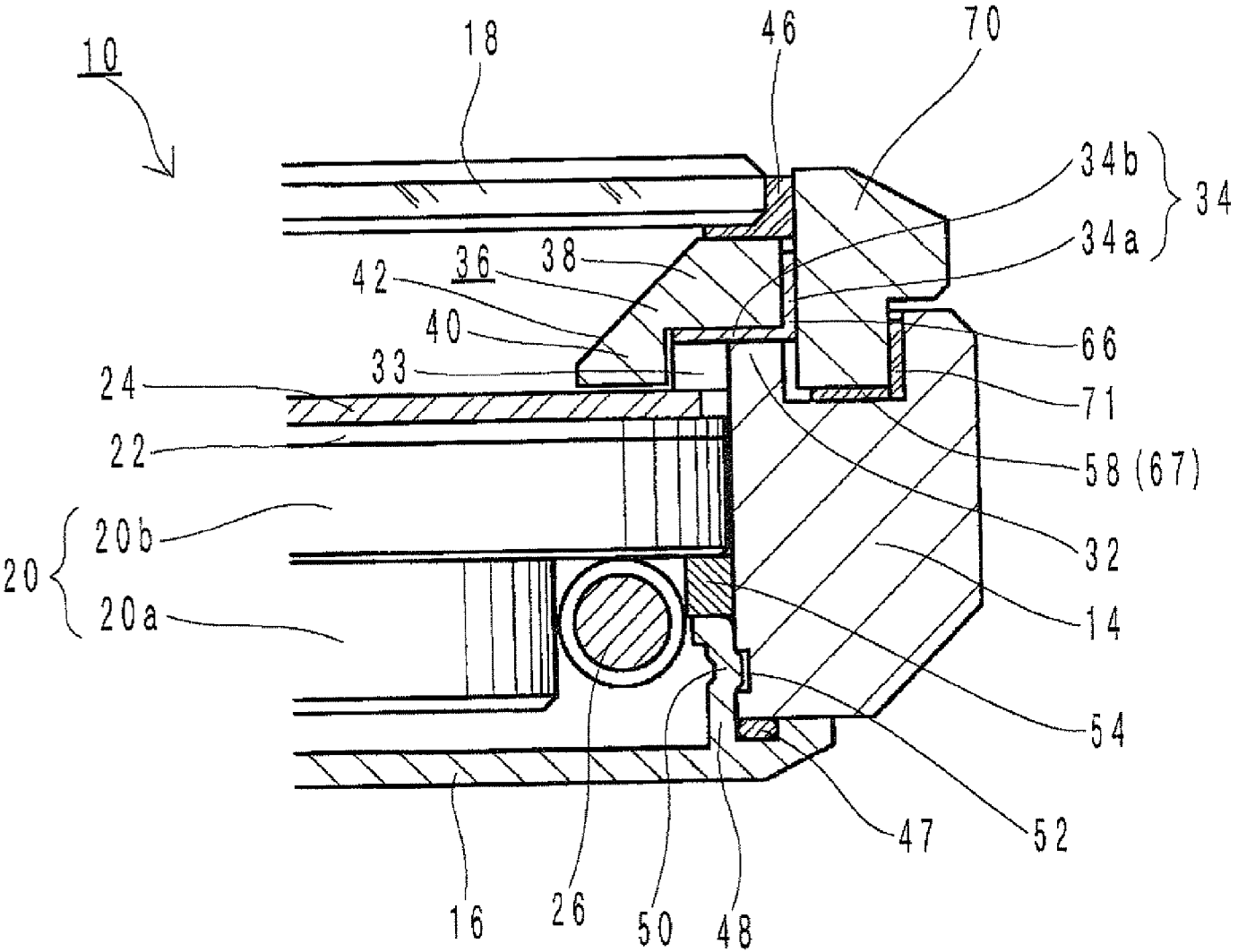
FIG. 40 is a partial sectional view illustrating another embodiment of a wireless function watch of the present invention.

FIG. 40 is a partial sectional view illustrating a wireless function watch of another embodiment of the present invention.

A wireless function watch 10 shown in FIG. 40 has basically the same configuration as that of the wireless function watch 10 of the embodiment shown in FIG. 1 or 2, and the same reference numerals are given to the same constituting members and the detailed explanation will be omitted.

In the wireless function watch 10 shown in FIG. 40, a bezel 70 is provided on the upper face of the watch case 14. In order to ensure water-proof properties between the watch case 14 and the bezel 70, a water-proof packing 71 is disposed between these members.

In this embodiment wherein the bezel 70 is provided as above, an insulating region 58 is preferably provided between the bezel 70 and the dial ring 36 and between the bezel 70 and the watch case 14, in addition to between the watch case 14 and the dial ring 36.

The insulating regions 58 may be formed at, as shown in FIG. 40, a junction 66 among the upper face 34*a* of the stepped portion 34 of the dial ring receiving portion 32, the dial ring 36 and the bezel 70, or may be formed at a junction 67 between the bezel 70 and the watch case 14 that is inward from the water-proof packing 71. However, such insulating regions 58 may also be formed at a junction between the bezel 70 and the watch case 14 that is outside the water-proof packing 71, and may be formed at both of the junctions. The positions of the insulating regions are preferably selected as appropriate.

Figure 41:
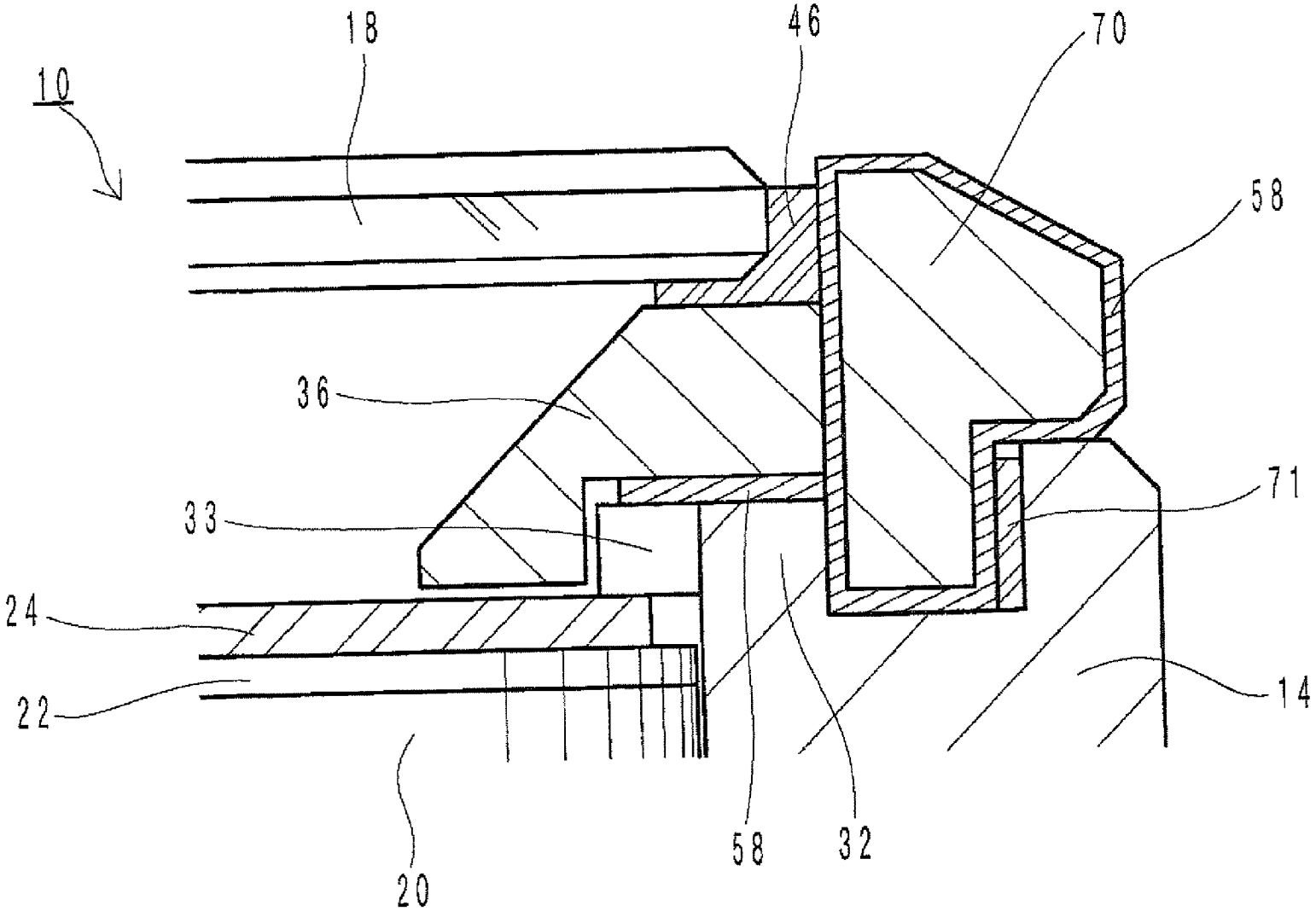
FIG. 41 is an enlarged partial sectional view illustrating another range in which the insulating region in the embodiment shown in FIG. 40 is provided.
Figure 42:
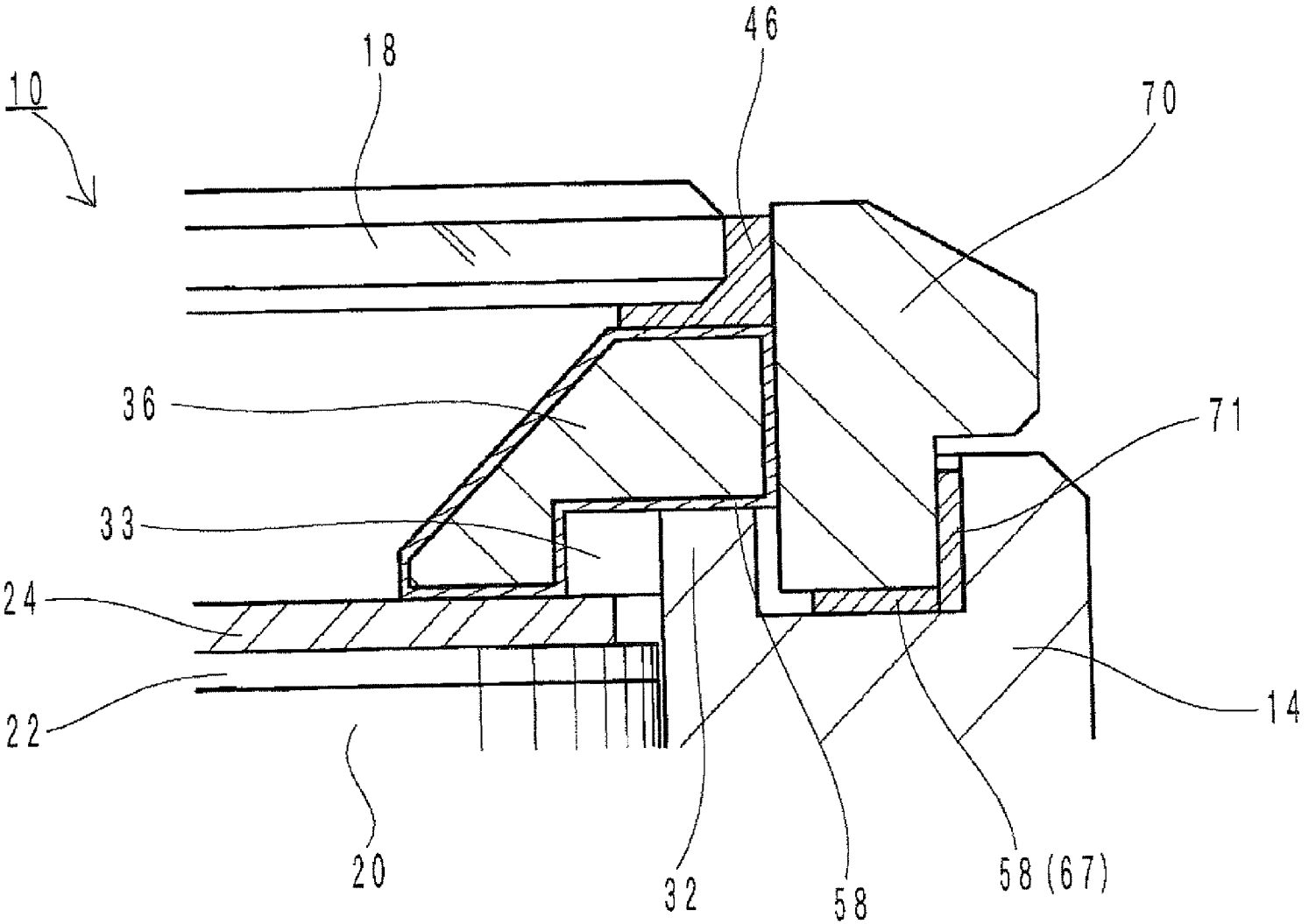
FIG. 42 is an enlarged partial sectional view illustrating another range in which the insulating region in the embodiment shown in FIG. 40 is provided.

Further, it is possible to provide the insulating region 58 on the entire face of the bezel 70 as shown in FIG. 41 or to provide the insulating region 58 on the entire face of the dial ring 36 as shown in FIG. 42.

The number and positions of the insulating regions 58 are not particularly limited, and an insulating coating may be formed as the insulating region 58 only at a position corresponding to the position of the antenna 26. The range of such coatings is preferably as shown in FIGS. 11 to 13 similarly to the insulating regions 58 of the dial ring 36.

In summary, the insulating members that are the insulating regions 58 between the members ensure that the antenna 26 receives the radio wave with good sensitivity through the opening 33.

Example 13

Figure 43:
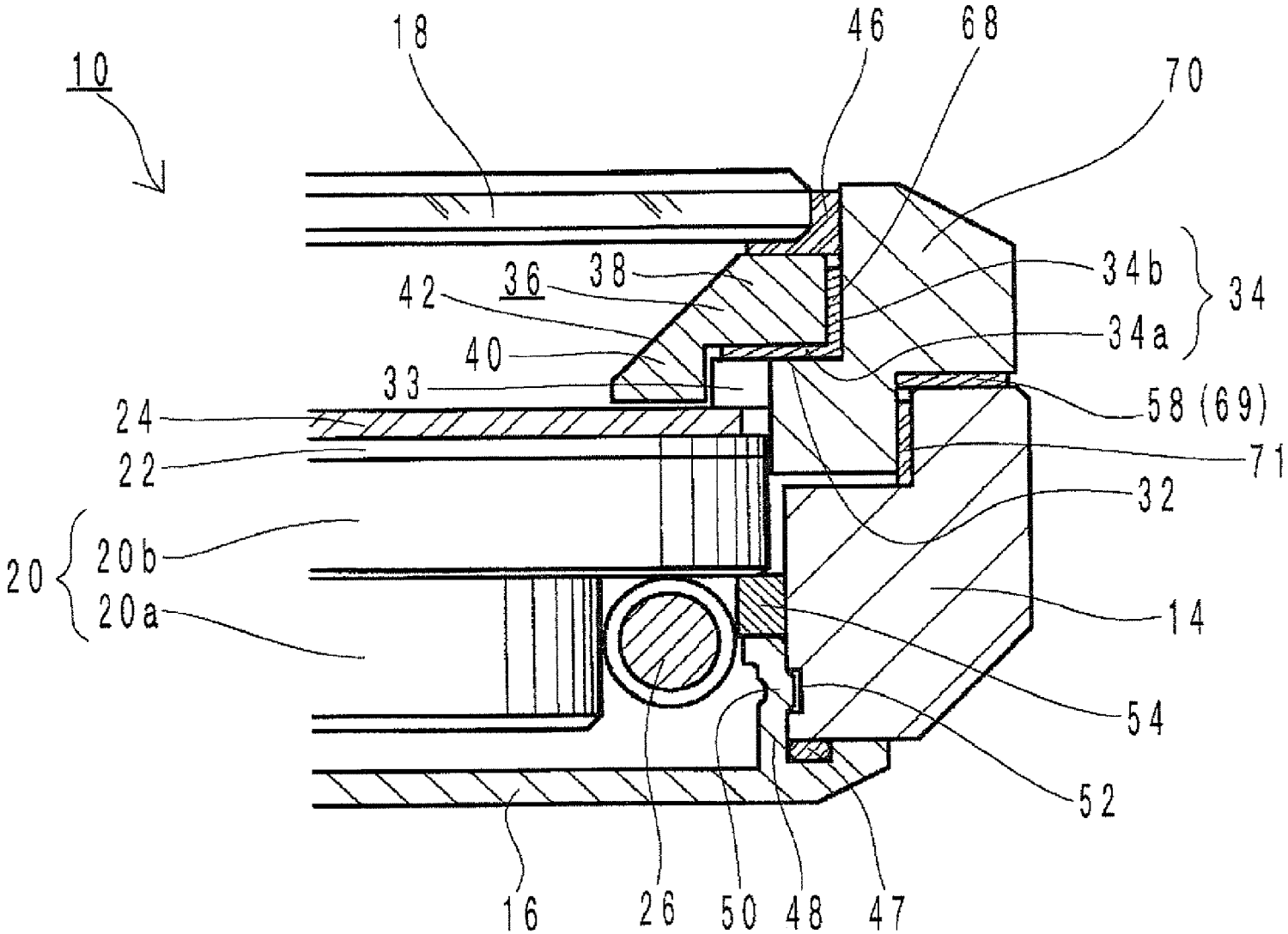
FIG. 43 is a partial sectional view illustrating another embodiment of a wireless function watch of the present invention.

FIG. 43 is a partial sectional view illustrating a wireless function watch of another embodiment of the present invention.

A wireless function watch 10 shown in FIG. 43 has basically the same configuration as that of the wireless function watch 10 of the embodiment shown in FIG. 1 or 2, and the same reference numerals are given to the same constituting members and the detailed explanation will be omitted.

In the wireless function watch 10 shown in FIG. 43, the bezel 70 is provided on the upper face of the watch case 14, and the dial ring 36 is arranged on the inner circumferential side of the bezel 70.

In Examples 1, 2, 3 and 12, the dial ring receiving portion 32 having the opening 33 is provided at the watch case 14. In this embodiment, a dial ring receiving portion 32 having an opening 33 is formed at the bezel 70.

In this case, the insulating region 58 is preferably provided between the bezel 70 and the dial ring 36 and between the bezel 70 and the watch case 14.

The insulating regions 58 may be formed at a junction 68 among the upper face 34*a* of the stepped portion 34 of the dial ring receiving portion 32 of the bezel 70, the dial ring 36 and the bezel 70, or may be formed at a junction 69 between the bezel 70 and the watch case 14 that is outside the water-proof packing 71 as shown in FIG. 27. Such insulating regions 58 may also be formed at a junction between the bezel 70 and the watch case 14 that is inward from the water-proof packing 71, or may be formed at both of the junctions. The positions of the insulating regions are preferably selected as appropriate.

Figure 44:
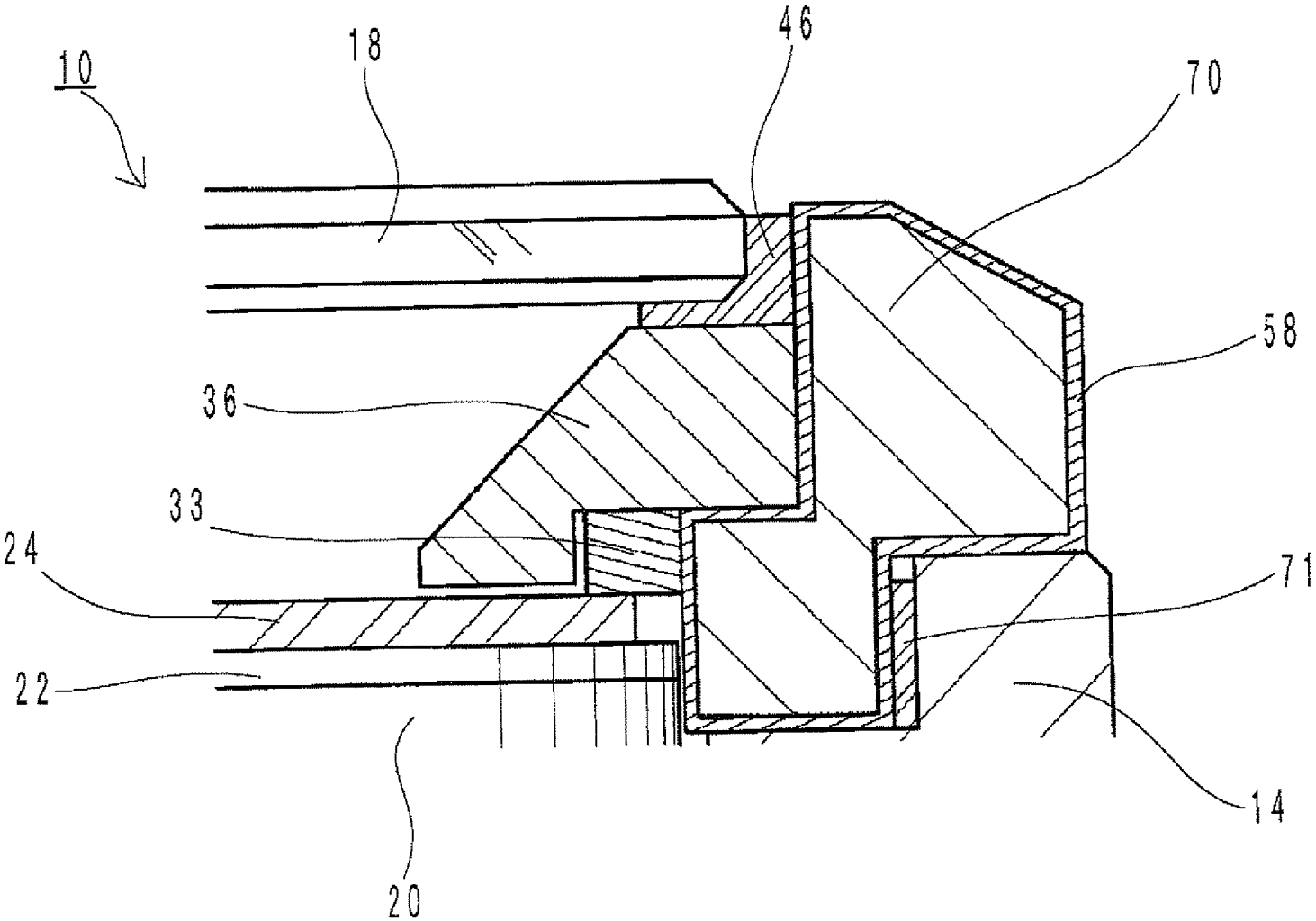
FIG. 44 is an enlarged partial sectional view illustrating another range in which the insulating region in the embodiment shown in FIG. 43 is provided.
Figure 45:
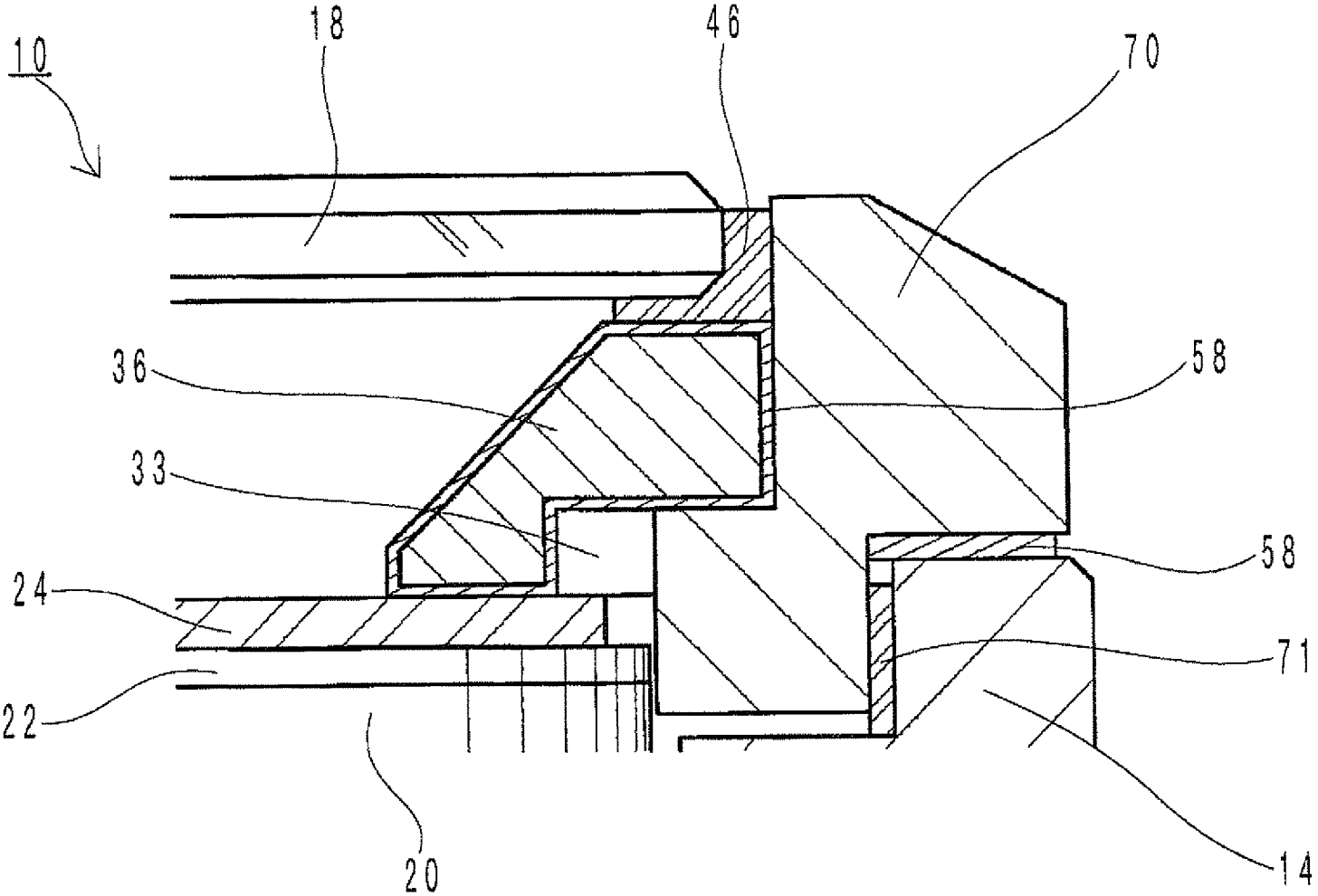
FIG. 45 is an enlarged partial sectional view illustrating another range in which the insulating region in the embodiment shown in FIG. 43 is provided.

Further, similarly to Example 12, it is possible to provide the insulating region 58 on the entire face of the bezel 70 as shown in FIG. 44 or to provide the insulating region 58 on the entire face of the dial ring 36 as shown in FIG. 45.

The number and positions of the insulating regions 58 are not particularly limited, and an insulating coating may be formed as the insulating region 58 only at a position corresponding to the position of the antenna 26. The range of such coatings is preferably as shown in FIGS. 11 to 13 similarly to the insulating regions 58 of the dial ring 36.

Example 14

Figure 46:
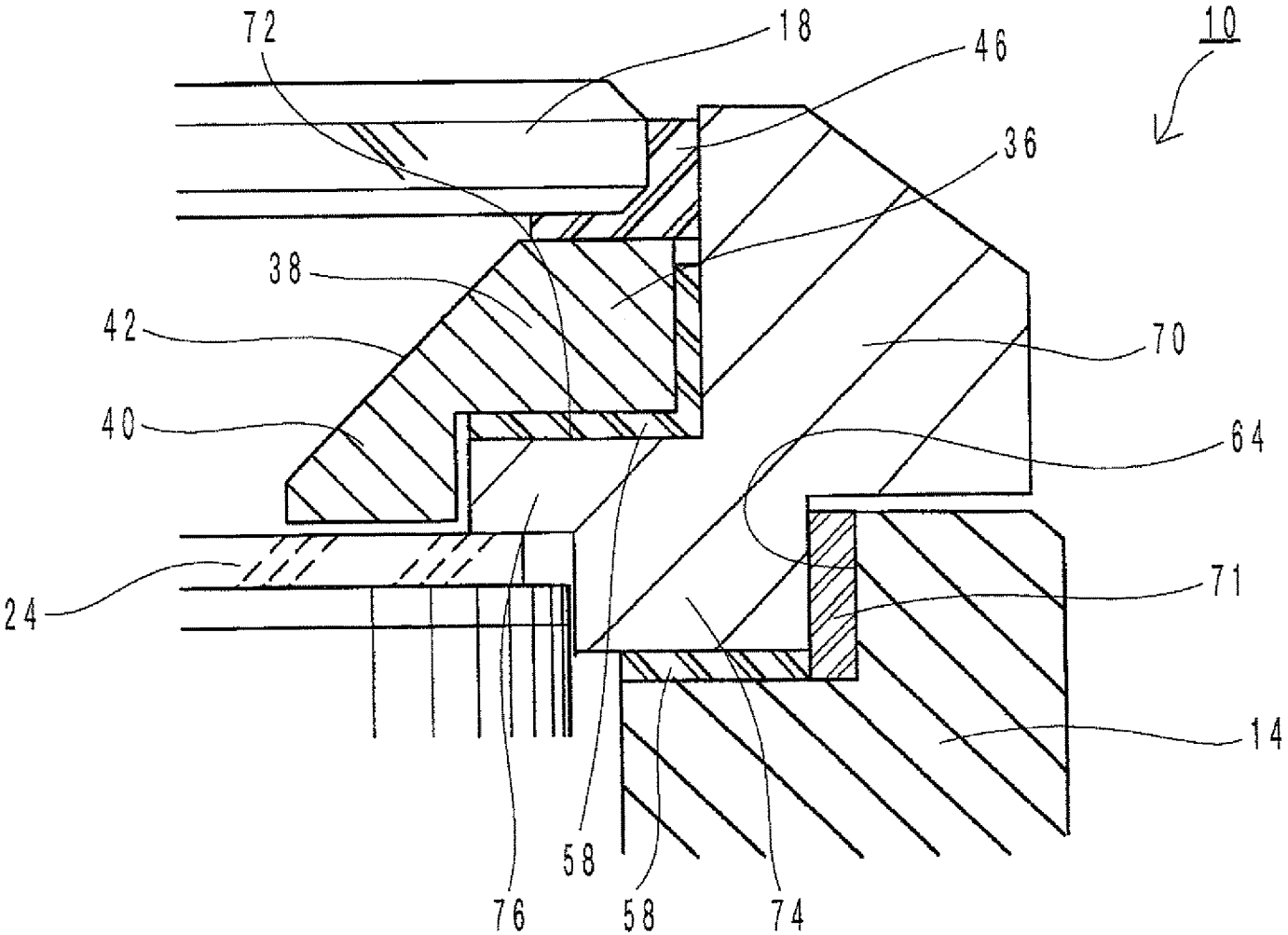
FIG. 46 shows another embodiment of the present invention, and is particularly an enlarged partial sectional view of a wireless function watch in which a bezel is provided.

FIG. 46 is an enlarged sectional view illustrating a wireless function watch of another embodiment of the present invention.

A wireless function watch 10 shown in FIG. 46 has basically the same configuration as that of the wireless function watch 10 of the embodiment shown in FIG. 1 or 2, and the same reference numerals are given to the same constituting members and the detailed explanation will be omitted.

In this embodiment, the bezel 70 is provided at the wireless function watch 10.

That is, the bezel 70 is provided on the watch case 14, and the dial ring 36 is arranged at the bezel 70.

In detail, in the wireless function watch 10 shown in FIG. 46, the bezel 70 is provided on the upper face of the watch case 14. Further, a bezel accommodating recess portion 73 is formed inside the opening end of the watch case 14, and the bezel 70 is accommodated in this bezel accommodating recess portion 73.

In the bezel 70, a flange-shaped dial ring receiving portion 76 is projected annularly on the inner circumferential side, and the dial ring 36 is attached on a top face 72 of the dial ring receiving portion 76. In the bezel 70, a fitting portion 74 to be fitted in the bezel accommodating recess portion 73 of the watch case 14 is formed at the lower end on the inner circumferential side.

In FIG. 46, reference numeral 71 denotes a packing for sealing between the bezel 70 and the watch case 14.

Between the bezel 70 and the watch case 14, the insulating region 58 is formed.

By forming the insulating region 58 between the bezel 70 and the watch case 14 as above, the receiving sensitivity is not deteriorated between the conductive bezel 70 and the watch case 14, and the receiving sensitivity of the antenna 26 is improved.

In this case, the insulating region 58 formed between the bezel 70 and the watch case 14 may be formed with the same material and by the same method as those for the insulating regions 58 described hereinabove.

Moreover, the wireless function watch 10 of this embodiment is provided with the insulating region 58 between the bezel 70 and the dial ring 36.

By providing the insulating region 58 between the bezel 70 and the dial ring 36 as above, the receiving sensitivity of the antenna 26 is improved.

Figure 47:
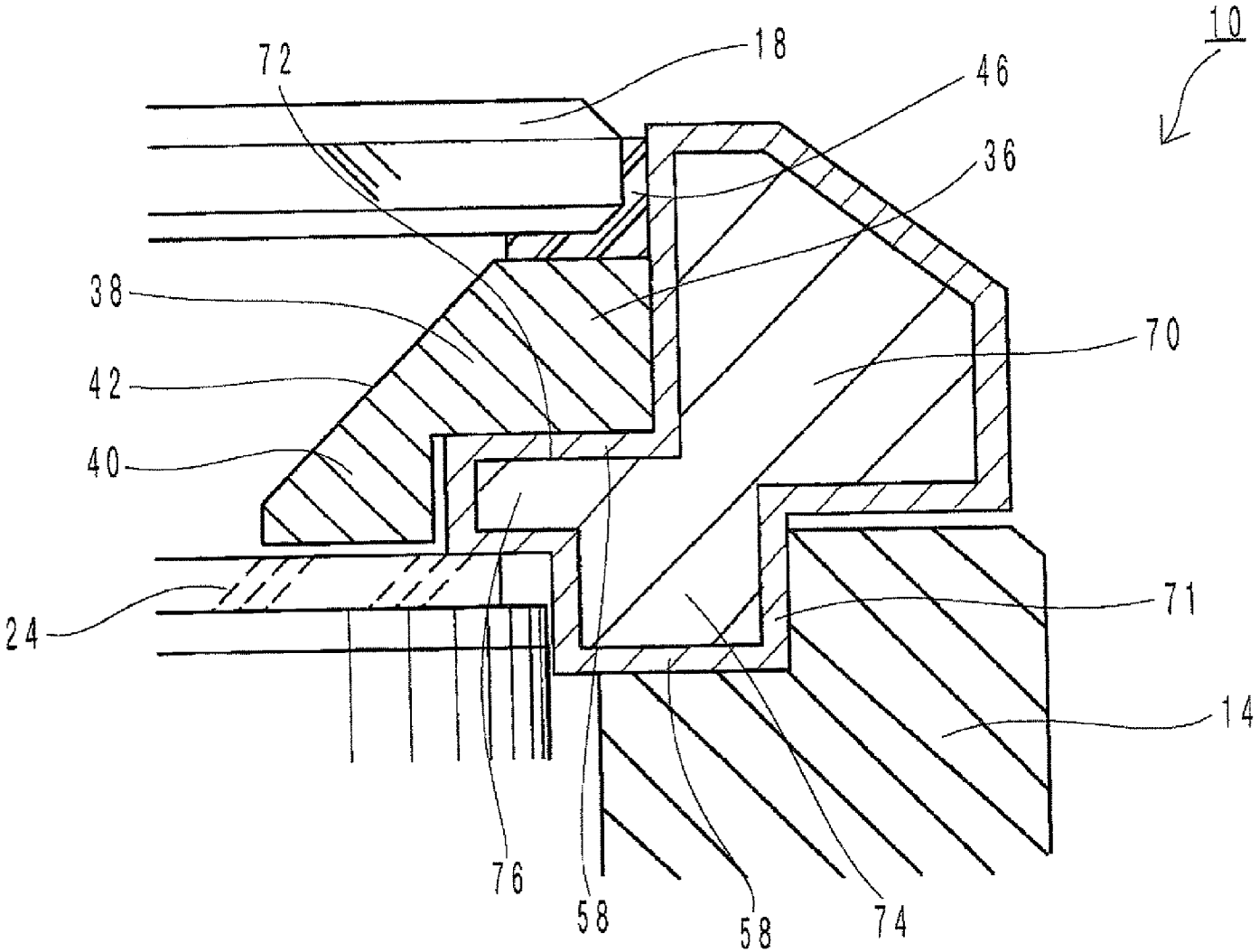
FIG. 47 is an enlarged partial perspective view similar to FIG. 9 of a wireless function watch 10 according to another embodiment of the present invention.

In this case, the insulating region 58 formed between the bezel 70 and the watch case 14 may be formed with the same material and by the same method as those for the insulating region 58 formed between the dial ring 36 and the watch case 14 in the embodiments in FIGS. 8 to 13. In detail, the insulating region 58 may be constituted by an insulating member arranged between the bezel 70 and the watch case 14; an insulating member may be affixed on the bezel 70; an insulating member may be affixed on the watch case 14; the insulating region 58 may be constituted by an insulating coating formed on at least one of the boundary faces of the bezel 70 and the watch case 14; and an insulating coating may be formed on the bezel 70 on the entire face of the bezel 70 as shown in FIG. 47. Detailed description of such embodiments is omitted.

With regard to the number and positions of the insulating regions 58, though not shown, the insulating region 58 may be arranged in the vicinity of and above the antenna 26 similarly to the insulating regions 58 of the embodiments in FIGS. 8 to 13 and similarly to the embodiment shown in FIG. 11; the insulating region 58 may be constituted by an insulating region 58 arranged in the vicinity of and above the antenna 26 and opposed to at least one open end portion 26*a* of the antenna 26 similarly to the embodiment shown in FIG. 12; or the insulating region 58 may be constituted by two insulating regions 58 arranged in the vicinity of and above the antenna 26 and opposed to both open end portions 26*a*, 26*b* of the antenna 26 similarly to the embodiment shown in FIG. 13.

Moreover, the wireless function watch 10 of this embodiment is provided with the insulating region 58 between the bezel 70 and the dial ring 36 that is an annular member.

By providing the insulating region 58 between the bezel 70 and the dial ring 36, an induction current is not generated between the conductive bezel 70 and the dial ring 36. Consequently, the decrease of the receiving sensitivity of the antenna 26 caused by an eddy current flowing between the bezel 70 and the dial ring 36 is prevented, and the receiving sensitivity of the antenna 26 is improved.

Figure 48:
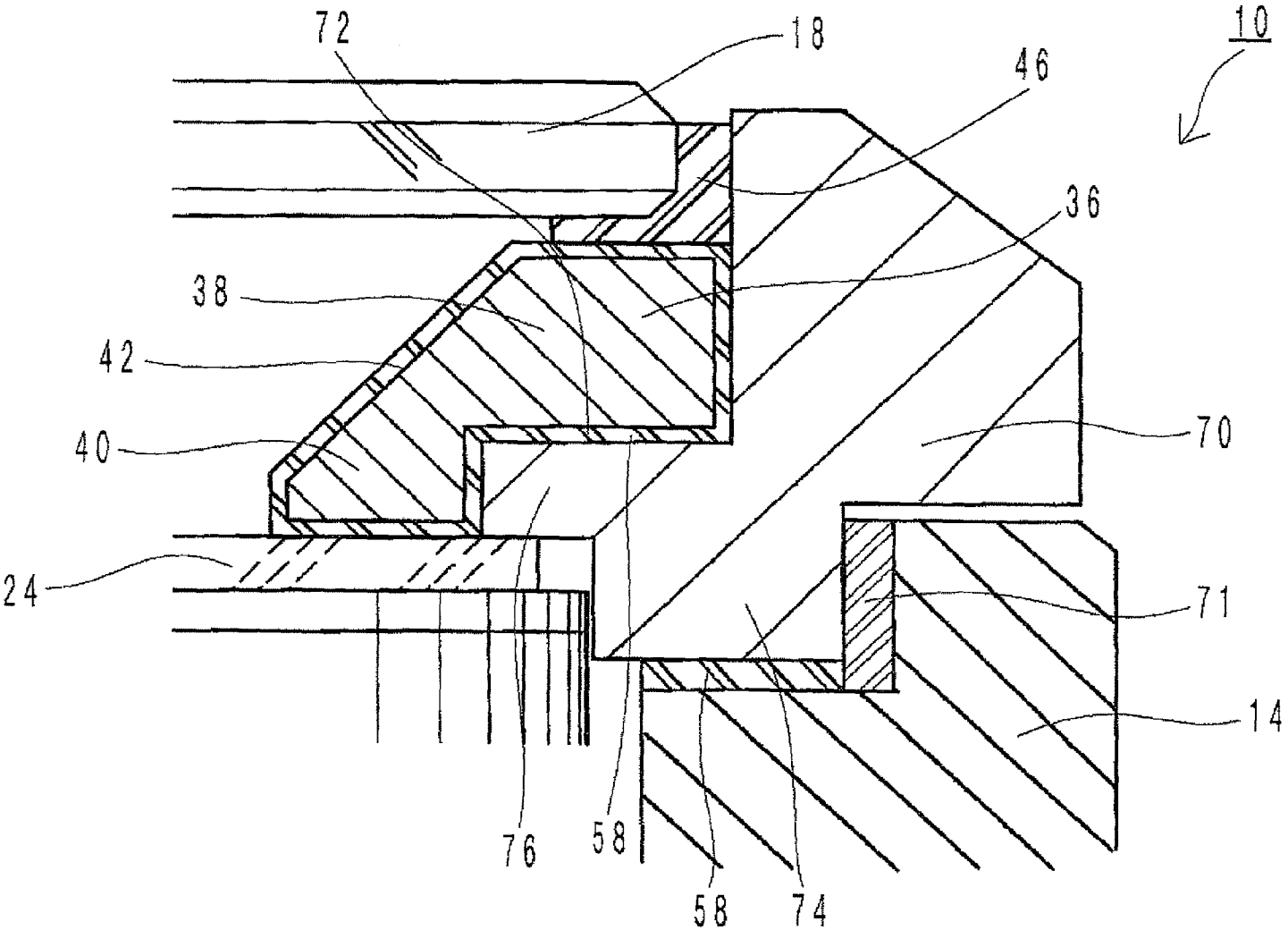
FIG. 48 is an enlarged partial sectional view similar to FIG. 9 illustrating another embodiment of a wireless function watch of the present invention.
Figure 49:
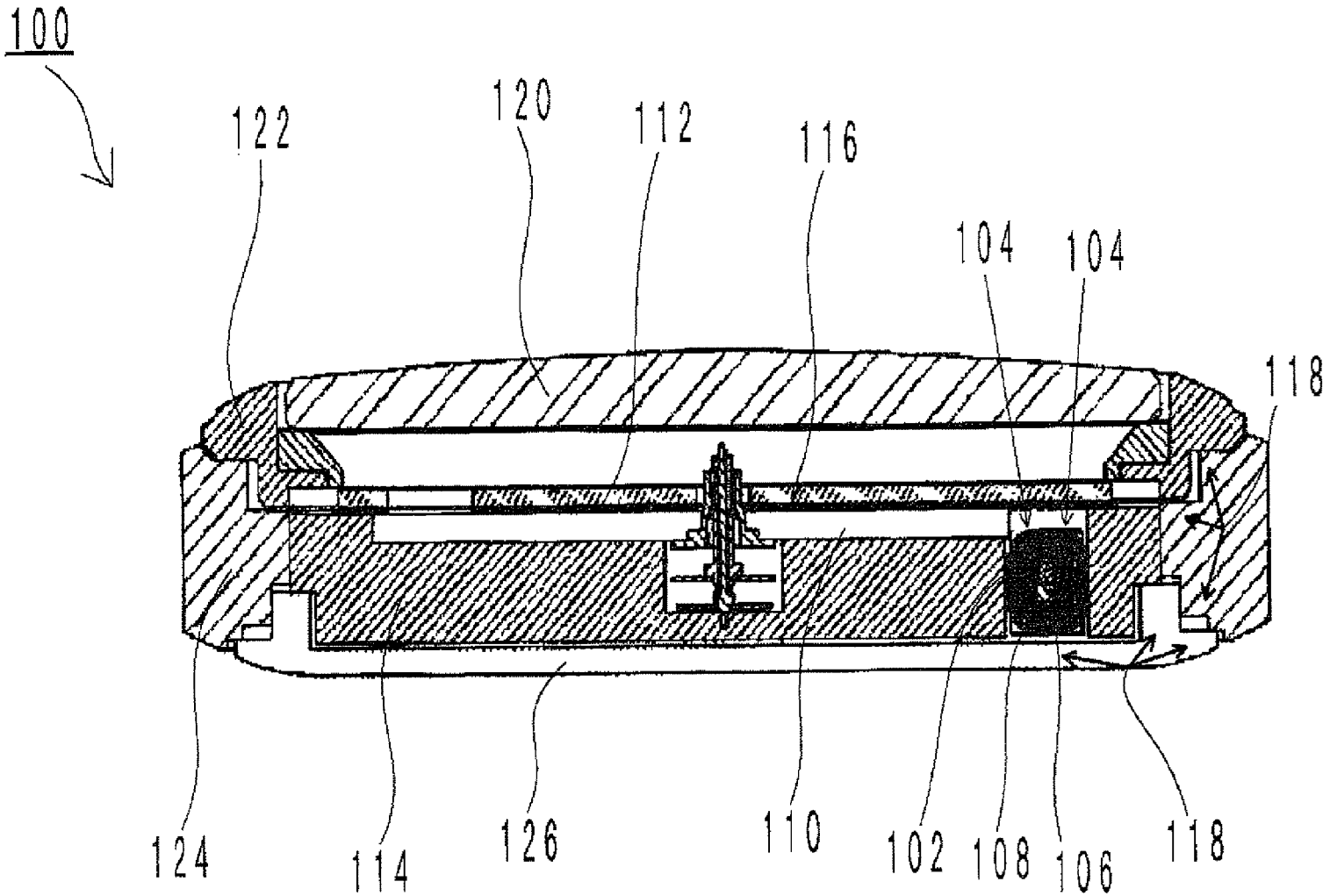
Figure 49 Prior Art
FIG. 49 is a sectional view of a conventional wireless function watch.
Figure 50:
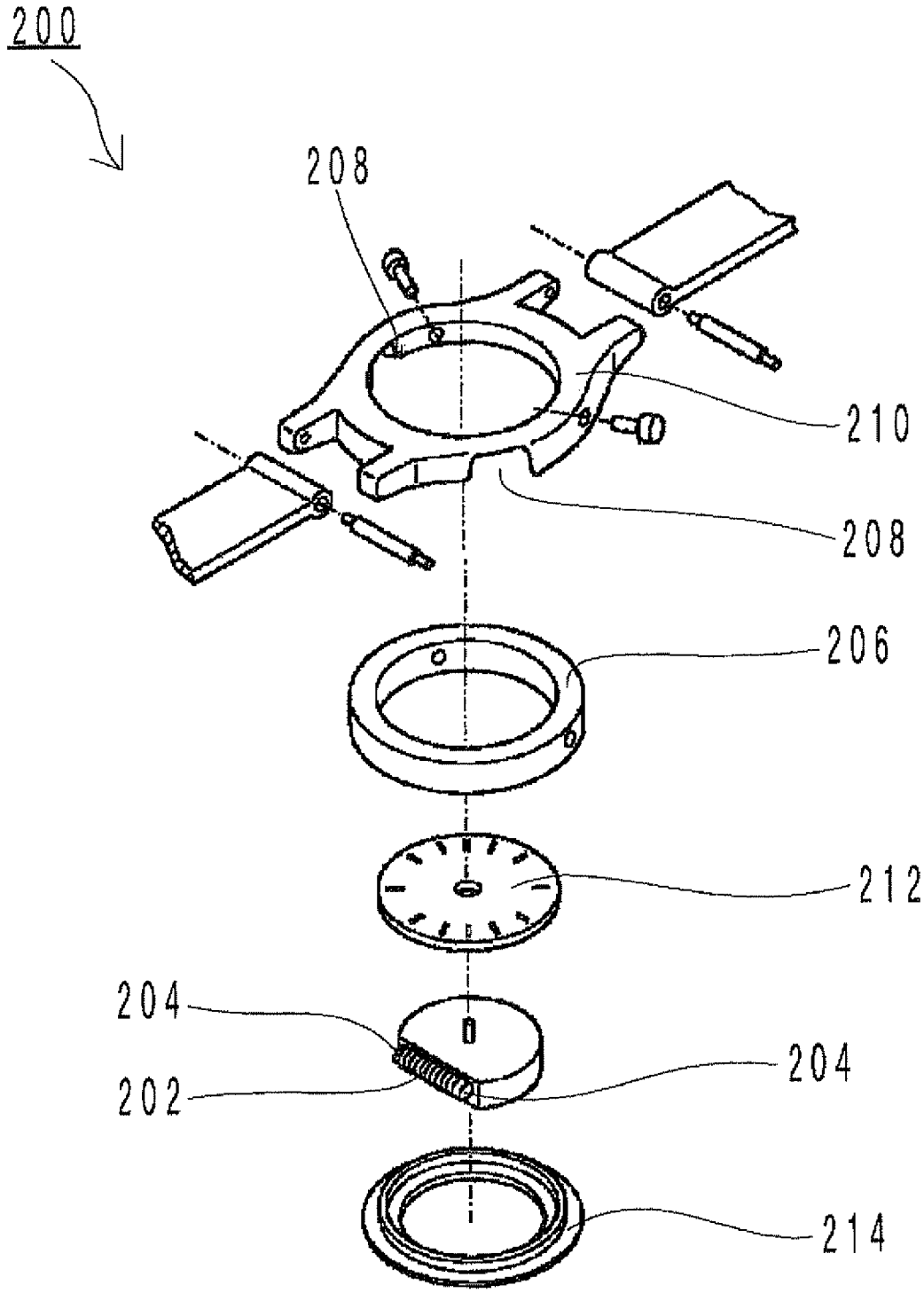
Figure 50 Prior Art
FIG. 50 is an exploded perspective view of a conventional wireless function watch.
Figure 51:
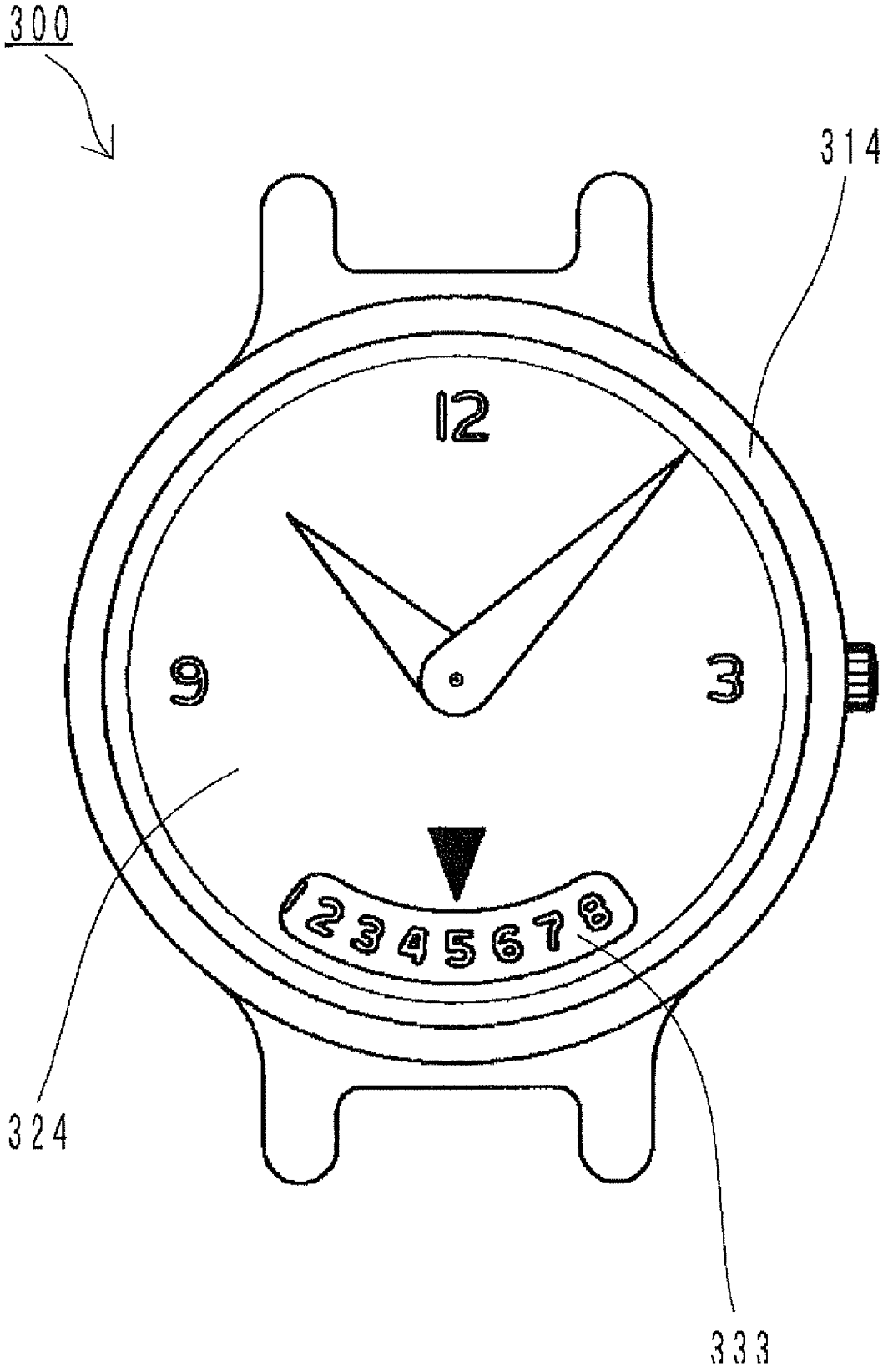
Figure 51 Prior Art
FIG. 51 is a plan view of a conventional wireless function watch.
Figure 52:
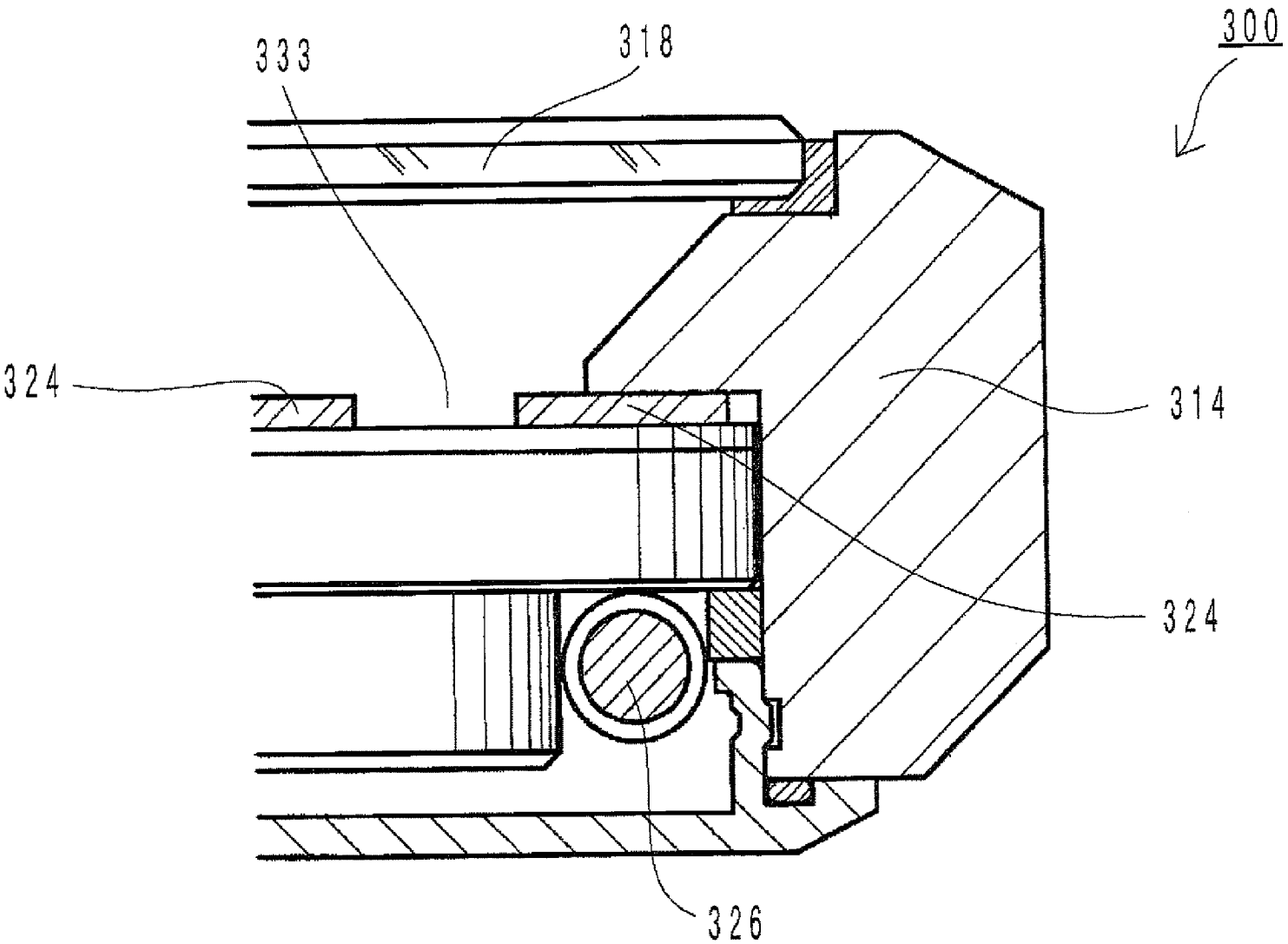
Figure 52 Prior Art
FIG. 52 is a partial sectional view of the wireless function watch shown in FIG. 51.
Figure 53:
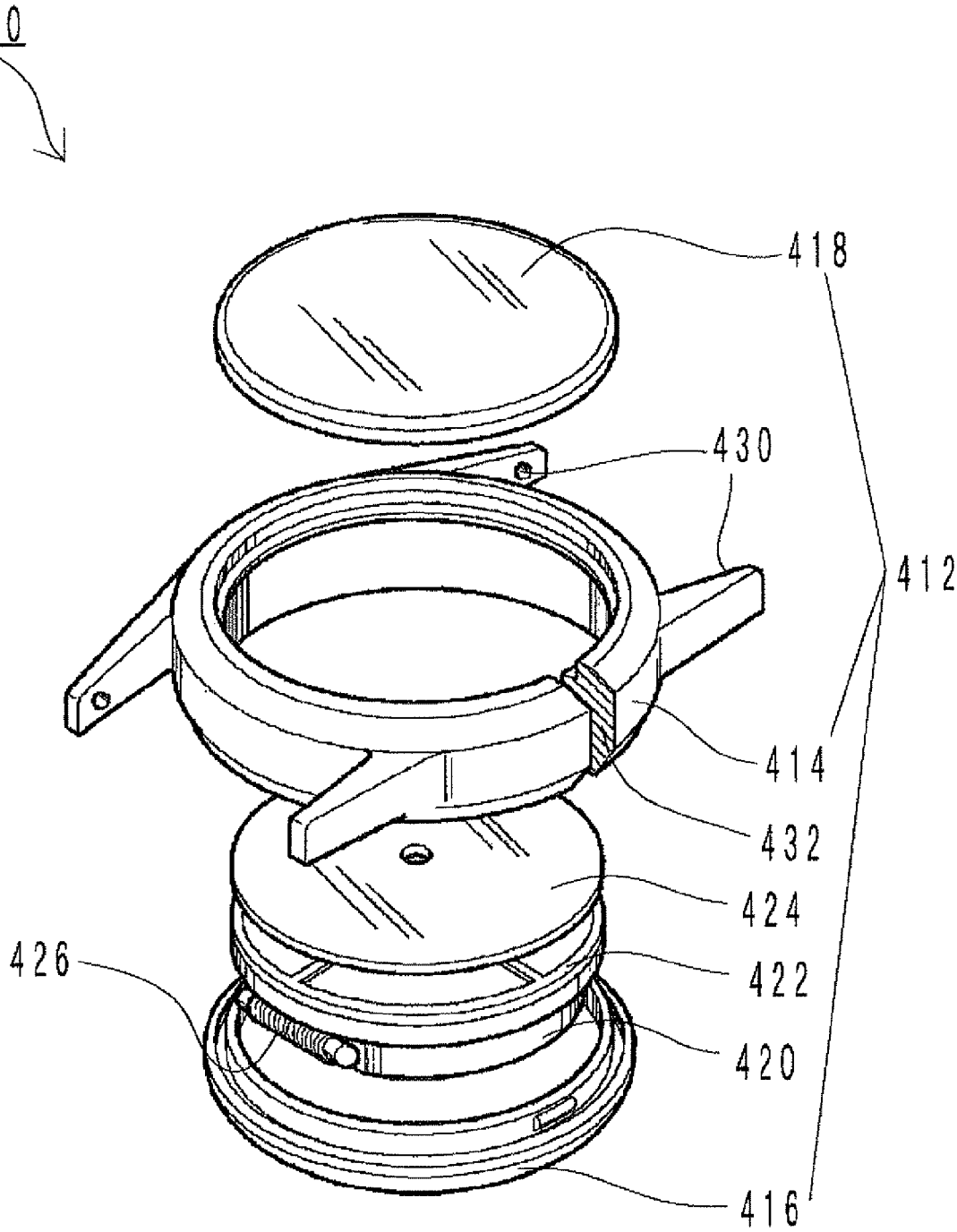
Figure 53 Prior Art
FIG. 53 is an exploded perspective view of a conventional wireless function watch.
Figure 54:
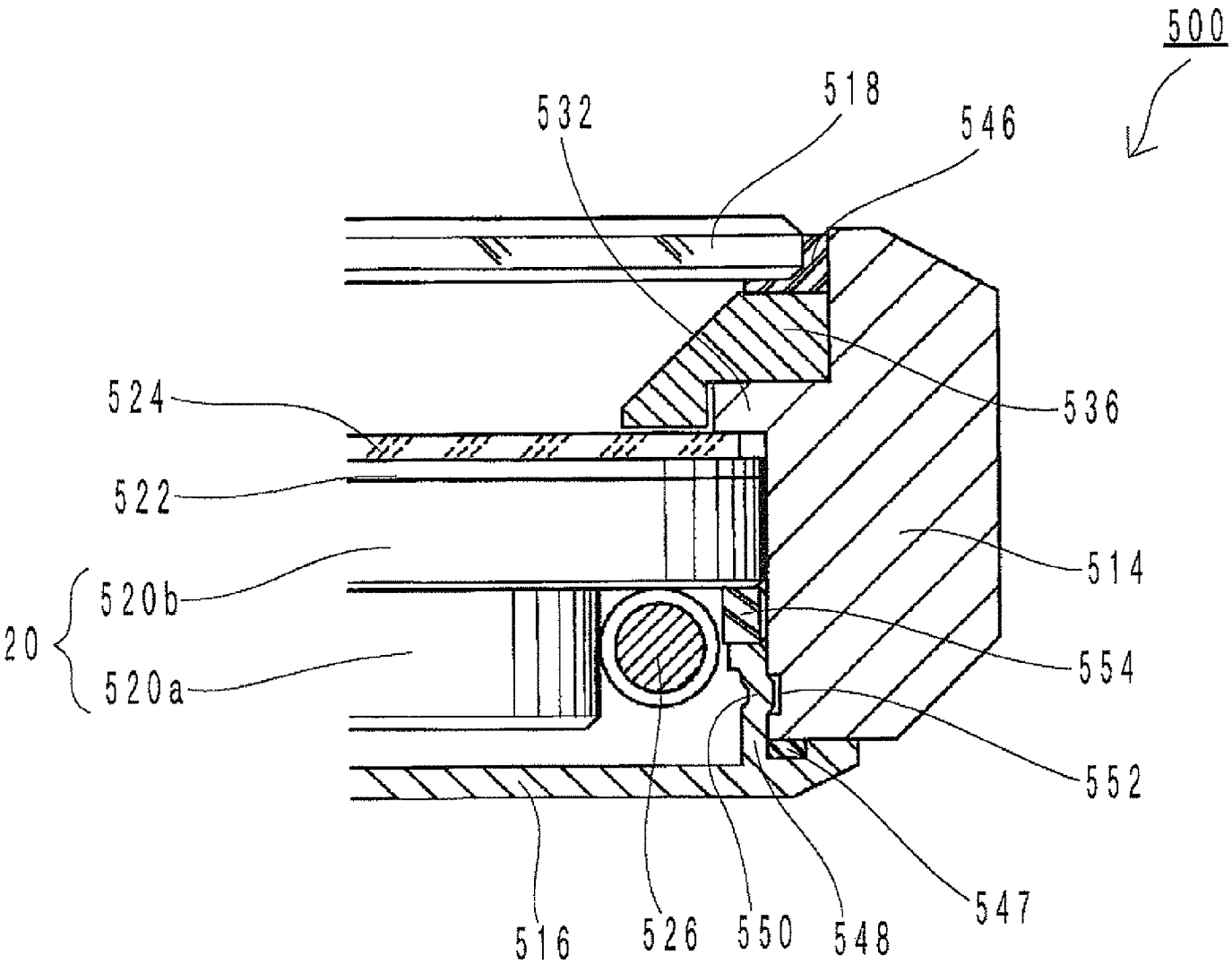
Figure 54 Prior Art
FIG. 54 is an exploded perspective view of a conventional wireless function watch provided with a bezel.

In this case, the insulating region 58 formed between the bezel 70 and the dial ring 36 may be formed with the same material and by the same method as those for the insulating region 58 formed between the dial ring 36 and the watch case 14 in the embodiments in FIGS. 8 to 13. In detail, the insulating region 58 may be constituted by an insulating member arranged between the bezel 70 and the dial ring 36; an insulating member may be affixed on the bezel 70; an insulating member may be affixed on the dial ring 36; the insulating region 58 may be constituted by an insulating coating formed on at least one of the boundary faces of the bezel 70 and the dial ring 36; and an insulating coating may be formed on the dial ring 36 on the entire face of the dial ring 36 as shown in FIG. 48. Detailed description of such embodiments is omitted.

With regard to the number and positions of the insulating regions 58, though not shown, the insulating region 58 may be arranged in the vicinity of and above the antenna 26 similarly to the insulating regions 58 of the embodiments in FIGS. 8 to 13 and similarly to the embodiment shown in FIG. 11; the insulating region 58 may be constituted by an insulating region 58 arranged in the vicinity of and above the antenna 26 and opposed to at least one open end portion 26*a* of the antenna 26 similarly to the embodiment shown in FIG. 12; or the insulating region 58 may be constituted by two insulating regions 58 arranged in the vicinity of and above the antenna 26 and opposed to both open end portions 26*a*, 26*b* of the antenna 26 similarly to the embodiment shown in FIG. 13.

In the embodiments in FIGS. 46 to 48, the flange-shaped dial ring receiving portion 76 is projected annularly on the inner circumferential side of the bezel 70, and the dial ring 36 constituting a conductive annular member is attached on a stepped portion 75 defined by the dial ring receiving portion 76. Although not shown, the dial ring receiving portion 76 may be formed on the inner circumferential side of the watch case 14 without projecting the dial ring receiving portion 76 on the bezel 70.

In this case too, it is possible to provide the insulating region between the dial ring 36 and the dial ring receiving portion 76 of the watch case 14.

The embodiments of the present invention have been described above, but the present invention is not limited to these embodiments, and various variations and changes are possible in a range not departing from the scope of the invention.

For example, various methods may be applied for the mounting of the dial ring and the watch case, the mounting of the dial plate and the watch case, the fixation of the watch case and the caseback, and the fixation of the watch case and the glass.

Relative positional relations between the members described in the embodiments may be appropriately changed as necessary. Further, the materials and shapes of the members are not limited as long as the function of each member is achieved.

It is also within the scope of the invention to integrate the caseback and the watch case into a single part.

The dial plate may be replaced by a liquid crystal display unit. When the liquid crystal display unit is used, the display hands may be eliminated.

The structures of the wireless function watch in the present invention exert the remarkable advantages when applied to wrist watches. However, the structures of the wireless function watch in the present invention may be also applied to clocks or wall clocks in addition to the wrist watches.

In the embodiments, radio controlled watches provided with a radio function to receive a standard long wave (carrier wave) including time information and to modify the time based on the time information were explained, but the structures of the wireless function watch in the present invention may be applied to watches provided with radio functions such as personal computer communication function, cellular phone function, non-contact IC card function and the like.

Test Example

A test example using a wireless function watch of the present invention will be described below. <Radio controlled watch>

Dial ring: (material: Ni-plated SUS316L)

Watch case: (material: SUS316L)

Caseback: (material: SUS316L)

Insulating region: (insulating member, material: PET) <Test procedure>

A wireless function watch with a structure in FIG. 1 or 2 was manufactured by assembling the members, and the receiving sensitivity of the antenna accommodated in the housing was measured (Test example 1).

The radio wave was a standard wave (40 KHz, 60 KHz).

For comparison, a watch in which the antenna was not accommodated in the housing and was allowed to receive the radio wave directly (Test example 2), and a watch similar to that of Test example 1 except that the opening was not provided at the dial ring receiving portion (Test example 3) were manufactured, and the receiving sensitivity of the antenna was measured.

According to the receiving results, it was found that the wireless function watch in which the opening was provided at the dial ring receiving portion (Test example 1) achieved receiving sensitivity comparable to the watch in which the antenna was not accommodated in the housing and was allowed to receive the radio wave directly (Test example 2).

Thus, it was obtained that the wireless function watch in which the opening was provided (Test example 1) had higher receiving sensitivity in the comparison between the wireless function watch without the opening (Test example 3) and the wireless function watch with the opening (Test example 1).

The invention claimed is:

1. A wireless function watch comprising: an antenna for receiving a radio wave from outside; a housing for accommodating the antenna; a conductive projecting portion projecting in a plane direction from an inner wall of the housing toward the inside of a watch case forming an annular surface radially extending between the inner wall of the housing and an inner circumference of the conductive portion; and an opening penetrating the conductive projecting portion vertically so as to improve receiving characteristics of the antenna, wherein at least part of the annular surface is interrupted by the opening, and wherein the opening penetrates only the conductive projecting portion; the watch case comprising a part of the housing; the conductive projecting portion constituting a conductive dial ring receiving portion projecting in a plane direction from an inner circumferential portion of the watch case toward the inside of the watch case; a dial ring mounted on an upper side of the dial ring receiving portion; and the opening penetrating the conductive dial ring receiving portion in the vertical direction.

2. The wireless function watch according to claim 1, wherein the opening is provided in the vicinity of and above the antenna.

3. The wireless function watch according to claim 2, wherein the opening is provided in the vicinity of and above at least one of open end portions of the antenna and opposed to the at least one open end portion.

4. The wireless function watch according to claim 2, wherein the opening is provided in the vicinity of and above open end portions on both sides of the antenna and opposed to the open end portions.

5. The wireless function watch according to claim 1, wherein: the dial ring is provided with a slit penetrating the dial ring vertically to improve the receiving characteristics of the antenna; and the opening and the slit are arranged at least partially overlapping each other vertically.

6. The wireless function watch according to claim 5, wherein the slit at the dial ring is constituted by fully dividing the dial ring in the circumferential direction.

7. The wireless function watch according to claim 5, wherein the slit in the dial ring is constituted by two holes formed separately from each other by a length corresponding to the distance between both open end portions of the antenna.

8. The wireless function watch according to claim 5, wherein the slit is provided in the vicinity of and above the antenna.

9. The wireless function watch according to claim 5, wherein the slit is provided in the vicinity of and above at least one of open end portions of the antenna and opposed to the at least one open end portion.

10. The wireless function watch according to claim 5, wherein an insulating member presenting a metal appearance is interposed in the slit.

11. The wireless function watch according to claim 5, wherein an insulating member is interposed in the opening.

12. The wireless function watch according to claim 10, wherein the insulating member is made of a non-conductive synthetic resin.

13. The wireless function watch according to claim 10, wherein the color tone of a visible face of the insulating member interposed in the slit is the same as the color tone of an outer face of the dial ring.

14. The wireless function watch according to claim 10, wherein the color tone of a visible face of the insulating member interposed in the slit is different from the color tone of a visible face of the dial ring.

15. The wireless function watch according to claim 10, wherein the insulating member interposed in the slit is provided with an index indicating a watch function display.

16. The wireless function watch according to claim 1, wherein an insulating region is provided between the dial ring in which at least a part thereof is conductive and the watch case in which at least a part thereof is conductive.

17. The wireless function watch according to claim 16, wherein the insulating region is constituted by an insulating member arranged between the dial ring and the watch case.

18. The wireless function watch according to claim 17, wherein the insulating member is affixed to at least either one of boundary faces of the dial ring and the watch case.

19. The wireless function watch according to claim 16, wherein the insulating region is constituted by an insulating coating formed on at least either one of boundary faces of the dial ring and the watch case.

20. The wireless function watch according to claim 19, wherein the insulating coating is formed on an entire face of the dial ring.

21. The wireless function watch according to claim 1, wherein: a bezel is provided in the watch case; and an insulating region is provided between the dial ring in which at least a part thereof is conductive and the bezel in which at least a part thereof is conductive.

22. The wireless function watch according to claim 21, wherein the insulating region is constituted by an insulating member arranged between the dial ring and the bezel.

23. The wireless function watch according to claim 22, wherein the insulating member is affixed to at least either one of boundary faces of the dial ring and the bezel.

24. The wireless function watch according to claim 21, wherein the insulating region is constituted by an insulating coating formed on at least either one of boundary faces of the dial ring and the bezel.

25. The wireless function watch according to claim 24, wherein the insulating coating is formed on an entire face of the bezel.

26. The wireless function watch according to claim 21, wherein an insulating region is provided between the bezel in which at least a part thereof is conductive and the watch case in which at least a part thereof is conductive.

27. The wireless function watch according to claim 26, wherein the insulating region is constituted by an insulating member arranged between the bezel and the watch case.

28. The wireless function watch according to claim 27, wherein the insulating member is affixed to at least either one of boundary faces of the bezel and the watch case.

29. The wireless function watch according to claim 26, wherein the insulating region is constituted by an insulating coating formed on at least either one of boundary faces of the bezel and the watch case.

30. The wireless function watch according to claim 21, wherein the insulating region is arranged in the vicinity of and above the antenna.

31. The wireless function watch according to claim 30, wherein the insulating region is constituted by an insulating region arranged in the vicinity of and above the antenna and opposed to at least one of open end portions of the antenna.

32. The wireless function watch according to claim 30, wherein the insulating region is constituted by two insulating regions arranged in the vicinity of and above the antenna and opposed to open end portions on both sides of the antenna.

33. The wireless function watch according to claim 1, comprising: a bezel arranged on an upper face of the watch case; the conductive dial ring receiving portion projecting in a plane direction from the bezel toward the inside of the watch case.

34. The wireless function watch according to claim 33, wherein the opening is provided in the vicinity of and above the antenna.

35. The wireless function watch according to claim 34, wherein the opening is provided in the vicinity of and above at least one of open end portions of the antenna and opposed to the at least one open end portion.

36. The wireless function watch according to claim 34, wherein the openings are provided in the vicinity of and above open end portions on both sides of the antenna and opposed to the open end portions.

37. The wireless function watch according to claim 33, wherein an insulating region is provided between the dial ring in which at least a part thereof is conductive and the bezel in which at least a part thereof is conductive.

38. The wireless function watch according to claim 37, wherein the insulating region is constituted by an insulating member arranged between the dial ring and the bezel.

39. The wireless function watch according to claim 38, wherein the insulating member is affixed to at least either one of boundary faces of the dial ring and the bezel.

40. The wireless function watch according to claim 37, wherein the insulating region is constituted by an insulating coating formed on at least either one of boundary faces of the dial ring and the bezel.

41. The wireless function watch according to claim 40, wherein the insulating coating is formed on an entire face of the dial ring.

42. The wireless function watch according to claim 33, wherein an insulating region is provided between the bezel in which at least a part thereof is conductive and the watch case in which at least a part thereof is conductive.

43. The wireless function watch according to claim 42, wherein the insulating region is constituted by an insulating member arranged between the bezel and the watch case.

44. The wireless function watch according to claim 43, wherein the insulating member is affixed to at least either one of boundary faces of the bezel and the watch case.

45. The wireless function watch according to claim 42, wherein the insulating region is constituted by an insulating coating formed on at least either one of boundary faces of the bezel and the watch case.

46. The wireless function watch according to claim 45, wherein the insulating coating is formed on an entire face of the bezel.

47. The wireless function watch according to claim 42, wherein the insulating region is arranged in the vicinity of and above the antenna.

48. The wireless function watch according to claim 47, wherein the insulating region is constituted by an insulating region arranged in the vicinity of and above the antenna and opposed to at least one of open end portions of the antenna.

49. The wireless function watch according to claim 47, wherein the insulating region is constituted by two insulating regions arranged in the vicinity of and above the antenna and opposed to open end portions on both sides of the antenna.

50. The wireless function watch according to claim 1, wherein the opening is a notch in the inner circumference of the conductive projecting portion.

51. The wireless function watch according to claim 1, wherein the opening is a slit disposed in the conductive projecting portion.

52. The wireless function watch according to claim 1, wherein the opening is a through hole disposed in the conductive projecting portion.

* * * * *

UNITED STATES PATENT AND TRADEMARK OFFICE

CERTIFICATE OF CORRECTION

PATENT NO. : 8,686,908 B2
APPLICATION NO. : 12/376898
DATED : April 1, 2014
INVENTOR(S) : Kouichi Kusunoki et al.

It is certified that error appears in the above-identified patent and that said Letters Patent is hereby corrected as shown below:

Title Page of the Patent, Column 1, Item (76) Inventors, Line 1, delete "Toyko (JP)" and insert -- Tokyo (JP) --

Signed and Sealed this
Eighth Day of July, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,686,908 B2
APPLICATION NO. : 12/376898
DATED : April 1, 2014
INVENTOR(S) : Kusunoki et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1027 days.

Signed and Sealed this
Twenty-ninth Day of September, 2015

Michelle K. Lee

Michelle K. Lee
*Director of the United States Patent and Trademark Office*